US011559718B2

(12) United States Patent
Davis

(10) Patent No.: US 11,559,718 B2
(45) Date of Patent: Jan. 24, 2023

(54) BARBELL SPOTTING APPARATUS

(71) Applicant: Bradley Davis, Franklin Lakes, NJ (US)

(72) Inventor: Bradley Davis, Franklin Lakes, NJ (US)

( * ) Notice: Subject to any disclaimer, the term of this patent is extended or adjusted under 35 U.S.C. 154(b) by 22 days.

(21) Appl. No.: 17/368,177

(22) Filed: Jul. 6, 2021

(65) Prior Publication Data

US 2021/0394009 A1 Dec. 23, 2021

Related U.S. Application Data

(63) Continuation of application No. 17/060,859, filed on Oct. 1, 2020, now Pat. No. 11,090,523, which is a (Continued)

(51) Int. Cl.
*A63B 21/078* (2006.01)
*A63B 21/072* (2006.01)

(Continued)

(52) U.S. Cl.
CPC ..... *A63B 21/0783* (2015.10); *A63B 21/0724* (2013.01); *A63B 21/153* (2013.01);

(Continued)

(58) Field of Classification Search
CPC ..... A63B 21/072; A63B 21/0724; A63B 21/0726; A63B 21/075; A63B 21/078; A63B 21/0783; A63B 21/151; A63B 21/153; A63B 21/154; A63B 21/156; A63B 21/158; A63B 24/0062; A63B 24/0087; A63B 71/0054; A63B 2071/0081; A63B 2220/833; A63B 21/06; A63B 21/062; A63B 21/0622; A63B 21/0624;

(Continued)

(56) References Cited

U.S. PATENT DOCUMENTS 4,949,959 A 8/1990 Stevens
4,998,721 A * 3/1991 Anders ..... A63B 21/0783 482/4

(Continued)

FOREIGN PATENT DOCUMENTS

WO 2010100493 A1 9/2010

OTHER PUBLICATIONS

International Search Report and Written Opinion of the International Searching Authority for PCT Application No. PCT/US2020/035243, dated Sep. 24, 2020.

(Continued)

*Primary Examiner* — Nyca T Nguyen
*Assistant Examiner* — Zachary T Moore
(74) *Attorney, Agent, or Firm* — Budzyn IP Law, LLC

(57) ABSTRACT

Provided herein are embodiments of a barbell spotting apparatus having all the benefits of a free-floating, unconstrained barbell in both the horizontal and vertical axes with the safety of a dedicated spotting mechanism, while addressing safety, noise, and space concerns raised by typical barbell apparatus. The embodiments herein permit a loaded barbell to be positioned in line with the axis of motion of the lift to be performed at both the beginning and end of the lift.

25 Claims, 73 Drawing Sheets

Related U.S. Application Data continuation of application No. 16/887,110, filed on May 29, 2020, now Pat. No. 10,881,894.

(60) Provisional application No. 62/923,683, filed on Oct. 21, 2019, provisional application No. 62/895,759, filed on Sep. 4, 2019, provisional application No. 62/882,486, filed on Aug. 3, 2019, provisional application No. 62/853,973, filed on May 29, 2019.

(51) Int. Cl.
*A63B 21/00* (2006.01)
*A63B 24/00* (2006.01)
*A63B 71/00* (2006.01)

(52) U.S. Cl.
CPC ..... *A63B 24/0062* (2013.01); *A63B 24/0087* (2013.01); *A63B 71/0054* (2013.01); *A63B 2071/0081* (2013.01); *A63B 2220/833* (2013.01)

(58) Field of Classification Search
CPC ..... A63B 21/0626; A63B 21/0628; A63B 21/063; A63B 21/0632; A63B 21/0728; A63B 21/08; A63B 21/152; A63B 21/4001; A63B 21/4011; A63B 21/4013; A63B 21/4015; A63B 21/4034; A63B 21/4035; A63B 21/4041; A63B 21/4045; G08B 21/0469; G05B 2219/37433
See application file for complete search history.

(56) References Cited

U.S. PATENT DOCUMENTS 5,048,826 A * 9/1991 Ryan ..... A63B 21/00181 482/7
D345,999 S 4/1994 Adkins
5,310,394 A 5/1994 Kallios
5,314,394 A 5/1994 Ronan
6,293,892 B1 * 9/2001 Slawinski ..... A63B 21/152 482/4
6,379,287 B1 4/2002 Slawinski et al.
6,537,182 B2 3/2003 Slawinski et al.
6,669,607 B2 12/2003 Slawinski et al.
6,749,538 B2 6/2004 Slawinski et al.
6,893,381 B2 5/2005 Slawinski
6,926,649 B2 8/2005 Slawinski
7,374,515 B2 5/2008 Slawinski et al.
7,575,538 B1 8/2009 Clark
7,963,886 B1 * 6/2011 Schwinn ..... A63B 21/0783 482/99
9,993,710 B1 * 6/2018 McCoy ..... A63B 67/10
10,878,952 B1 12/2020 Patel et al.
2004/0192519 A1 9/2004 Slawinski
2005/0233871 A1 * 10/2005 Anders ..... A63B 21/0783 482/8
2009/0233769 A1 * 9/2009 Pryor ..... B60R 11/02 482/8
2009/0312162 A1 * 12/2009 Maiaro ..... A63B 21/0626 482/104
2012/0244999 A1 * 9/2012 Tauriainen ..... A63B 21/078 482/104
2014/0213414 A1 7/2014 Balandis et al.
2016/0310789 A1 10/2016 Emerson
2017/0128765 A1 * 5/2017 Garretson ..... G09B 19/0038
2017/0282002 A1 10/2017 Lee
2018/0200562 A1 7/2018 Nesbit et al.

OTHER PUBLICATIONS

Ball Bearing [online], Published Feb. 2, 2018. Retrieved from the Internet <URL: https://www.britannica.com/technology/ball-bearing>.

* cited by examiner

BARBELL SPOTTING APPARATUS

CROSS-REFERENCES TO RELATED APPLICATIONS

This application is a continuation of U.S. patent application Ser. No. 17/060,859, filed Oct. 1, 2020, now allowed, which is a continuation of U.S. patent application Ser. No. 16/887,110, filed May 29, 2020, now U.S. Pat. No. 10,881,894, which claims priority to U.S. Provisional Application No. 62/853,973, filed May 29, 2019, U.S. Provisional Application No. 62/882,486, filed Aug. 3, 2019, U.S. Provisional Application No. 62/895,759, filed Sep. 4, 2019, and, U.S. Provisional Application No. 62/923,683, filed Oct. 21, 2019, the entire contents of which are incorporated by reference herein.

FIELD OF THE INVENTION

The invention relates to weightlifting apparatus and in particular, a barbell spotting apparatus constructed in such a manner as to facilitate both the vertical and horizontal free movement of a loaded barbell.

BACKGROUND

The barbell—core equipment in any resistance training exercise program—has not materially evolved since its origins. Barbell training has successfully withstood the test of time despite two core shortcomings.

First, most, if not all, barbell users require a spotter for safety. This issue is of paramount concern for fitness facility operators. This is especially true for operators whose core facility is not a gym. Currently, operators of multifamily housing, hotels and office complexes face a unique challenge when offering fitness amenities to residents and guests. The need and desire to offer 24-hour gyms fully-equipped with traditional iron pumping equipment such as free-weight barbells and dumbbells is tempered by concerns of liability, noise, space, and risk of bodily injury. This results in fitness rooms becoming watered-down "workout rooms" rather than functional gyms. Prior efforts to eliminate the need for a spotter either force the user to adapt to a predetermined plane of vertical movement and/or restrict the horizontal movement because of interference from the machine itself. At present, fitness facility operators lack an apparatus which supports unencumbered traditional, free-weight training using loaded barbells.

The second core shortcoming is that the resting place of the barbell frequently differs from the starting position of the strength building motion. For example, the bench press exercise requires a loaded barbell be lifted over the lifter's head before starting the exercise. The axis of motion for the exercise is forward of the racking position. In fact, the racking position forces the lifter to place the loaded bar behind the axis of motion. This positioning of the barbell requires hyperextending the shoulders—a common source of injury, especially for older lifters. The required positioning of the barbell before beginning the exercise is more than an inconvenience. The efforts divert energy from the core movement, decrease the maximum weight that can be lifted, and increase risk of injury. Other exercises such as deadlifts require the fitness operator to purchase, store, and maintain stands to properly position a loaded barbell at the starting point of exercise motion.

SUMMARY OF THE INVENTION

There is a need in the art for a barbell spotting apparatus which addresses the shortcomings referenced above. Provided herein are embodiments of a barbell spotting apparatus having all the benefits of a free-floating, unconstrained barbell in both the horizontal and vertical axes with the safety of a dedicated spotting mechanism, while addressing safety, noise, and space concerns raised by typical barbell apparatus. The embodiments herein permit a loaded barbell to be in a starting position in line with the axis of motion of the lift to be performed.

In accordance with an embodiment, a barbell spotting apparatus permitting free-floating movement along both vertical and horizontal planes is disclosed having a frame having spaced-apart booms extending therefrom, at least one column, and two pairs of brake shoes coupled to the at least one column. In some embodiments there are two columns, with a pair of brake shoes coupled to each column. In other embodiments there may be one or more additional columns, or no columns. Each pair of brake shoes is operably coupled to a tensioning device. First and second cables are coupled at respective first ends to respective tensioning devices and routed, such as via pulleys, to depend from the respective frame booms and are coupled at respective second ends to a barbell bar. In further embodiments, cable winders may be provided, in lieu of the brake shoes, to provide braking. Also, the frame may be trestle-shaped having a spaced-apart legs supporting an upper frame.

Apparatus disclosed herein facilitate the free movement in both the vertical and horizontal planes of a suspended barbell from any frame such that the downward movement of the barbell can be attenuated or fully and immediately stopped.

The columns include tracks, which may be for example in the form of flanged edges, extending all or part of their length to engage and/or guide the brake shoes which keep the brake shoe aligned at all times. A bearing surface extending along all or a part of the column is preferably smooth to facilitate movement of the brake shoes when the brake shoes are not actuated.

In one or more embodiments the columns are tapered along all or part of their length. For example and not by way of limitation, the columns have sides sloped outward 8° from base to top end. The taper of the columns, in combination with limitations on the maximum opening of the brake shoes by virtue of the tensioning devices, creates a certain, positive stop at any point along the path of travel without the possibility of slippage along the columns. This is an improvement over the traditional "tooth and groove" apparatus which permits stopping only at distinct, discrete predefined points.

In certain other embodiments, the columns include a mechanical stop positioned to prevent the brake shoes from travelling beyond a certain height. The mechanical stop may be adjustable, such as but not limited to a series of openings at various heights through which a pin may be removably inserted. In still further embodiments, a mechanical stop may include a tapered mechanical stop column operably engaged to a further brake shoe assembly coupled to an adjustment handle. In this embodiment the tapered mechanical stop column allows the user to set the adjustable handle at any point along the path of travel. The user is not forced to select predefined, discrete points which may prove suboptimal. In the extremely unlikely event that a solenoid becomes stuck in the open, unbraked position, the mechanical stop will arrest downward movement beyond the set point selected by the user.

In certain embodiments utilizing the frame booms the aggregate weight of the column or columns may be in the range of from about 1,000-3,000 pounds. For example, in embodiments having two columns, each column may weigh from about 500 to about 1,500 pounds. In other embodiments each column weighs about 1,000 pounds. The weight and positioning of the columns in a rear portion of the frame permits the frame booms to extend well beyond the frame legs. For example, the frame booms may extend as far as three to six feet or more from the closest column. In a further embodiment the column or columns may be configured to be filled with water or sand to provide weight thereto. This allows for lighter-weight construction and transportation. With on-site filling of water or sand, the weight of the column or columns is increased to provide the desired level of counterweight.

The frame and column arrangement facilitates both the vertical and horizontal free movement of a barbell suspended from an overhead extension positioned a considerable distance from the main structure of the frame. Positioning of the column(s) provide(s) a counterweight able to withstand safe operation without anchorage to the prevailing grade. The considerable distance from the frame permits the user to interact with the barbell on both a vertical and horizontal plane in a free-floating manner without interference from the frame. The frame booms may be positioned at such height from the prevailing grade as to permit overhead movement of the loaded barbell above the user's head. Moreover, the weight of the column or columns acts as a counterweight in allowing the barbell to move forward of the frame booms, with moment generated by the weight of the barbell about the frame booms being counteracted by the weight of the columns. The unique construction of the frame permits this apparatus to provide a true free-weight experience. In addition, the unique construction avoids the need for fastening the apparatus to the ground or floor; an advantage for facilities which lease space.

Tensioning devices may be any suitable tensioning device, such as but not limited to a brake fork, friction brake, cable winder, etc.

In one embodiment the first cable may be routed from the tensioning device coupled to the brake shoe pair positioned at a front side of the frame through a series of sheaves or pulleys so that it extends from one frame boom and downward to be coupled to a barbell bar. The second cable may be routed from the second tensioning device coupled to the brake shoe pair positioned at a rear side of the frame through a series of sheaves or pulleys so that it extends from one frame boom and downward to be coupled to the barbell bar. The first and second cables are coupled to the barbell bar in a spaced-apart configuration so as not to interfere with the grip of a lifter. For example, the couplings may be located at or near the barbell collars.

Any suitable barbell such as but not limited to a conventional, unmodified Olympic or powerlifting barbell can be used in conjunction with the disclosed spotting apparatus.

The brake shoes are operably coupled to a brake actuator which may be pneumatic, hydraulic, motorized, or the like. The brake actuator may be mounted to one brake shoe of each brake shoe pair, and triggered by one or more sensors operable to detect one or more qualifying conditions, such as but not limited to: 1. a voice command; 2. a rate of descent that exceeds a predetermined downward velocity or acceleration of the barbell; 3. uneven ascent or descent of the barbell beyond a predetermined set point; 4. a time period of no movement; 5. eye or eyelid movement; 6. pressing of an emergency stop button; and, 7. detectable removal of a hand from the barbell. The brake actuator may be operably coupled to a solenoid which is coupled to one or more sensors for detecting any of the qualifying conditions.

In some embodiments the brake actuator is a pneumatic cylinder having a shaft extending therefrom and terminating in a ball transfer unit. The brake actuator is coupled to a pneumatic directional control solenoid valve. In one embodiment, the pneumatic cylinder in a resting, or unactuated, state urges the shaft against a bearing surface of the column, maintaining the pair of brake shoes in an unbraked state, disengaged from the column. In an unactuated state, the ball of the ball transfer unit permits a smooth rolling coupling between the column bearing surface and the shaft of the pneumatic cylinder. When the brake actuator is actuated, the shaft is retracted, engaging the brake shoes with the column, preventing downward movement of the barbell. This is an improvement over the traditional "tooth and groove" apparatus which permits stopping only at distinct, discrete predefined points.

One or more sensors or detectors operably coupled to the brake actuators, for example via a controller and solenoid, can be mounted to the frame in position to detect a qualifying condition requiring braking. For example, and not by way of limitation, one or more microphones may be positioned to receive a voice command or utterance. One or more eye or eyelid motion readers may be positioned on the apparatus. One or more accelerometers may be positioned to detect free-fall of one or both ends of the barbell. Cable counters may be positioned on both the left and right load bearing cables to detect an unduly rapid descent or an uneven ascent or descent as determined by a processor in evaluating the difference in readings between the left and right load bearing cables as measured by cable counters. One or more emergency stop buttons operably coupled to the brake actuators may be positioned on the frame.

In some embodiments, the cylindrical surface of the bar between the collars contains a grip sensor. Any suitable barbell grip sensor and/or sensor system may be employed, including but not limited to those disclosed in for example U.S. Pat. Nos. 6,537,182 and 6,749,538, incorporated herein by reference in their entirety. A topcoat may be applied to the sensor material making the surface waterproof and offering very similar tactile properties to the native surface of an unmodified barbell. A particularly suitable grip sensor which utilizes a topcoat is found in U.S. Provisional Patent Application No. 62/895,759, the entire contents of which are incorporated by reference herein. In embodiments which employ a grip sensor, the sensor is operably coupled to the solenoid as well as a visual control system.

In practice, with embodiments utilizing the brake shoes, when the apparatus is at rest, the downward force of the barbell is transmitted through the cable and pulleys, exerting a force tightening the tensioning device which in turn presses the brake shoes firmly against the column(s). The brake shoes are engaged. In the event pneumatic or hydraulic pressure or electrical power is lost, the brake shoes will engage and the downward movement of the barbell will halt.

In certain embodiments the apparatus includes cable winders which permit the barbell to be raised or lowered to a selected position. In these embodiments, with the apparatus at rest, the cable winders resist downward movement of the barbell.

In certain embodiments a barbell spotting apparatus is provided for exercise with unconstrained movement of a barbell, the barbell spotting apparatus including: a frame; a first cable guide supported by the frame to be movable in multiple axes relative thereto; a second cable guide supported by the frame to be movable in multiple axes relative thereto; a first cable connected to a first end of the barbell, the first cable being suspended from the first cable guide such that the first cable is movable in multiple axes in response to movement of the first end of the barbell; a second cable connected to a second of the barbell, the second cable being suspended from the second cable guide such that the second cable is movable in multiple axes in response to movement of the second end of the barbell; a first brake associated with the first cable, the first brake being actuatable from a rest state to a braking state, wherein, in the rest state, the first cable is extendible to allow downward movement of the barbell, and, wherein, in the braking state, the first cable is not extendible to restrict downward movement of the barbell; a second brake associated with the second cable, the second brake being actuatable from a rest state to a braking state, wherein, in the rest state, the second cable is extendible to allow downward movement of the barbell, and, wherein, in the braking state, the second cable is not extendible to restrict downward movement of the first cable; and, at least one detector configured to detect a qualifying condition during use requiring downward movement of the barbell to be restricted, wherein, upon detection of a qualifying condition, the at least one detector transmits an actuation signal to at least one of the first brake and the second brake, wherein, the first and second brakes are independently actuatable.

In certain embodiments a barbell spotting apparatus is provided for exercise with unconstrained movement of a barbell, the barbell spotting apparatus including: a frame; a first cable, suspended from the frame, connected to a first end of the barbell; a second cable, suspended from the frame, connected to a second of the barbell; a first brake associated with the first cable, the first brake being actuatable from a rest state to a braking state, wherein, in the rest state, the first cable is extendible to allow downward movement of the barbell, and, wherein, in the braking state, the first cable is not extendible to restrict downward movement of the barbell; a second brake associates with the second cable, the second brake being actuatable from a rest state to a braking state, wherein, in the rest state, the second cable is extendible to allow downward movement of the barbell, and, wherein, in the braking state, the second cable is not extendible to restrict downward movement of the first cable; and, at least one detector configured to detect a qualifying condition during use requiring movement of the barbell to be restricted, wherein, upon detection of a qualifying condition, the at least one detector transmits an actuation signal to at least one of the first brake and the second brake, wherein, with the first and second brakes being each in the rest state, the first and second cables allow the barbell to move in multiple degrees of freedom relative to the frame without contacting the frame, and, wherein, the first and second brakes are independently actuatable.

In certain embodiments a barbell spotting apparatus is provided for exercise with unconstrained movement of a barbell, the barbell spotting apparatus including: a frame having an elongated trolley support frame; a first trolley resting on the trolley support frame so as to be movable therealong; a second trolley resting on the trolley support frame so as to be movable therealong; a first cable connected to a first end of the barbell, the first cable being suspended from the first trolley; a second cable connected to a second of the barbell, the second cable being suspended from the second trolley; a first brake associated with the first cable, the first brake being actuatable from a rest state to a braking state, wherein, in the rest state, the first cable is extendible to allow downward movement of the barbell, and, wherein, in the braking state, the first cable is not extendible to restrict downward movement of the barbell; a second brake associated with the second cable, the second brake being actuatable from a rest state to a braking state, wherein, in the rest state, the second cable is extendible to allow downward movement of the barbell, and, wherein, in the braking state, the second cable is not extendible to restrict downward movement of the first cable; and, at least one detector configured to detect a qualifying condition during use requiring downward movement of the barbell to be restricted, wherein, upon detection of a qualifying condition, the at least one detector transmits an actuation signal to at least one of the first brake and the second brake, wherein, the first and second brakes are independently actuatable.

In certain embodiments a barbell spotting apparatus is provided for exercise with unconstrained movement of a barbell, the barbell spotting apparatus including: a frame including first and second overhanging booms; a first fork being pivotably mounted to the first boom; a second fork being pivotably mounted to the second boom; a first cable connected to a first end of the barbell, the first cable being suspended from the first fork; a second cable connected to a second of the barbell, the second cable being suspended from the second fork; a first brake associated with the first cable, the first brake being actuatable from a rest state to a braking state, wherein, in the rest state, the first cable is extendible to allow downward movement of the barbell, and, wherein, in the braking state, the first cable is not extendible to restrict downward movement of the barbell; a second brake associated with the second cable, the second brake being actuatable from a rest state to a braking state, wherein, in the rest state, the second cable is extendible to allow downward movement of the barbell, and, wherein, in the braking state, the second cable is not extendible to restrict downward movement of the first cable; and, at least one detector configured to detect a qualifying condition during use requiring downward movement of the barbell to be restricted, wherein, upon detection of a qualifying condition, the at least one detector transmits an actuation signal to at least one of the first brake and the second brake, wherein, the first and second brakes are independently actuatable.

In certain embodiments a barbell spotting apparatus is provided for exercise with unconstrained movement of a barbell, the barbell spotting apparatus including: a frame; a first cable connected to a first end of the barbell, the first cable being suspended from the frame; a second cable connected to a second of the barbell, the second cable being suspended from the frame; a rotatable first dual drum winch having first and second drums connected so as to rotate together, the first drum having a different diameter from the second drum, wherein the first cable is connected to the first drum; a rotatable second dual drum winch having first and second drums connected so as to rotate together, the first drum having a different diameter from the second drum, wherein the second cable is connected to the second drum; a first brake connected to the second drum of the first dual drum winch by a third cable, the first brake being actuatable from a rest state to a braking state, wherein, in the rest state, the third cable is free to move to allow the first dual drum winch to pay out the first cable to allow downward movement of the barbell, and, wherein, in the braking state, the third cable is not free to move restricting the first dual drum winch from paying out the first cable to restrict downward movement of the barbell; a second brake connected to the second drum of the second dual drum winch by a fourth cable, the second brake being actuatable from a rest state to a braking state, wherein, in the rest state, the fourth cable is free to move to allow the second dual drum winch to pay out the second cable to allow downward movement of the barbell, and, wherein, in the braking state, the fourth cable is not free to move restricting the second dual drum winch from paying out the second cable to restrict downward movement of the barbell; and, at least one detector configured to detect a qualifying condition during use requiring downward movement of the barbell to be restricted, wherein, upon detection of a qualifying condition, the at least one detector transmits an actuation signal to at least one of the first brake and the second brake, wherein, the first and second brakes are independently actuatable.

The weightlifter may interact with the barbell in the same manner as a conventional barbell. No accommodation or compromise is needed on the lifter's part. The weightlifter can perform any exercise involving vertical or horizontal movement of a conventional barbell, allowing for free movement of the barbell with multiple degrees of freedom. Exercises include but are not limited to squats, bench press, shoulder press, overhead press, leg thrusts, curls, etc. In addition, the overhead reach of the frame permits CrossFit™ exercises. The barbell is free to move both horizontally and vertically; the barbell is not affixed to a track. The barbell is suspended a substantial distance from the frame of the apparatus. This arrangement permits fluidity of movement. The machine conforms to the weightlifter, instead of the weightlifter conforming to the machine. A significant advantage is that the weightlifter starts the exercise with the loaded barbell in position to execute the productive, beneficial movement. For example, a bench presser can position themselves so that there is no need to extend the shoulders behind the head to position the weights and then begin the exercise. Similarly, the weightlifter ends the exercise at the natural conclusion of the productive movement, there is no need to re-rack the barbell or drop the loaded barbell on the floor. In addition, the apparatus of the subject invention provides for spotting for a person in a wheelchair or other disability, allowing for the barbell to be brought to a desired height for an exercise and suspension of the barbell at a height upon completion.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

FIGS. 18E-18G are different views of a bearing in accordance with an embodiment of the present disclosure;

DETAILED DESCRIPTION

Figure 1:
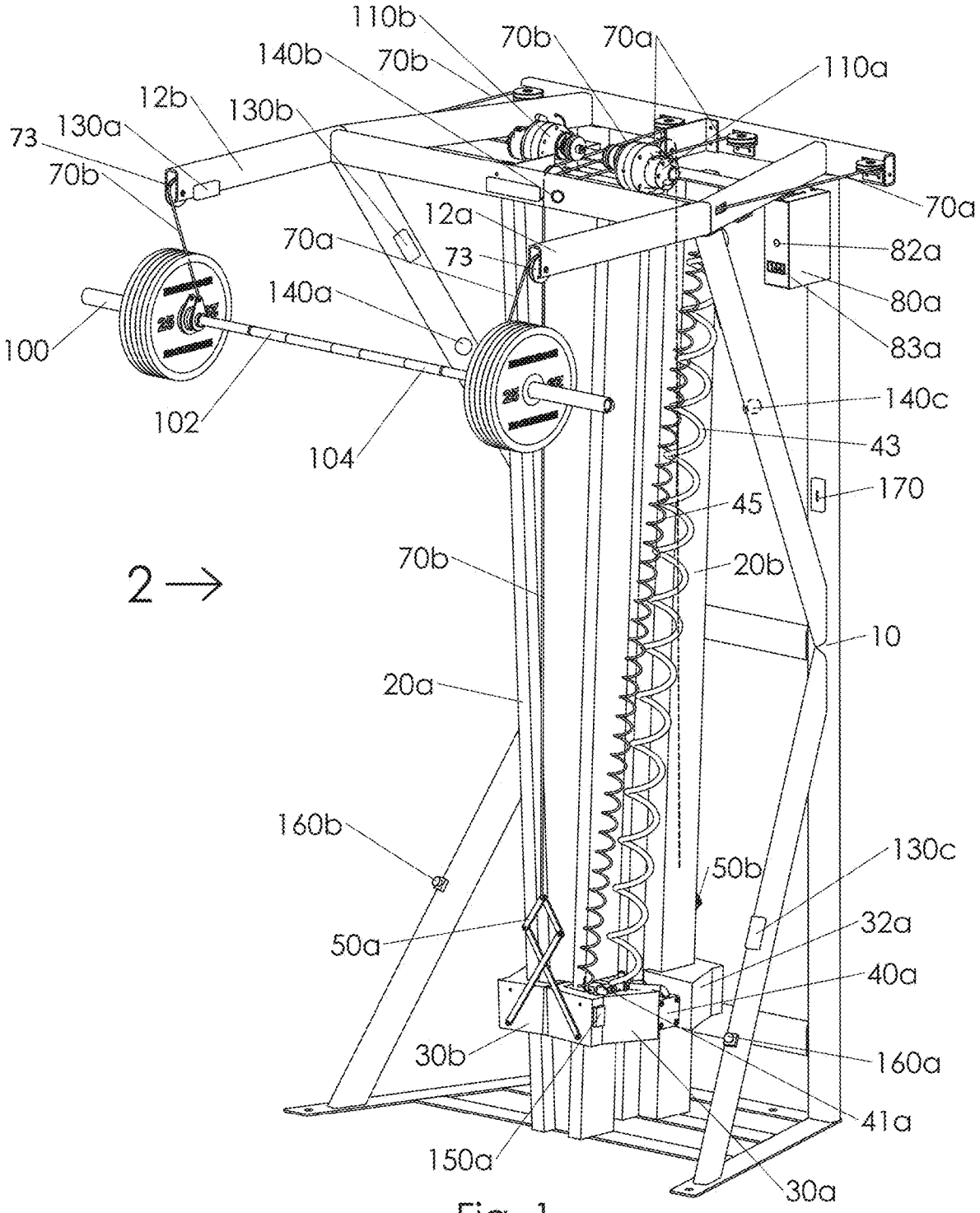
FIG. 1 is an elevated perspective view of a barbell spotting apparatus with the barbell in a raised position in accordance with an embodiment of the present disclosure.
Figure 2:
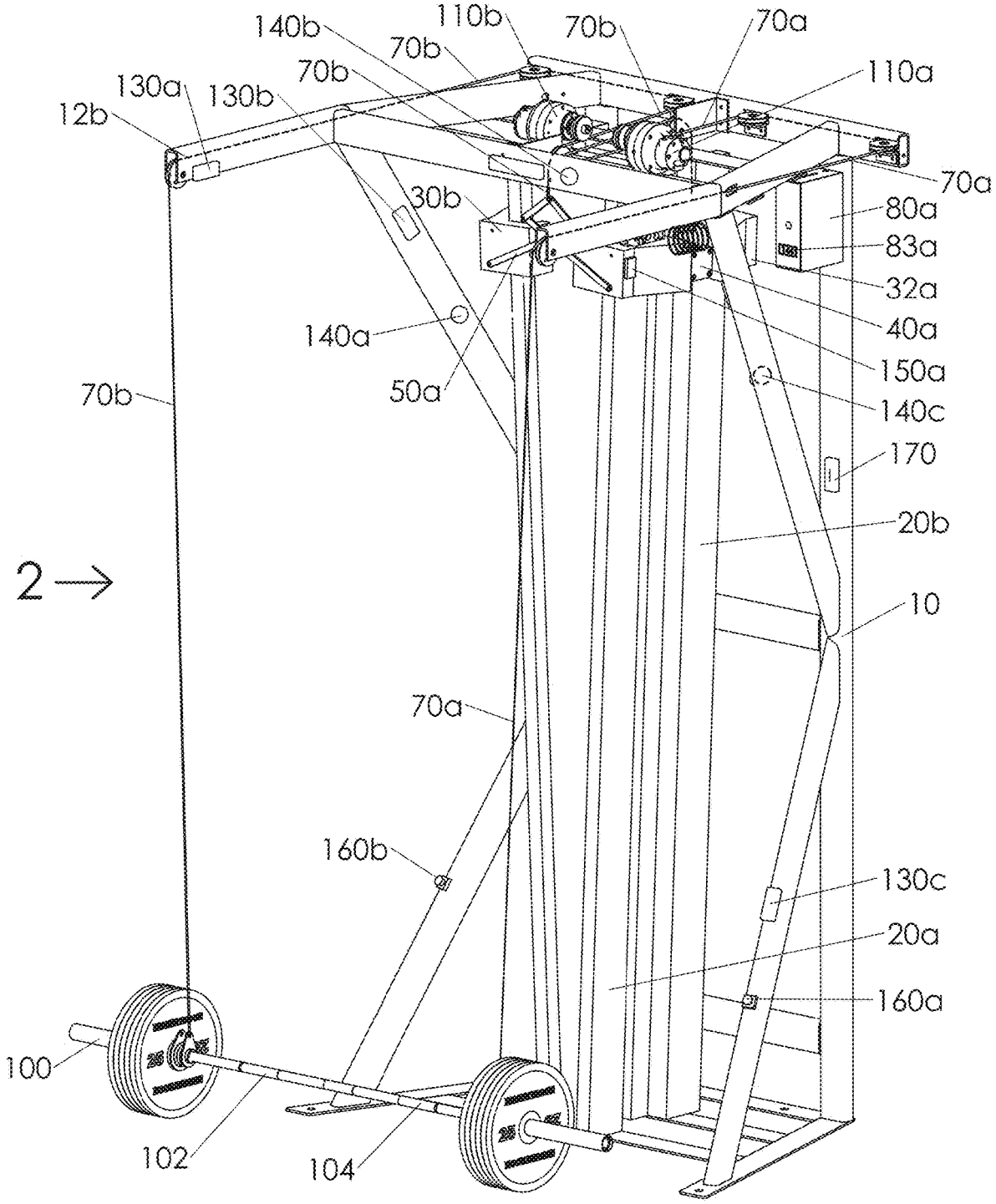
FIG. 2 is an elevated perspective view of a barbell spotting apparatus in a lowered position in accordance with an embodiment of the present disclosure.
Figure 3:
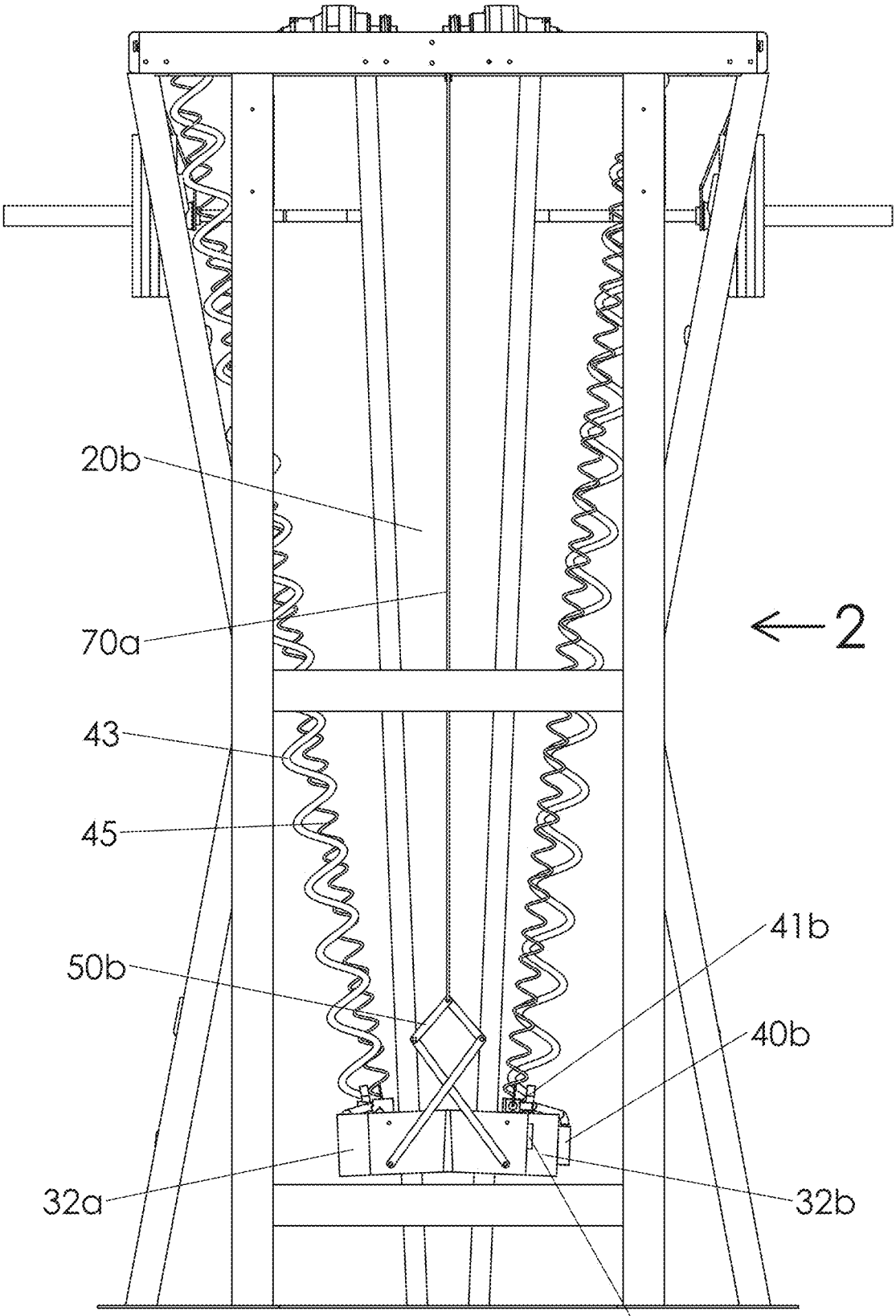
FIG. 3 is a rear view of a barbell spotting apparatus in accordance with an embodiment of the present disclosure.
Figure 4:
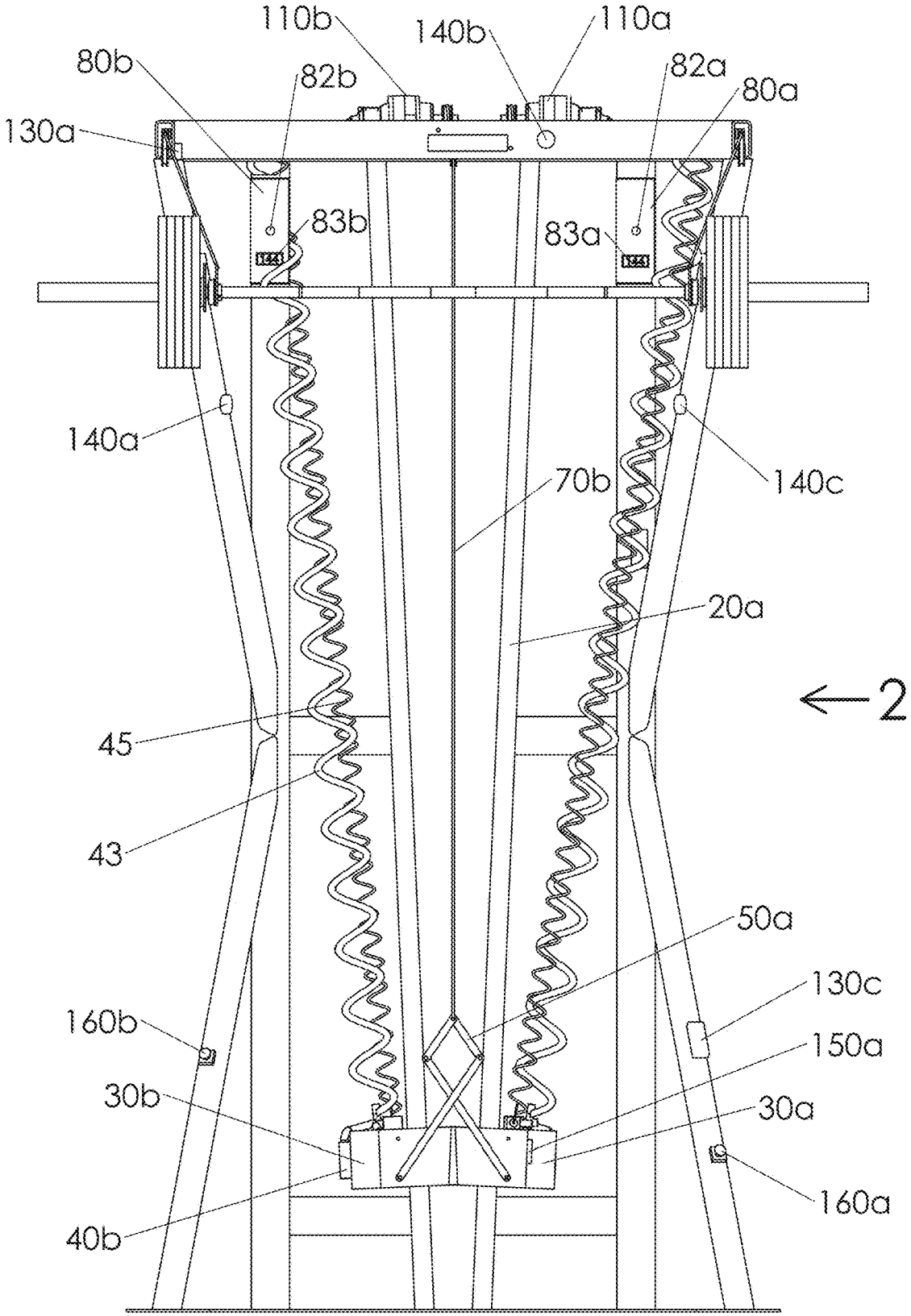
FIG. 4 is a rear view of a barbell spotting apparatus in accordance with an embodiment of the present disclosure.
Figure 5:
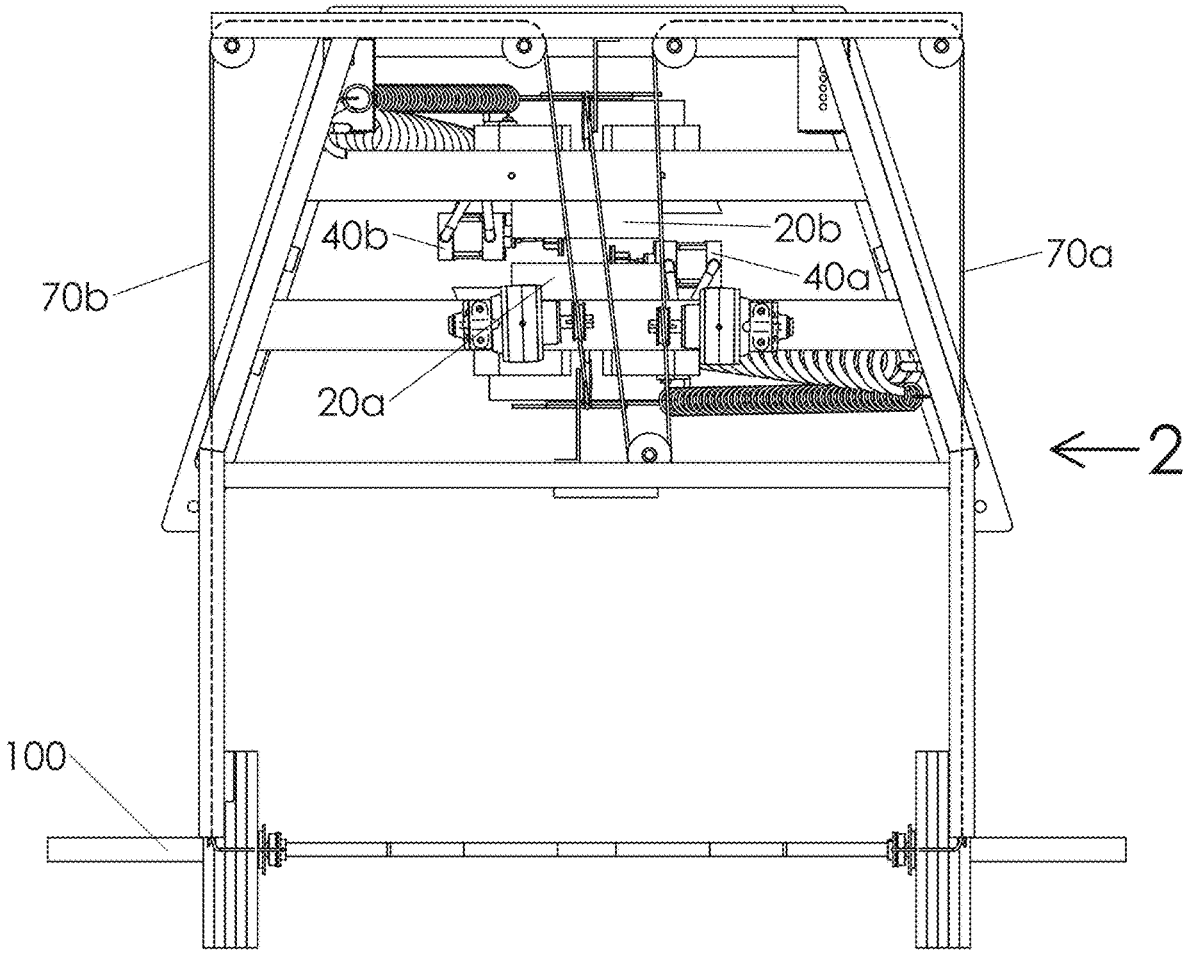
FIG. 5 is a top plan view of a barbell spotting apparatus in accordance with an embodiment of the present disclosure.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the present invention will now be described with reference to the FIGs. With reference to FIGS. 1-5, in accordance with an embodiment a barbell spotting apparatus 2 is disclosed having a frame 10 having spaced-apart booms 12*a* and 12*b* extending therefrom, columns 20*a* and 20*b*, a first pair of brake shoes 30*a*, 30*b* coupled to column 20*a* and second pair of brakes shoes 32*a*, 32*b* coupled to column 20*b*. One skilled in the art will recognize a single unitary column having the features of two separate columns 20*a*, 20*b* may be employed and still accommodate both pairs of brake shoes. Brake shoes 30*a*, 30*b* are coupled to a first end of tensioning device 50*a*, and brake shoes 32*a*, 32*b* are coupled to a first end of tensioning device 50*b*. Cable 70*a* is coupled at a first end to tensioning device 50*b* and routed via a series of pulleys, to depend from frame boom 12*a* and coupled at a second end to a barbell bar 102 of barbell 100. One of the pulleys 73 may be located at the end of the frame boom 12*a* to act as a cable guide for the cable 70*a*, with the cable 70*a* being suspended therefrom. Cable 70*b* is coupled at a first end to tensioning device 50*a* and routed via a series of pulleys to depend from frame boom 12*b* and coupled at a second end to barbell bar 102. One of the pulleys 73 may be located at the end of the frame boom 12*b* to act as a cable guide for the cable 70*b*, with the cable 70*b* being suspended therefrom. The cables 70*a*, 70*b* are coupled to the barbell bar 102 in a spaced-apart configuration so as not to interfere with the grip of a lifter. Booms 12*a* and 12*b* may be any suitable length.

Tensioning devices 50*a*, 50*b* as shown are in the form of a fork. Other tensioning devices such as but not limited to climbing brakes may be employed applying the same principle of operation, When the apparatus is at rest, the downward force of the barbell 100 is transmitted through the cables 70*a*, 70*b* and pulleys, exerting a force tightening the tensioning devices 50*a*, 50*b* which in turn press the brake shoes 30*a*, 30*b* and 32*a*, 32*b* firmly against the respective columns 20*a*, 20*b*, preventing downward movement of the barbell 100. The brake shoes 30*a*, 30*b* and the brake shoes 32*a*, 32*b* are each configured as a caliper brake, configured to apply inward pressure.

Figure 6A:
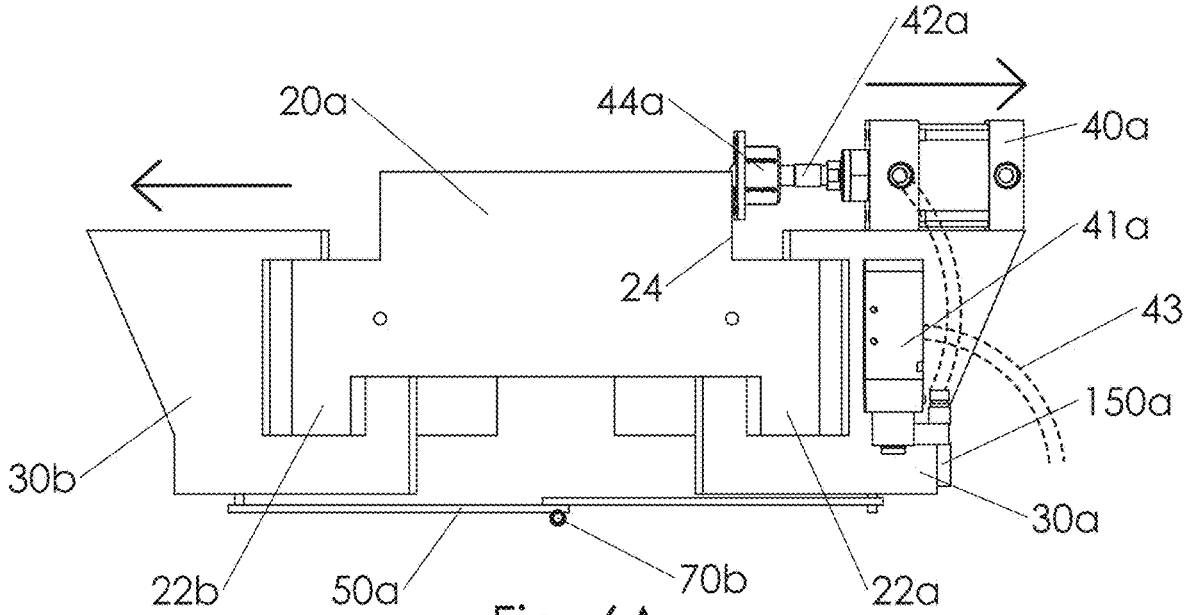
FIG. 6A is a top plan view of a pair of brake shoes coupled to a column in a disengaged position in accordance with an embodiment of the present disclosure.
Figure 6B:
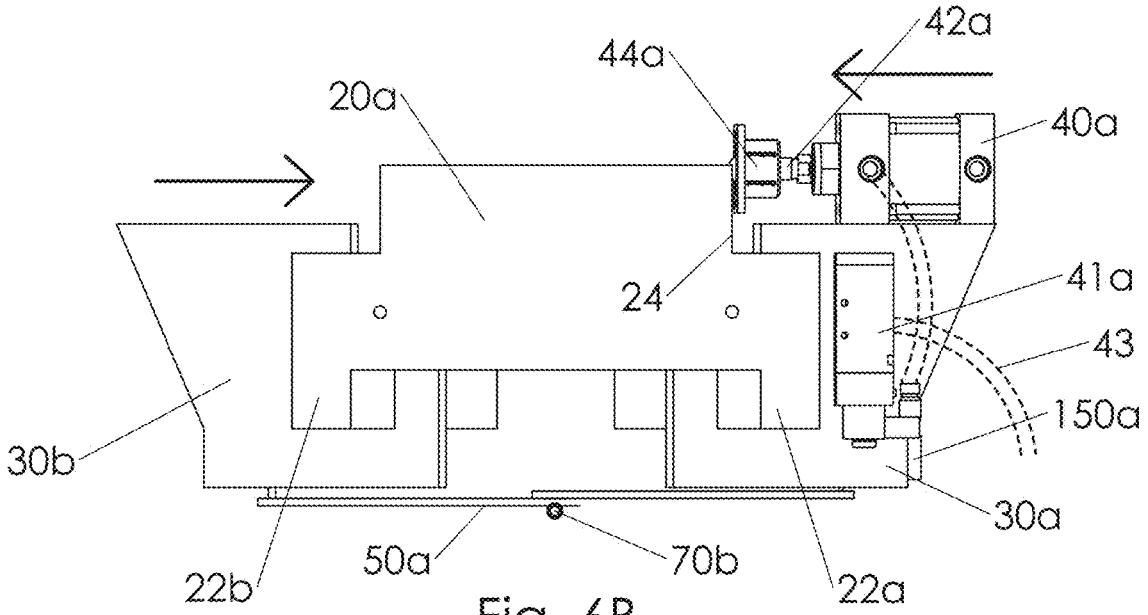
FIG. 6B is a top plan view of a pair of brake shoes coupled to a column in an engaged position in accordance with an embodiment of the present disclosure.
Figure 7A:
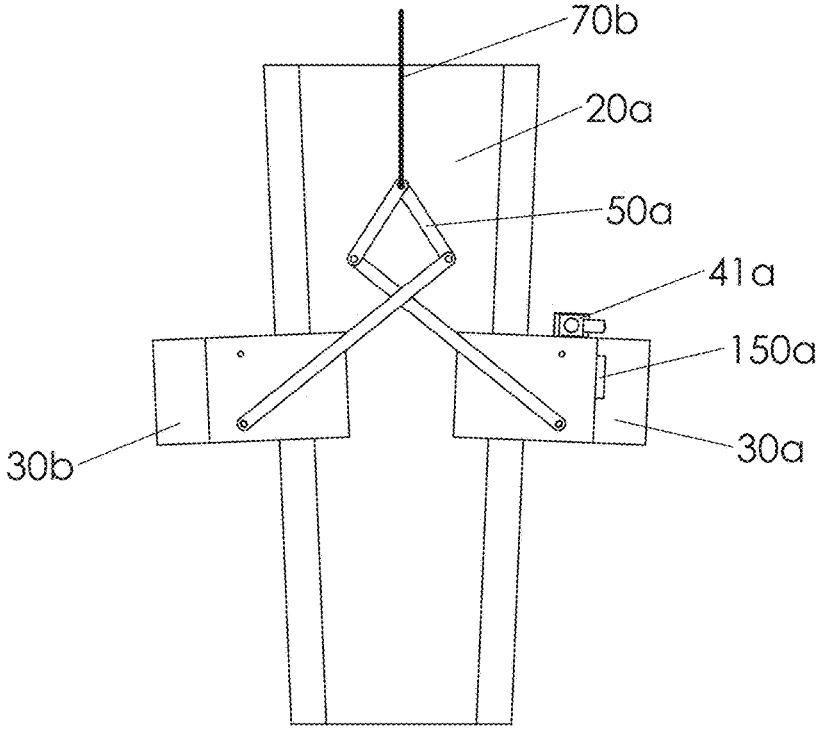
FIG. 7A is a front view of a pair of brake shoes coupled to a column in a disengaged position in accordance with an embodiment of the present disclosure.
Figure 7B:
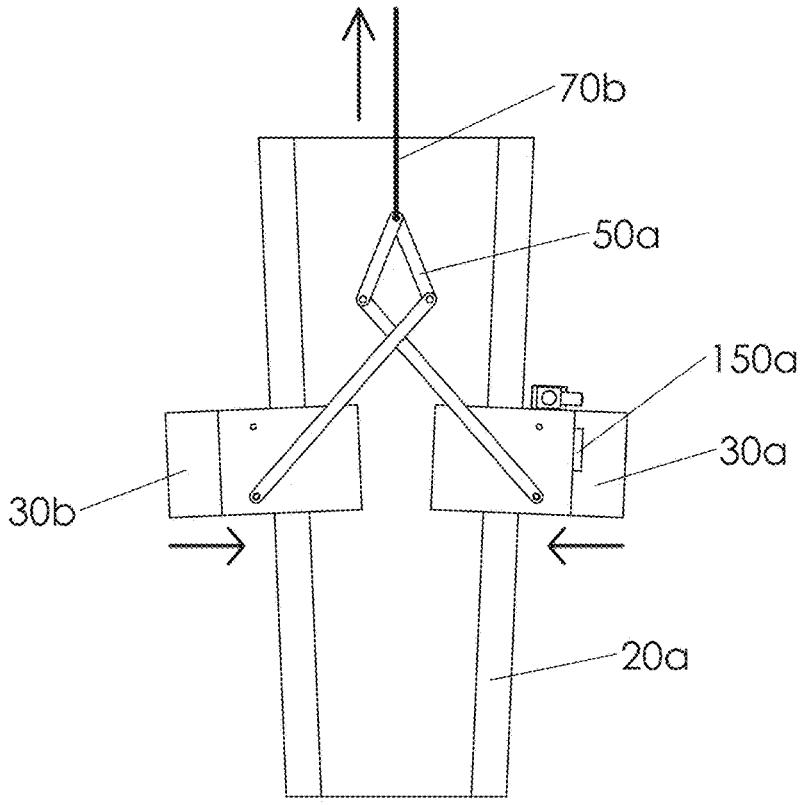
FIG. 7B is a front view of a pair of brake shoes coupled to a column in an engaged position in accordance with an embodiment of the present disclosure.
Figure 8A:
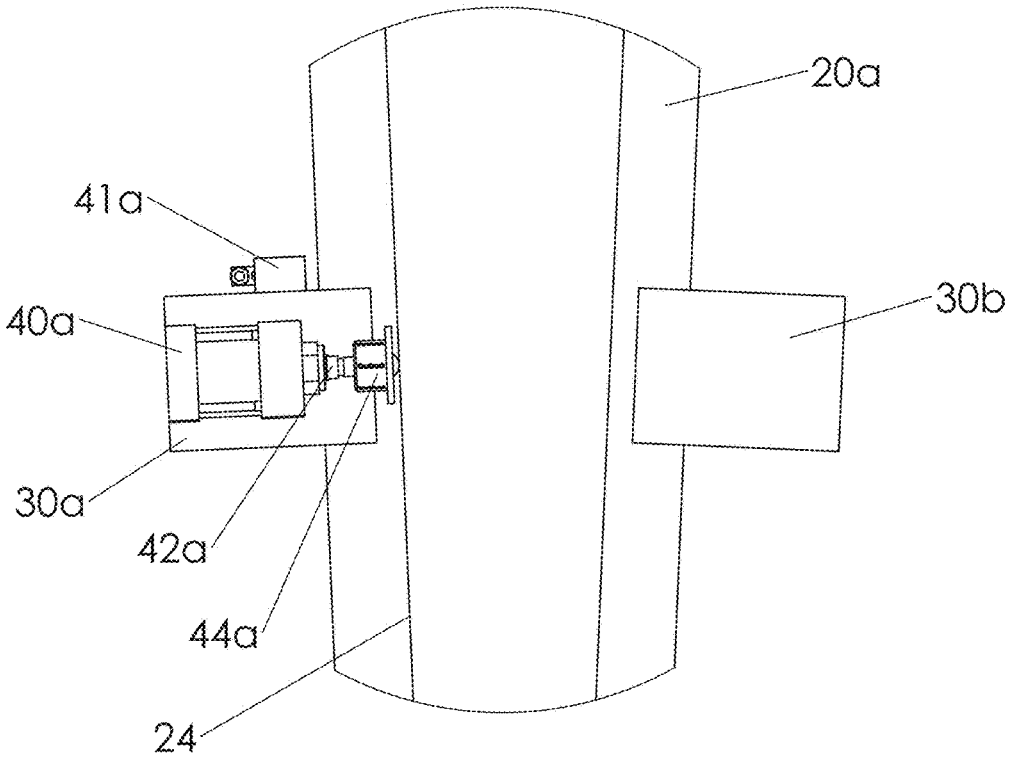
FIG. 8A is a rear view of a pair of brake shoes coupled to a column in a disengaged position in accordance with an embodiment of the present disclosure.
Figure 8B:
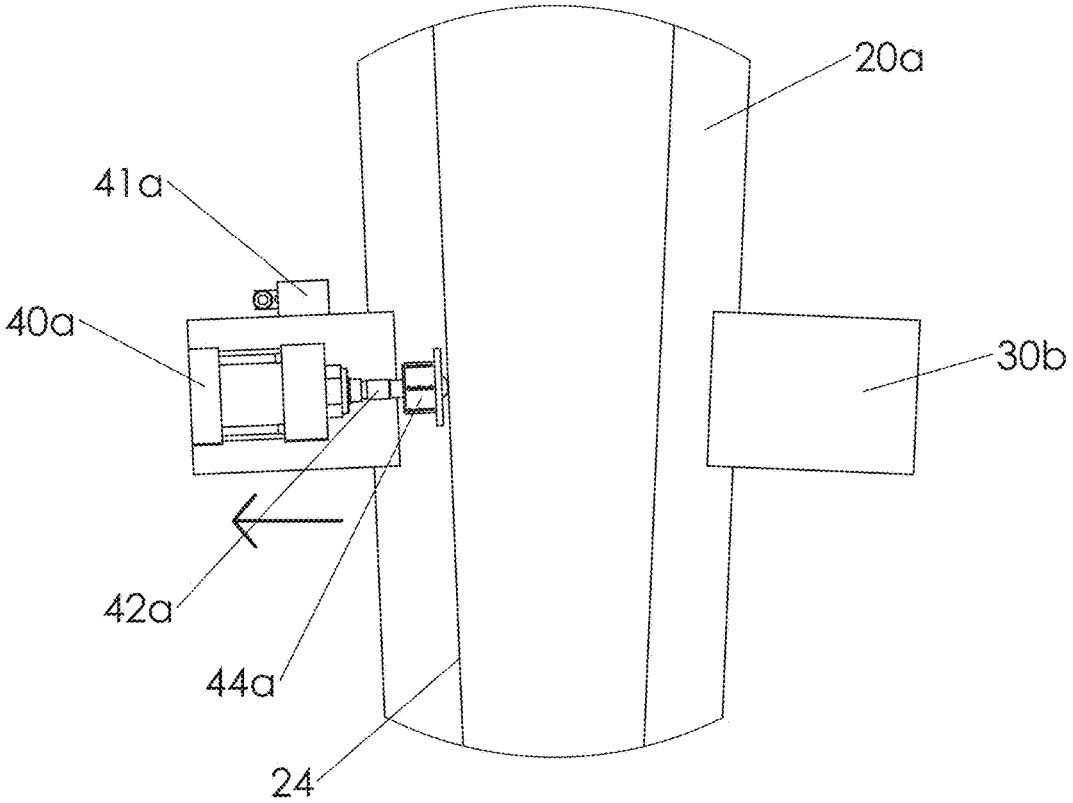
FIG. 8B is a rear view of a pair of brake shoes coupled to a column in an engaged position in accordance with an embodiment of the present disclosure.

The columns 20*a*, 20*b* are preferably identical in configuration. For purposes of brevity the following exemplary description of column 20*a* and its relationship and configuration with respect to brake shoes 30*a*, 30*b* applies equally to column 20*b* and its brake shoes 32*a*, 32*b*. With further reference to FIGS. 6A-6B, the column 20*a* includes flanges 22*a*, 22*b*, extending all or part of the length of the column 20*a* to engage and/or guide the brake shoes 30*a*, 30*b* which keep the brake shoes 30*a*, 30*b* aligned at all times. A bearing surface 24 extending along all or a part of the column 20*a* is preferably smooth to facilitate movement of the brake shoes 30*a*, 30*b* when the brake shoes 30*a*, 30*b* are not actuated.

In one or more embodiments the columns 20*a*, 20*b* are tapered along all or part of their length. For example and not by way of limitation, the columns 20*a*, 20*b* have sides sloped outward 8° from base to top end. The taper of the columns 20*a*, 20*b*, in combination with limitations on the maximum opening of the brake shoes 30*a*, 30*b*, 32*a*, 32*b* by virtue of the tensioning devices 50*a*, 50*b*, creates a certain stop without the possibility of slippage along the columns 20*a*, 20*b*.

The columns 20*a*, 20*b* may be made of any suitable material. Preferably, the columns 20*a*, 20*b* weigh several times the range of weight anticipated to be used for exercise (i.e., the weight of the barbell 100 plus any weight (plates) mounted thereto). This allows for a counterweight effect with, not only a margin of safety, but also freedom to move ahead of the booms 12*a*, 12*b*, with any resulting increased moment being counteracted. In certain embodiments, and not by way of limitation, the aggregate weight of the columns 20*a*, 20*b* may be in the range of from about 1,000-3,000 pounds. For example, in embodiments having two columns, each column 20*a*, 20*b* may weigh from about 500 to about 1,500 pounds. In other embodiments each column 20*a*, 20*b* weighs about 1,000 pounds. In such embodiments the weight and positioning of the columns 20*a*, 20*b* in a rear portion of the frame permits the frame booms 12*a*, 12*b* to extend well beyond columns 20*a*, 20*b* and the rest of the supporting structures of the frame 10. For example, the frame booms 12*a*, 12*b* may extend as far as three to six feet from the closest column 20*a*. The arrangement of the frame 100 and columns 20*a*, 20*b* facilitates both the vertical and horizontal free movement of a barbell 100 suspended from an overhead extension positioned a considerable distance from the main structure of the frame. Placement of the columns 20*a*, 20*b* provides a counterweight able to withstand safe operation without anchorage to the prevailing grade. The considerable distance from the frame 10 permits the user to interact with the barbell 100 without interference from the frame 10. Moreover, the distance permits a user to face the apparatus 2 during lifting, allowing the user to see the apparatus and at least some of its safety features, and allowing the various sensors to detect user input as described below.

Any suitable barbell 100 such as but not limited to a conventional, unmodified Olympic or powerlifting barbell can be used in conjunction with the disclosed spotting apparatus.

The apparatus may include one or more cable winders 110*a*, 110*b*, which may be operably coupled to a switch 170. The cable winders 110*a*, 110*b* may be for example electric, hydraulic or pneumatic motors, each having a pulley coupled to cables 70*a*, 70*b*, respectively. In the exemplary embodiments shown in FIGS. 1-5 and 12 the cable winders are pneumatically controlled. The cable winders 110*a*, 110*b* may be employed to raise or lower the barbell 100. When the cable winders 110*a*, 110*b* are not engaged, for example, when the lifter is in control of the barbell, the cable winders 110*a*, 110*b* coast so that the cables move freely, adding de minimis resistance and providing no assistance to the lifter.

Figure 9:
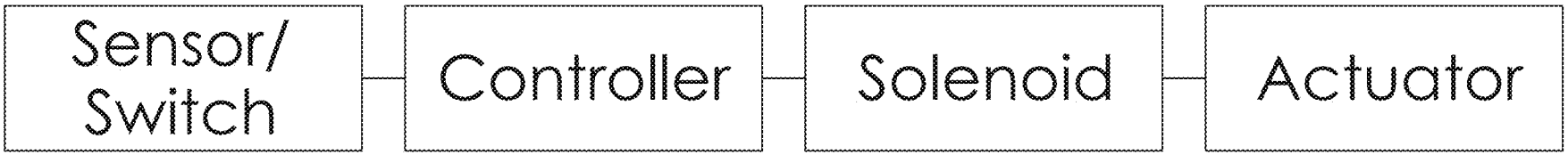
FIG. 9 is a schematic representation of an exemplary signal path in accordance with an embodiment of the present disclosure.

With further reference to FIGS. 6A-8B, the brake shoes 30*a*, 30*b* and 32*a*, 32*b* are operably coupled to brake actuators 40*a*, 40*b*, respectively. It will be understood that although brake shoes 32*a*, 32*b*, actuator 40*b* and solenoid block 41*b* are not shown in FIGS. 6A-8B, the description made in the context of brake shoes 30*a*, 30*b*, actuator 40*a* and solenoid block 41*a* applies with equal force to brake shoes 32*a*, 32*b* actuator 40*b* and solenoid block 41*b*. The brake actuators 40*a*, 40*b* may be pneumatic, hydraulic or motorized. The brake actuators 40*a*, 40*b* may be mounted to one brake shoe of each brake shoe pair, and triggered by a switch or detection by a sensor operable to detect one or more qualifying conditions, as discussed further below, such as, but not limited to, a voice command, detection of a predetermined downward velocity or acceleration of the barbell, uneven barbell movement, a time period of no movement, eye or eyelid movement, emergency stop switch, detectable removal of a hand from the barbell, or the like. With further reference to FIG. 9, switches/sensors may be operably coupled to a controller containing one or more processors operably coupled to a solenoid, which in turn activates the brake actuators 40*a*, 40*b*.

In the non-limiting embodiments shown the brake actuators 40*a*, 40*b* are pneumatic cylinders operably coupled to solenoid blocks 41*a*, 41*b*, respectively. In accordance with one embodiment, electrical cables 45 operably couple solenoid blocks 41*a*, 41*b* to a processor, which in turn may be coupled to a sensor or switch. Solenoid blocks 41*a*, 41*b* may be positioned in any suitable location, such as but not limited to adjacent or on one brake shoe of each pair.

The solenoid blocks 41*a*, 41*b* may include one or more valves for controlling flow of compressed air supplied via air lines 43. Suitable commercially available pneumatic cylinders include but are not limited to D-series heavy duty pneumatic cylinders from Nitra Pneumatics of Cumming, Ga. The solenoid blocks 41*a*, 41*b* may be and/or include any suitable commercially available pneumatic control valve(s), such as but not limited to an AVS-5 series pneumatic directional control solenoid valve from Nitra Pneumatics, or the like. One skilled in the art will recognize the type of valves and solenoids employed in solenoid blocks 41*a*, 41*b* may depend on space considerations, load demand, etc. The solenoid blocks 41*a*, 41*b* are coupled via hoses 43 to a pneumatic control box 80*a* and in some cases an electrical power source and control box 80*b* via electrical lines 45 to operate the valve(s) thereof.

Brake actuator 40*a* includes a shaft 42*a* extending therefrom and terminating in a ball transfer unit 44*a*. In a resting, unactuated state, shaft 42*a* extends from brake shoe actuator 40*a*, urging a ball transfer unit 44*a* against a bearing surface 24 of the column 20*a*, maintaining the pair of brake shoes 30*a*, 30*b* in an unbraked state, disengaged from the column 20*a*. In an unactuated state, the ball of the ball transfer unit 44*a* permits a smooth rolling coupling between the column bearing surface 24 and the shaft 42*a*. When the brake actuator 40*a* is actuated, the shaft 42*a* is retracted, engaging the brake shoes 30*a*, 30*b* with the column 20*a*, preventing downward movement of the barbell 100.

The control boxes 80*a*, 80*b* may be any suitable control boxes, and include suitable controls. For example with reference to FIG. 9, in one embodiment, control box 80*b* houses electronics including one or more processors operably coupled to sensors, switches and solenoids as described. The control box 80*b* for example may include an IEC male chassis socket plug connector, one or more step down transformers, terminal blocks, voice control interface circuit board, host side processor, cable counter processor, accelerometer processor, camera/video interface circuit board, emergency stop processor, cable winder switch interface, etc. Power may be supplied to the control box 80*b* as well as any other components of the apparatus 2 requiring power by means of any suitable power source such as but not limited to a battery, AC or DC power source. The processors and circuit boards can be programmed in a variety of ways well known to those skilled in the art. For example, and not by way of limitation, one or more processors can be programmed so that if one of the sensors detects the barbell 100 free-falls more than a predetermined distance, such as but not limited to one foot, the brake shoes 30*a*, 30*b*, 32*a*, 32*b* are automatically engaged.

Figure 11:
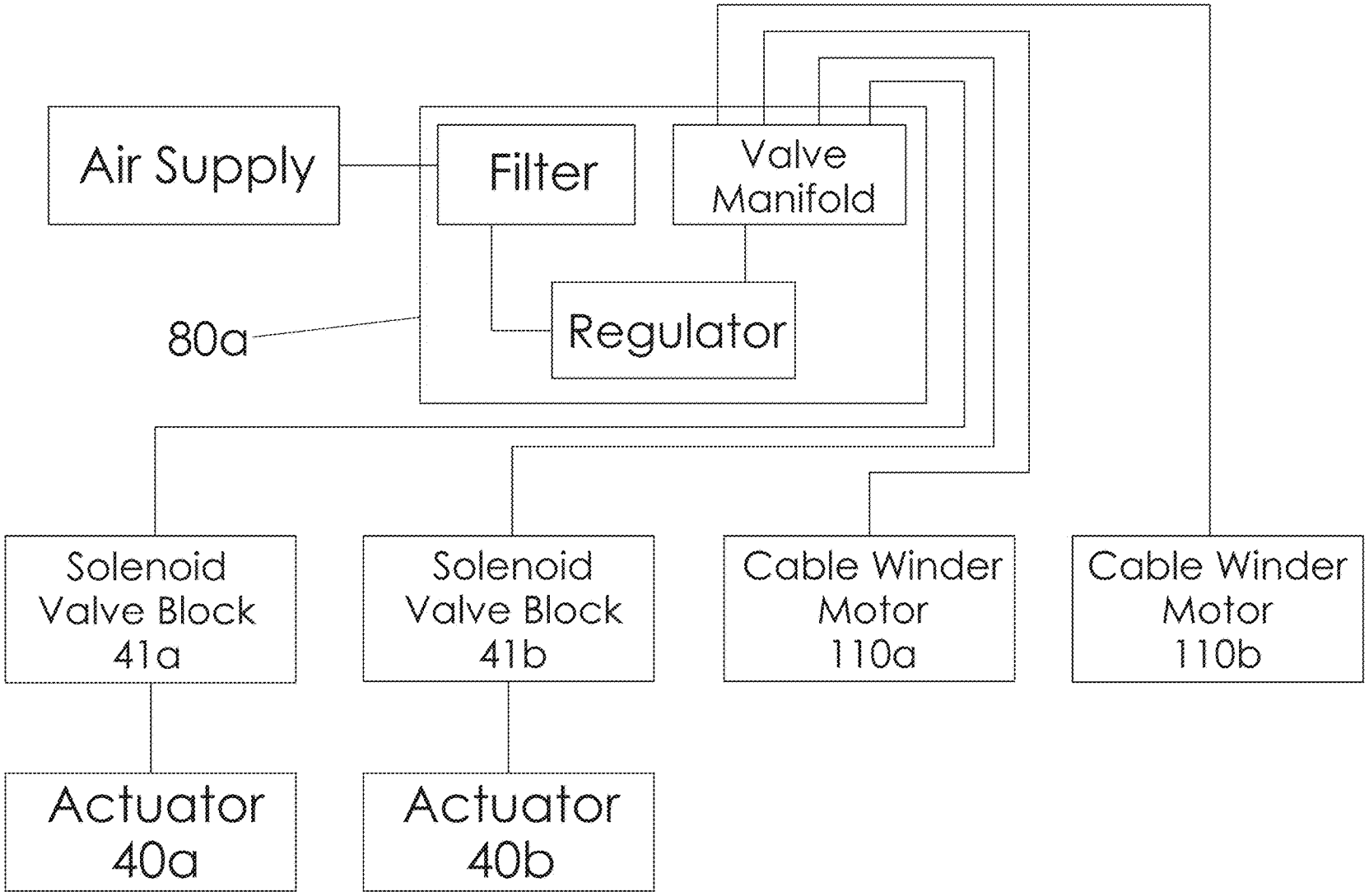
FIG. 11 is a schematic representation of an exemplary pneumatic system in accordance with an embodiment of the present disclosure.
Figure 12:
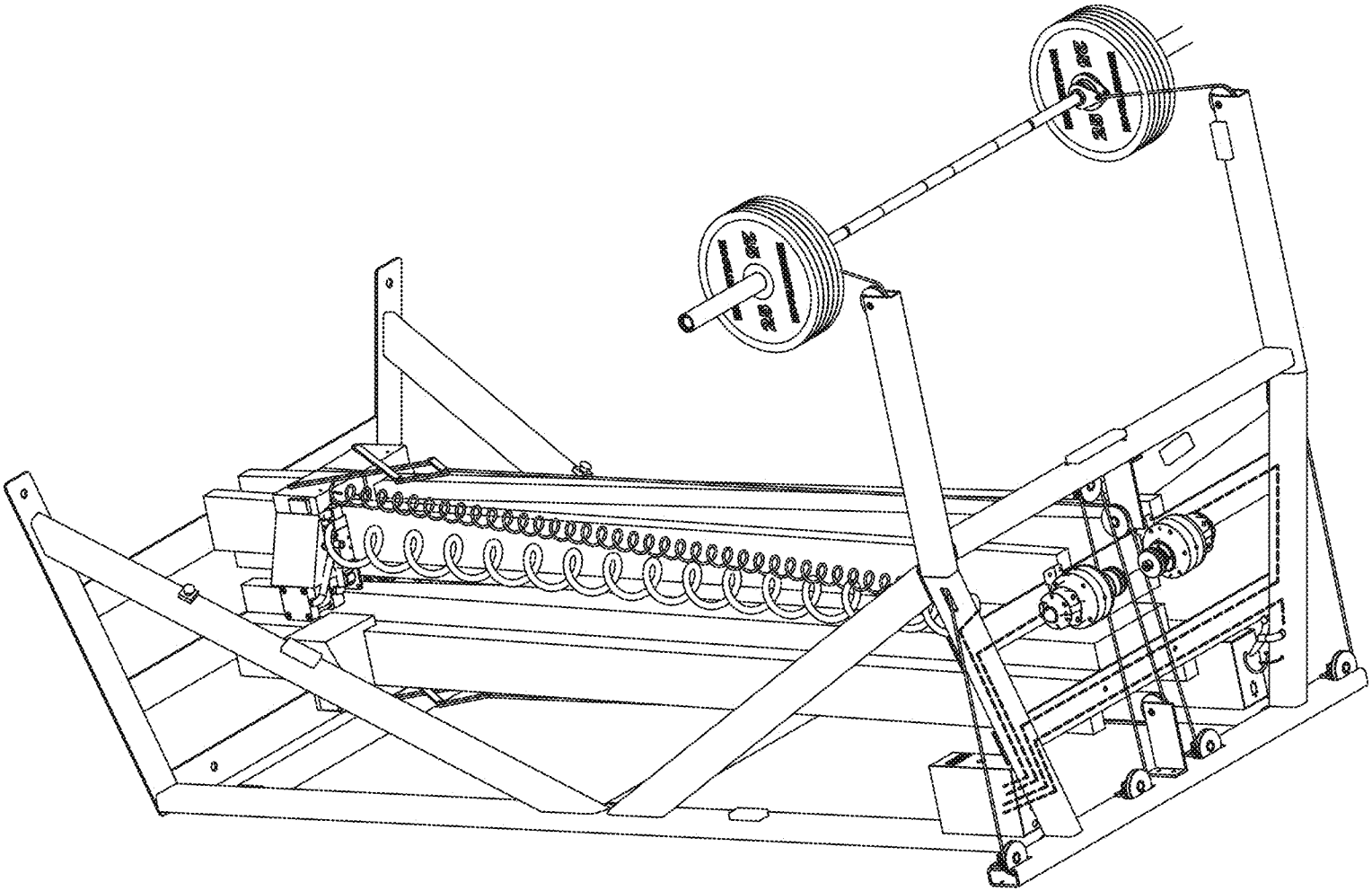
FIG. 12 is an elevated perspective view depicting exemplary pneumatic pathways in accordance with an embodiment of the present disclosure.

In some embodiments, control box 80*a* houses pneumatic equipment, and may serve as a junction box for receiving supplied air and distributing it to pneumatic components. With reference to FIG. 11, control box 80*a* may include a filter, regulator and valve manifold, from which plural pneumatic lines 43 extend to various pneumatic components, such as solenoid blocks 41*a* and 41*b*, as well as to cable winder motors 110*a* and 110*b*. With further reference to FIG. 12, dashed lines indicate exemplary, non-limiting pneumatic pathways. It will be apparent to those skilled in the art similar pathways and equipment may be employed for hydraulic motors. For electric motors, no supplied air or hydraulic fluid is required.

One or more sensors or detectors can be mounted to the frame 10 in position to detect conditions which trigger actuation of the brake actuators 40*a*, 40*b*. As will be apparent to those skilled in the art, some or all of the sensors and switches disclosed herein may be powered via any suitable power source, such as but not limited to a battery, AC or DC power source. In addition, it will be recognized the sensors and switches may be coupled to a processor/control box either by wired or wireless connection. It will be further recognized that different embodiments of the apparatus 2 may include a variety of sensor combinations, and need not include each type of sensor. For example, and not by way of limitation, plural sensors of the same type, more than one type of sensor, only one type of sensor, etc. may be employed. In some embodiments there may be no sensors.

One or more microphones, e.g., microphones 140*a*, 140*b* and/or 140*c*, may be positioned to receive a voice command or utterance. The processor associated with the microphones can be programmed with a "safe" word for example. When the microphone detects the safe word, the processor signals the solenoids 41*a*, 41*b* to actuate the brake actuators 40*a*, 40*b*. In the event that multiple apparatus are in use at the same venue, the processor is programmable so the fitness operator can set a unique "safe word" for each apparatus. Suitable commercially available microphones include for example a DA-350 Auto Array microphone from Andrea Electronics of Bohemia, N.Y. The microphone can be coupled to a signal processor such as but not limited to a DA-250Q Stereo Array Microphone Digital Signal Processor available from Andrea Electronics.

Figure 25:
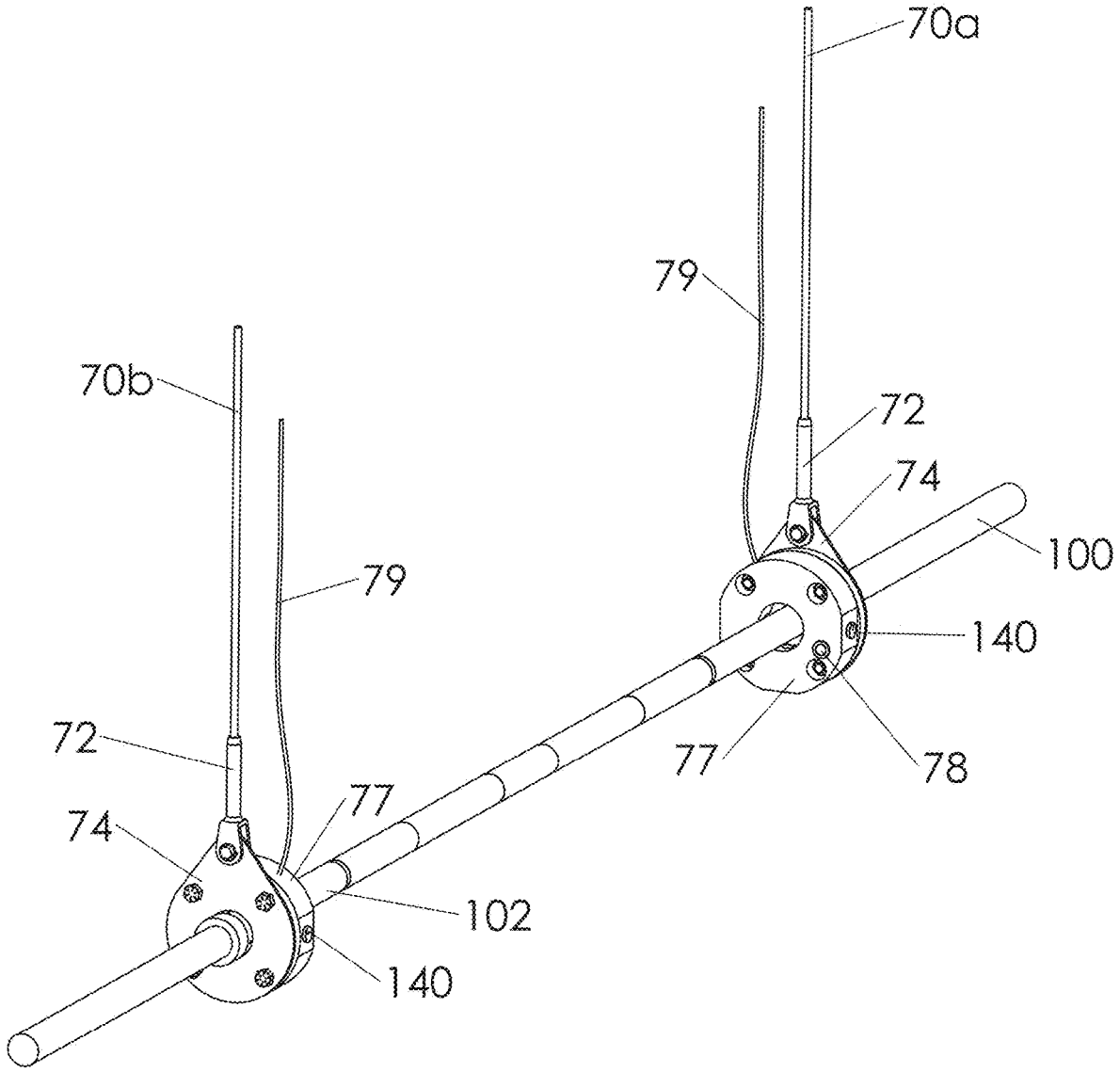
FIG. 25 is a perspective view of a microphone array in accordance with an embodiment of the present disclosure.
Figure 25A:
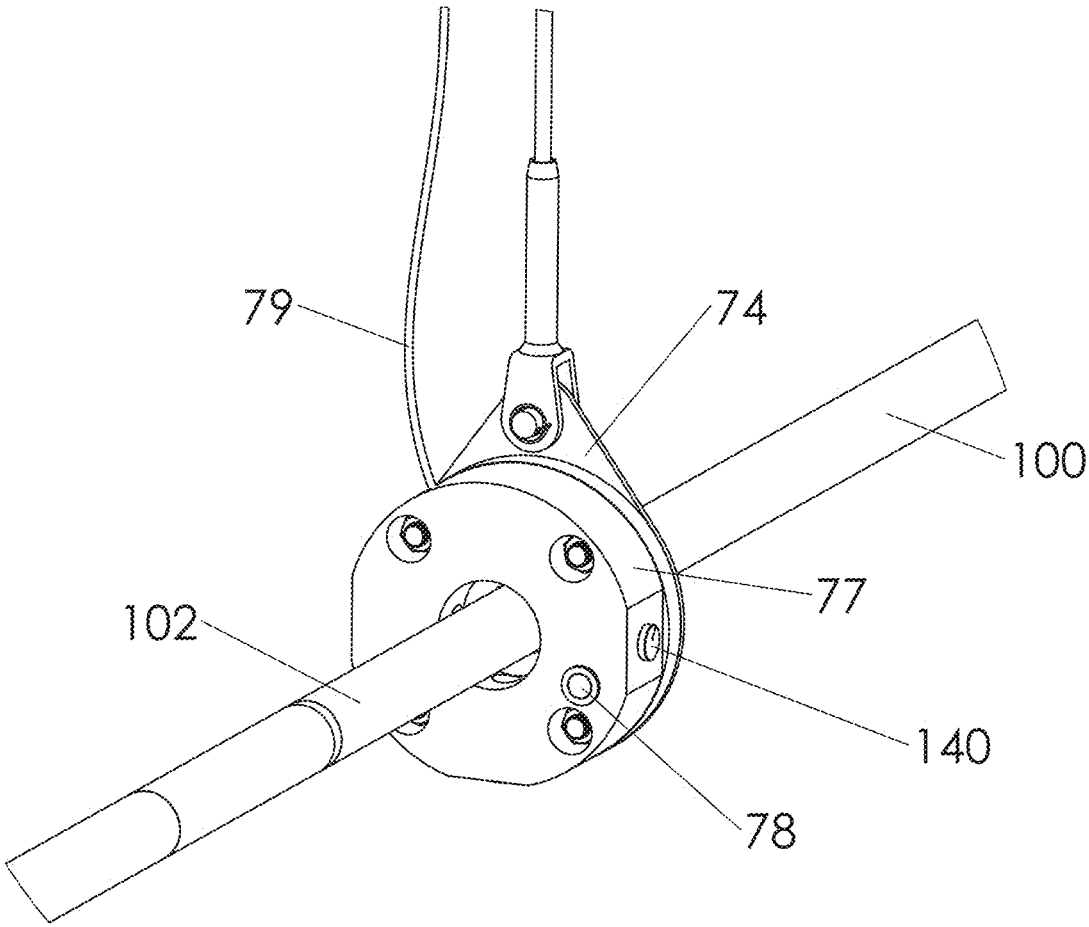
FIG. 25A is a perspective view of a detail of FIG. 25 in accordance with an embodiment of the present disclosure.
Figure 25B:
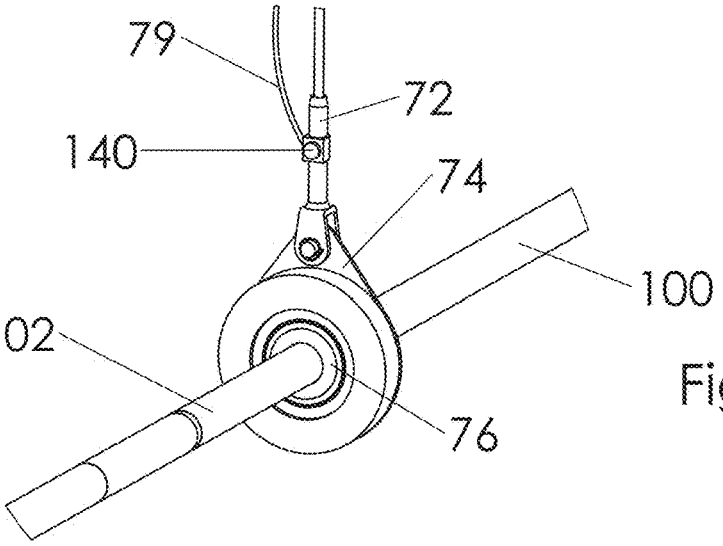
FIGS. 25B-25D are perspective views of variations of microphone positions in accordance with an embodiment of the present disclosure.
Figure 25C:
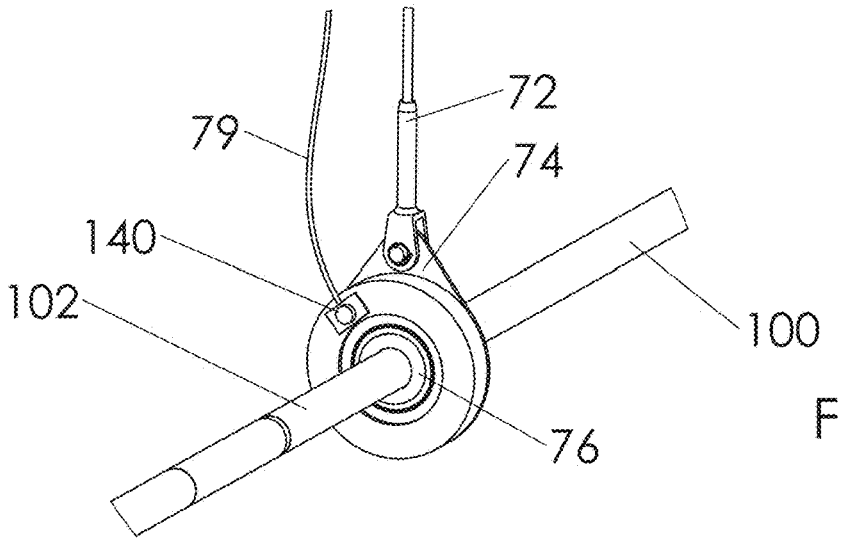
Figure 25D:
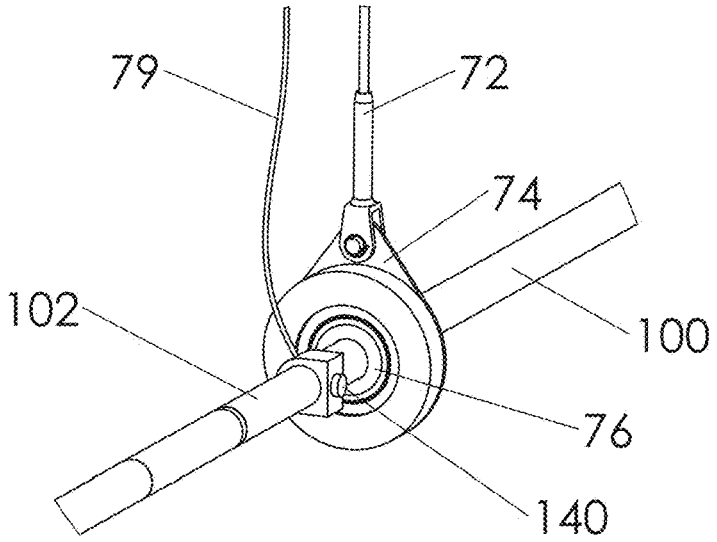

With further reference to FIGS. 25 and 25A, any suitable coupling 72 can be employed for coupling the cables 70*a*, 70*b* to the barbell bar 102, such as but not limited to an open swage socket, yoke or clevis coupled to a mounting plate 74. Suitable couplings are commercially available for example from Cleveland City Forge, Wellington, Ohio. In some embodiments the mounting plate 74 may be or include a ball bearing 76 as shown in FIGS. 25B-D to operably engage the barbell bar 102. A ball bearing 76 permits the barbell bar 102 to rotate freely while the outer ring of the ball bearing 76 remains static. One example of a suitable ball bearing is a stainless-steel, single-row, deep-groove ball bearing with a flanged outer ring commercially available from SKF USA Inc. of Lansdale, Pa. In accordance with some embodiments, one or more microphones 140 may be positioned on or near the barbell bar 102. For example, but not by way of limitation, a microphone hub 77 may include one or more microphones 140 and optionally one or more LED indicator(s) 78 coupled to control box 80*b* such as via cable 79. The microphone hub 77, which may be any suitable material and may include a protective rubber coating, may be coupled to the mounting plate 74 such as by bolts, adhesive, etc. The use of a ball bearing coupled to the plate 74 so that the barbell bar rotates freely while the outer bearing ring remains static ensures the microphones 140 coupled to the microphone hub 77 will always be positioned in a desirable location during a lifter's use of the barbell 102, e.g., near the head and mouth of the lifter, which is ideal for the voice control interface (VCI). The microphones 140 and signal processor may be as recited above. The LED indicator may be any suitable LED such as but not limited to Q-Series RGB LED indicators commercially available from APEM (www.APEM.com). The cable 79 may be any suitable cable operable to carry power and signals between the control box 80*b* and the microphone hub 77. In other embodiments, one or more microphone(s) 140 may be positioned on either or both of cables 70*a*, 70*b*, directly or indirectly to plate 74 (FIG. 25C), the couplings 72 (FIG. 25B), the barbell bar 102 (FIG. 25D), etc. The placement of a microphone or array thereof in close proximity to the head of the weightlifter provides greater accuracy of the VCI as an input for the spotting apparatus.

By way of further example, one or more eye or eyelid motion readers such as but not limited to cameras 130*a*, 130*b*, 130*c* may be positioned in strategic positions on the apparatus to detect a blink, series of blinks, eye movement pattern or the like. For example, with reference to FIGS. 1-2, camera 130*a* is positioned to detect movement of the eyes and/or eyelids of a lifter during a bench press or an exercise using an inclined bench. Camera 130*b* is positioned to detect movement of the eyes and/or eyelids of a lifter during exercises and portions of exercises in which the lifter is facing the apparatus in a standing position with head level or raised. Camera 130*c* is positioned to detect movement of the eyes and/or eyelids of a lifter during exercises and portions of exercises in which the lifter is facing the apparatus in a standing position with directed downward. The processor associated with the cameras can be programmed to recognize a particular eye or eyelid movement such as but not limited to time duration of blink, series of blinks, or eye movement pattern for example. When one of the cameras detects the programmed movement, the processor signals the solenoids 41*a*, 41*b* to actuate the brake actuators 40*a*, 40*b*. Suitable commercially available cameras include for example a Biometric SD Eye Tracker Bundle available from Gazepoint of Vancouver, Wash. which may include or be coupled with a suitable signal processor.

Figure 10:
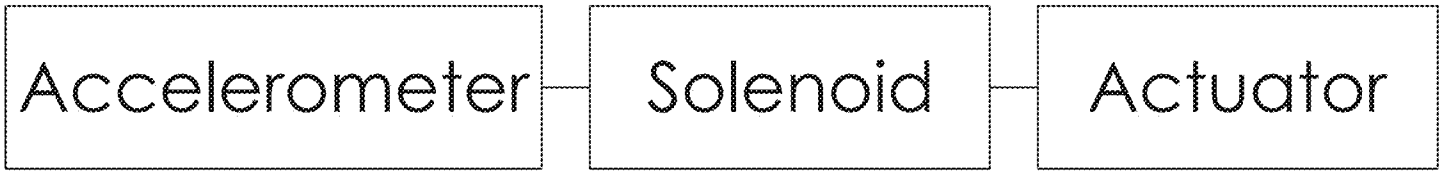
FIG. 10 is a schematic representation of an exemplary signal path in accordance with an embodiment of the present disclosure.

One or more accelerometers 150*a*, 150*b* may be positioned to detect free-fall of one or both ends of the barbell 100. With reference to FIG. 10, the accelerometer(s) 150*a*, 150*b* may be operably coupled with a solenoid coupled to the brake actuator. Suitable commercially available accelerometers include for example a TARS-IMU available from Honeywell International of Mount Laurel, N.J.

Figure 26A:
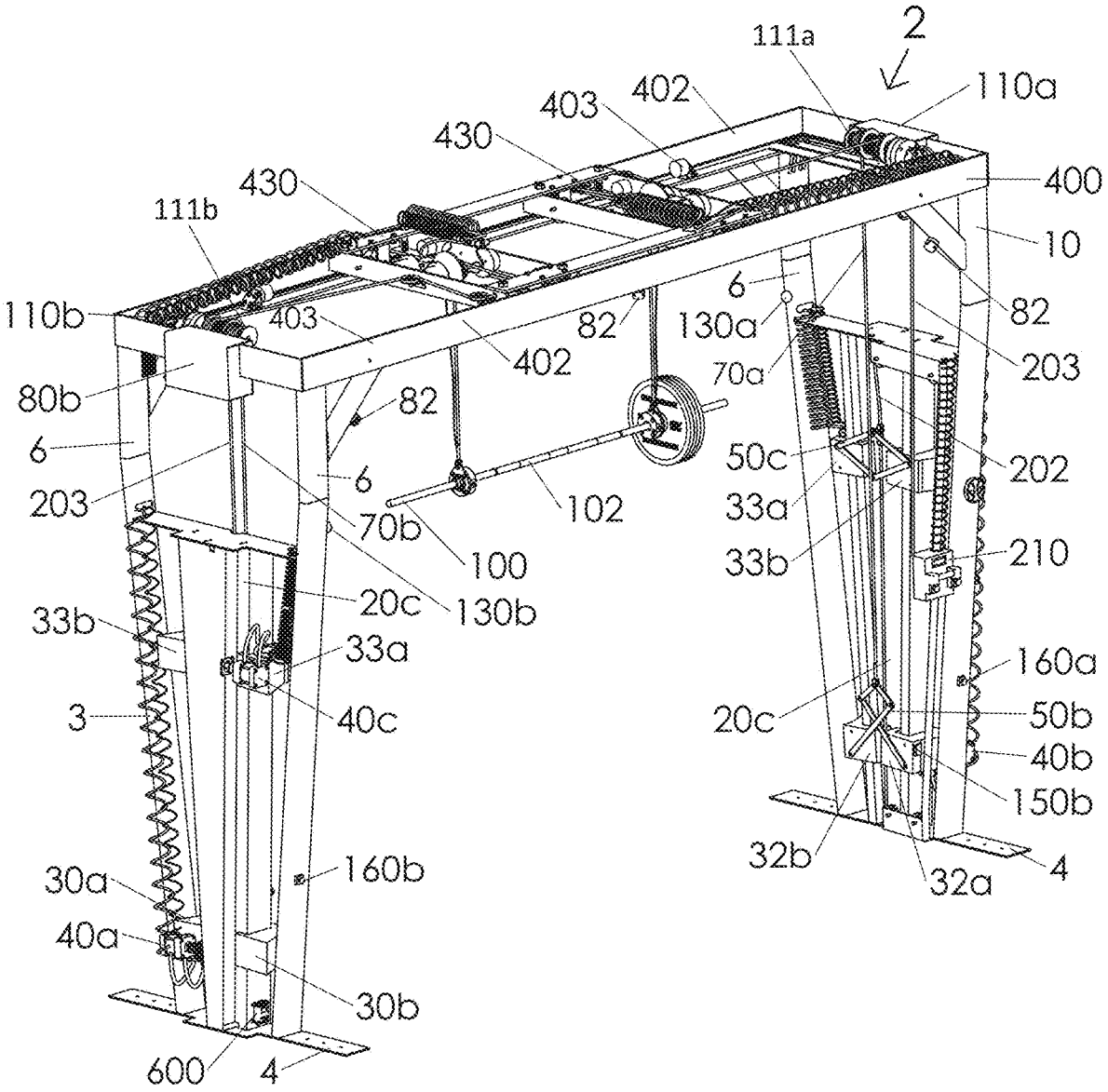
FIG. 26A is a perspective view of a barbell spotting apparatus in accordance with an embodiment of the present disclosure.
Figure 26B:
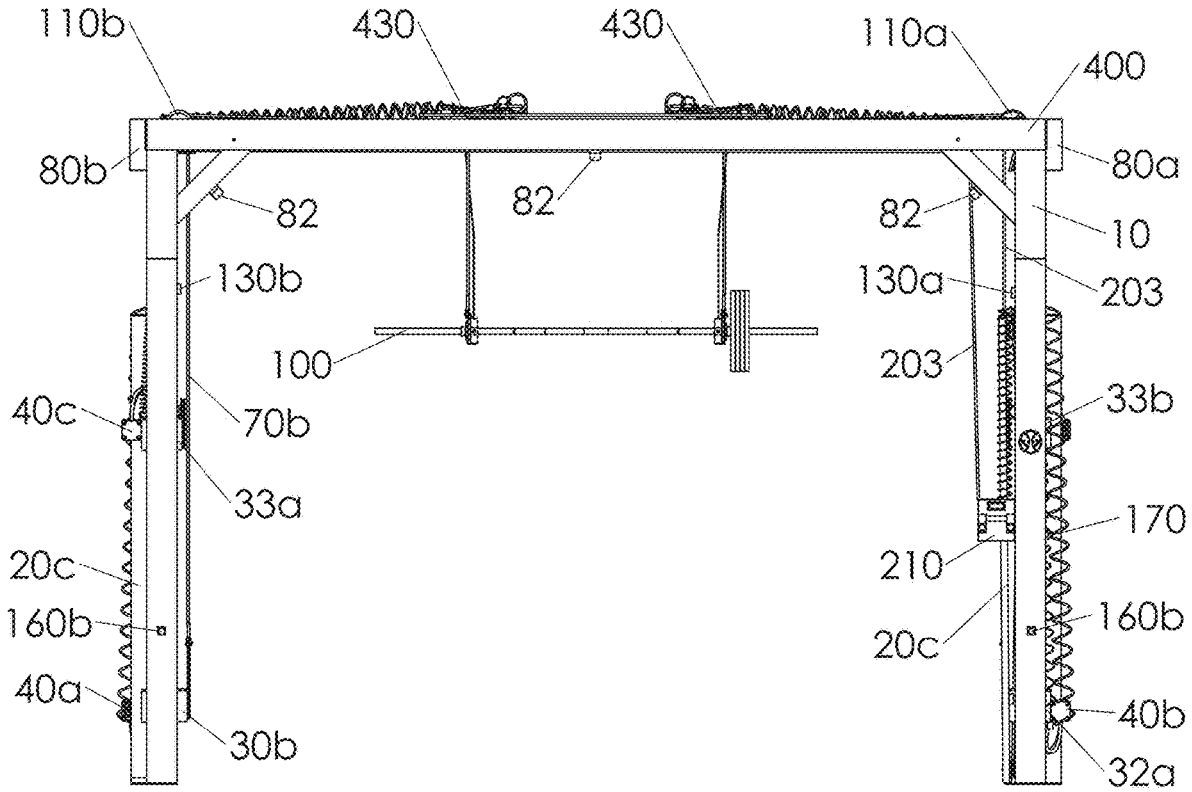
FIG. 26B is a front view of a barbell spotting apparatus of FIG. 26A in accordance with an embodiment of the present disclosure.
Figure 26C:
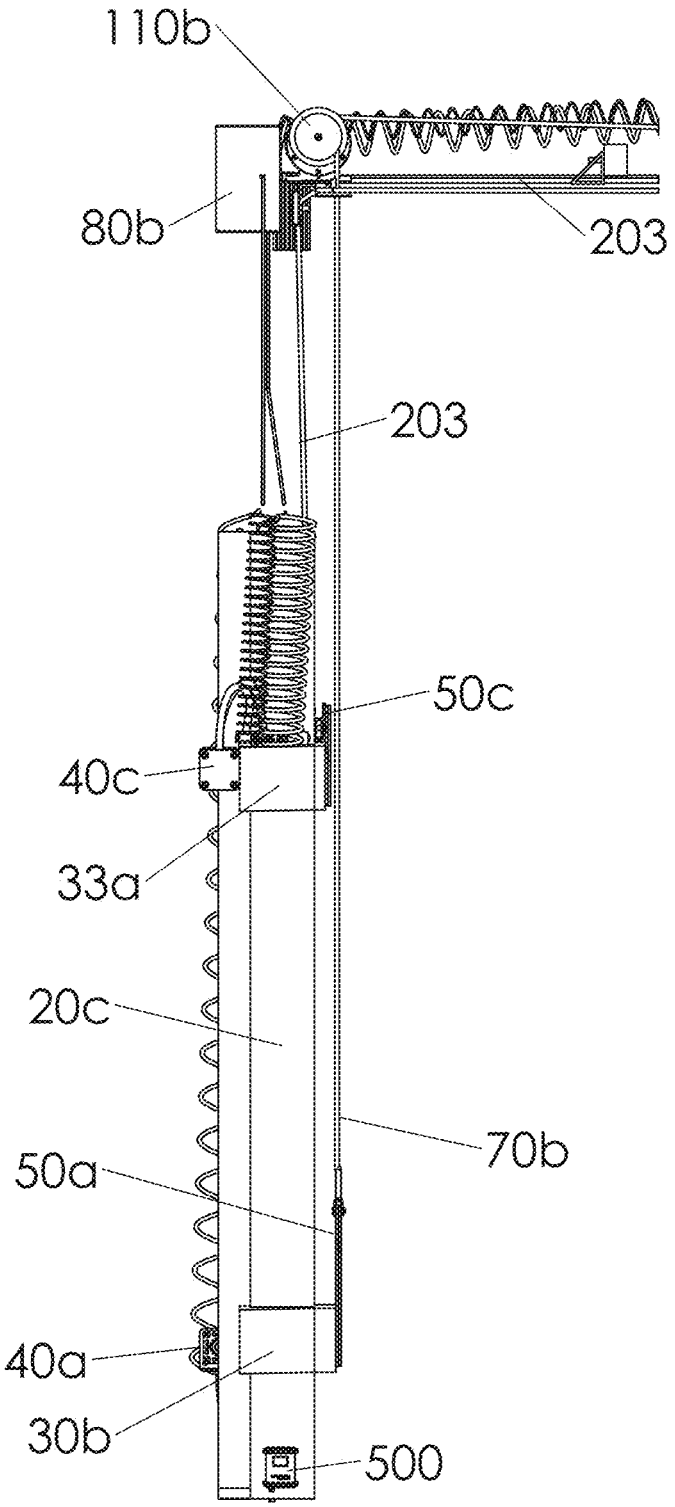
FIGS. 26C and 26D are front views of column 20*c* of the barbell spotting apparatus of FIG. 26A with a support removed in accordance with an embodiment of the present disclosure.
Figure 26D:
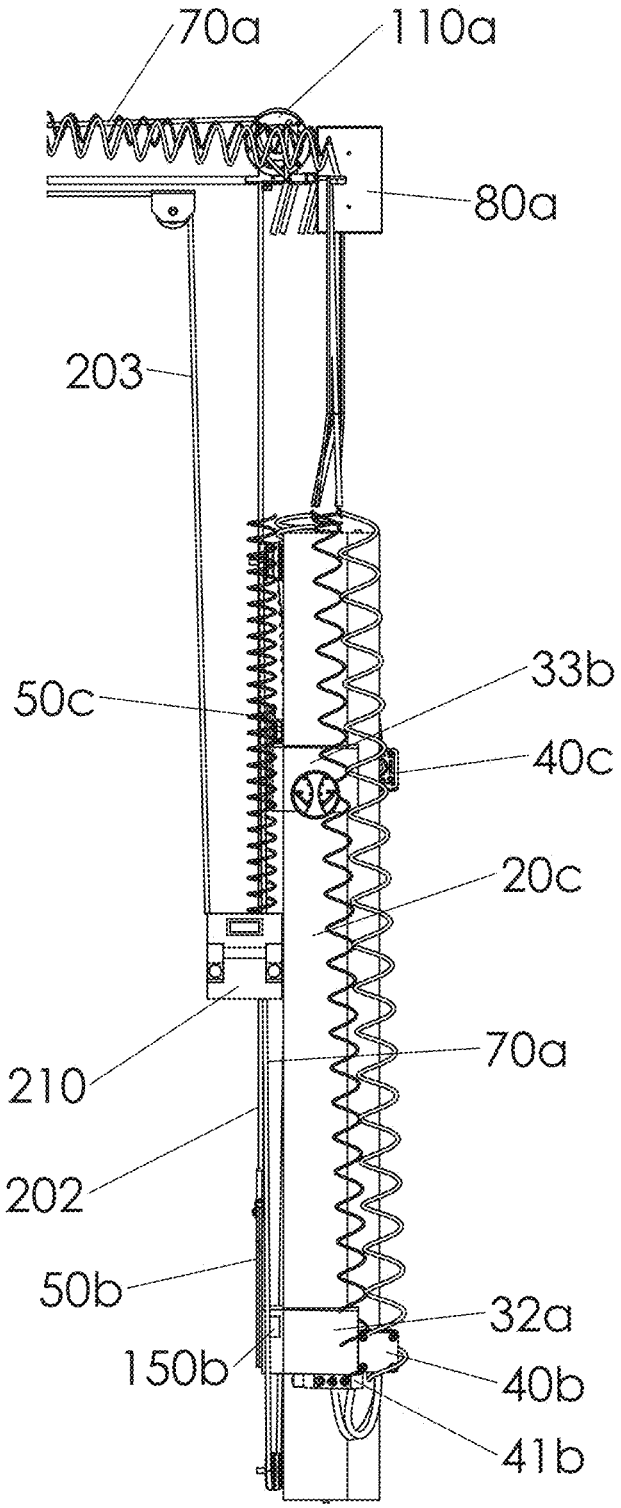
Figure 26E:
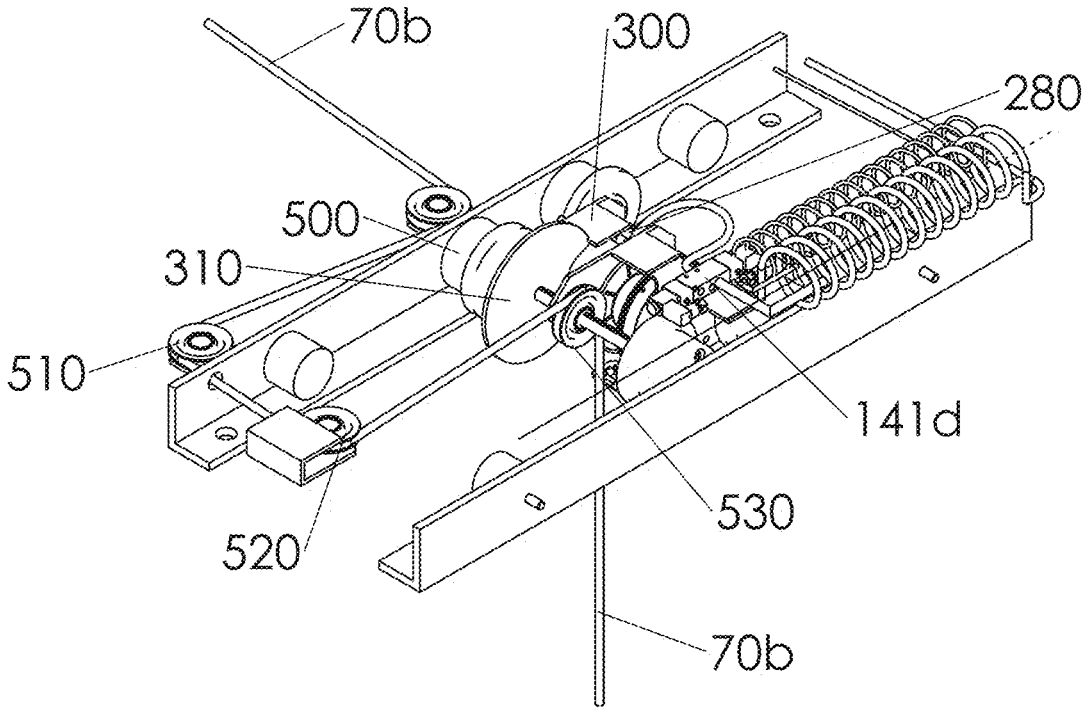
FIG. 26E is an elevated perspective view of a trolley and sled apparatus of FIG. 26A in accordance with an embodiment of the present disclosure.

One or more reflective optical sensors 600 may be positioned below any of the brake shoes 30*a*, 30*b*, 32*a*, 32*b*, as shown in FIG. 26A. This allows for a beam of light (e.g., laser) to be emitted from the sensor 600 to impinge on, and be reflected by, a reflector located on a bottom surface of the corresponding brake shoe 30*a*, 30*b*, 32*a*, 32*b*. Utilizing such reflectance, the sensor 600 may detect distance to the corresponding brake shoe 30*a*, 30*b*, 32*a*, 32*b*. With determination of differences in detected distance, movement, and acceleration, including rate of ascent in response to downward movement of the barbell 100, of the brake shoes 30*a*, 30*b*, 32*a*, 32*b* may be determined.

Cable counters 83*a*, 83*b* coupled to a cable counter processor are operably coupled to respective cables 70*a*, 70*b* to detect an unduly rapid descent or an uneven ascent or descent. For example, the cable counter processor may be programmed with a pre-set limit on the rate of change of one or both of the cable counters, a predetermined limit on the acceptable difference in readings between the cables 70*a*, 70*b*, a predetermined limit on a period of non-movement of the barbell, etc. When the cable counter processor detects a limit or condition has been met or exceeded, the processor signals the solenoids 41*a*, 41*b* to actuate the brake actuators 40*a*, 40*b*. Suitable commercially available cable counters include for example an LR 300 wire length counter available from Taymer America, Inc. of Claremont, N.C. The bale counter may be coupled to a signal processor such as but not limited to a PLC controller available from Taymer America, Inc.

Emergency stop buttons 160*a*, 160*b* may be coupled to an emergency stop processor to signal the solenoids 41*a*, 41*b* to actuate the brake actuators 40*a*, 40*b*. Alternatively the emergency stop buttons 160*a* may be configured to immediately cut power or compressed air supply to the apparatus. Suitable emergency stop buttons include but are not limited to a mushroom head push button, Model No. 10250T17213-53 commercially available from Eaton Corporation plc of Dublin, Ireland.

In some embodiments, the cylindrical surface of the bar 102 between the collars contains a grip sensor 104. Any suitable barbell grip sensor and/or sensor system may be employed, including but not limited to those disclosed in for example U.S. Pat. Nos. 6,537,182, 6,749,538, and U.S. Provisional Patent Application No. 62/895,759, and which are incorporated herein by reference in their respective entireties. A topcoat may be applied to the sensor material making the surface waterproof and offering very similar tactile properties to the native surface of an unmodified barbell. In embodiments which employ a grip sensor, the sensor is operably coupled to the solenoid as well as a visual control system.

In practice, when the apparatus 2 is at rest, the downward force of the barbell 100 is transmitted through the cables 70*a*, 70*b* and pulleys, exerting a force tightening the tensioning devices 50*a*, 50*b* which in turn presses the brake shoes 30*a*, 30*b*, 32*a*, 32*b* firmly against the column 20*a*, 20*b* and the brake shoes 30*a*, 30*b*, 32*a*, 32*b* are engaged.

In one or more embodiments, the apparatus includes indicator lights 82*a*, 82*b*, which may be integrated in control boxes 80*a*, 80*b*, respectively, operably linked to one or more of the sensors 104, 130*a*-*c*, or 140*a*-*c*. Indicator lights 82*a*, 82*b* may be LED lights or the like. Indicator lights 82*a*, 82*b* may be provided with optics to direct or throw light in particular area, such as the floor under the barbell 100. The weightlifter approaches the machine and addresses the barbell 100. As one of the sensors 104, 130*a*-*c*, or 140*a*-*c* detects a pre-programmed signal, the right and left side indicator lights 82*a*, 82*b* illuminate a preset color (for example, red). The red LED indicator confirms that the brake mechanism is engaged and downward movement of the barbell is restricted. For example, one of the microphones 140*a*, 140*b*, 140*c* may detect a command that matches a pre-programmed code (e.g., a pre-programmed code word) for a ready state, resulting in red illumination of indicator lights 82*a*, 82*b*. By way of further example, as the grip sensor 104 detects the presence of a hand on the right side of the barbell 100, indicator lights 82*a*, 82*b* illuminate red. At this point, the brake shoes 30*a*, 30*b*, 32*a*, 32*b* are engaged. The brake shoes 30*a*, 30*b*, 32*a*, 32*b* in the engaged state allow the loaded barbell 100 to move up if pushed by the weightlifter but the barbell 100 cannot move downward.

As the weightlifter pushes the load up a predetermined distance, such as but not limited to 3 inches, the indicator lights 82*a*, 82*b* change to a different color. For example they may turn yellow. This indicates that the barbell 100 is under the control of a user, permitted to move up but not down, and that the apparatus will disengage the brake system after the barbell 100 has moved upward the predetermined distance. The lifting of the barbell 100 causes the tensioning devices 50*a*, 50*b* to be relieved of the force imparted by the barbell 100. During this initial interaction with the barbell 100, i.e., during the predetermined upward movement of the barbell 100, the brake shoes 30*a*, 30*b*, 32*a*, 32*b* remain engaged thus permitting the barbell 100 to move higher but not lower.

After the predetermined distance of upward movement is exceeded, the indicator lights 82*a*, 82*b* change to a different color than the previous two colors. For example, they may turn green. At this point, the brake shoes 30*a*, 30*b*, 32*a*, 32*b* are disengaged and the barbell 100 is permitted to move freely—both up and down. Because the resting, unactuated state of the brake actuators 40*a*, 40*b* is engaged and unpowered, in the event of an electrical or pneumatic malfunction, the brake shoes 30*a*, 30*b*, 32*a*, 32*b* will engage. As an added redundancy, the apparatus may include a mechanical safety stop which prevents the downward movement of the barbell 100 below a user determined set-point.

As the weightlifter performs the exercises and maintains control of the bar, the indicator lights 82*a*, 82*b* remain illuminated green and the brakes are disengaged. The brakes remain disengaged and the barbell is permitted to move freely until one or more "qualifying conditions" is met, which, as used herein, includes, but is not limited to one or more of 1) a voice command is issued, 2) the rate of descent exceeds a predetermined speed as measured by either a cable counter or accelerometer or reflective optical sensor, 3) the cable counters detect an uneven ascent or descent of the barbell beyond a predetermined set point, 4) a period of no movement of the barbell, which may be detected by the cable counters for example, 5) the user signals the apparatus using a movement of eyes or eyelids, 6) the pressing of a frame-mounted emergency stop button, or 7) if so equipped with a grip sensor, when the weightlifter removes a substantial portion of his or her hand from the barbell 100. When any of the qualifying conditions are met, the brake shoes 30*a*, 30*b*, 32*a*, 32*b* engage. "Removal of a substantial portion of the hand" is a predefined condition that may be for example but not by way of limitation an event in which the grip sensor detects a 5% reduction of a hand on the gripped surface. At the point when the qualifying condition is met, the brake actuators 40*a*, 40*b* retract the shafts 42*a*, and the brake shoes 30*a*, 30*b*, 32*a*, 32*b* are pressed into the columns 20*a*, 20*b*. The indicator lights 82*a*, 82*b* illuminate red.

With the end of an exercise, the user may remove his or her hands from the bar 102 completely. With removal of the hands as a qualifying condition, the brake shoes 30*a*, 30*b*, 32*a*, 32*b* are caused to engage with the barbell 100 being suspended in that position. Thus, there is no need to re-rack the barbell 100. Advantageously, when the productive portion of the exercise ends, so can the movement. This reduces the possibility of injuries and adds to comfort and convenience. For example, hyperextension of the shoulder, a common weightlifting-related injury, may be avoided, since a lifter does not need to lift the barbell 100 by reaching or arching outside of a normal exercise movement. The indicator lights 82*a*, 82*b* remain red and indicate that the braking mechanism is engaged and the barbell 100 is safely suspended. The cycle is complete and the apparatus is ready for the next user.

The following exemplary code is useable to evaluate the qualifying conditions. This code presupposes inclusion of a grip sensor 104. However, a grip sensor is not necessary. If a grip sensor is not used, revise <<GripCurrent>5>> to <<GripCurrent>−1>>.

```
DIM GripBase as Integer
DIM GripCurrent as Integer, GripCurrent1 as Integer
DIM CableCurrent Integer, CablePosition1 as Integer,
CablePosition2 as Integer, CablePosition3 as Integer
DIM Flag1 as binary
DIM Time1 as Integer, Time2 as Integer
DIM NoMove as Integer
Dim FreeFall as Integer
START Loop A
  GripCurrent = {third party grip output, RS485, slot1}
  CableCurrent = {third party cable position sensor, RS485, slot2}
  CablePosition2 = CableCurrent
    If GripCurrent <> GripCurrent1 and GripCurrent > 5 and
Flag1 is False Then
      Flag1 = True
      GOTO sub <Yellow>
      CablePosition1 = CableCurrent
    End if
  If Flag1 = True and CableCurrent > CablePosition1 + 76.2 then
    GOTO sub <Green>
  End if
GripCurrent1 = GripCurrent
  If GripBase > GripCurrent + 1 then
    GOTO sub <Red>
  End if
Time1 = <CurrentTime> + 3 seconds
If Time1 = <CurrentTime> and CablePosition3 = CableCurrent
then then NoMove = 1
If Time1 = <CurrentTime> then CablePosition3 = CableCurrent
Time1 = <CurrentTime> + .25 seconds
If Time1 <CurrentTime> and CableCurrent > CablePosition3
+306 then FreeFall = 1
If <EmergencyStop> button is UNSECURE than GOTO sub <Red>
If <LeftCableCounter> > <RightCableCounter> + 100 then
GOTO sub <Red>
If <RightCableCounter> > <LeftCableCounter> + 100 then
GOTO sub <Red>
If <VoiceInterface> is UNSECURE than GOTO sub <Red>
If FreeFall = 1 then
  FreeFall = 0
  GOTO sub <Red>
End If
If <eyelid interface. Is UNSECURE than GOTO sub <Red>
If <mechanical stop sensor> is UNSECURE than GOTO sub <Red>
If NoMove = 1 then
  NoMove = 0
  GOTO sub <Red>
End if
If (and when) <GreenButton> is UNSECURE and PULL and
NoMove = 1 then Relay 11 = ON
    'motors on and up
If (and when) <GreenButton> is UNSECURE and PUSH and
NoMove = 1 then
  Relay 10 = OFF
  Relay 12 = ON
End if
```

-continued

```
    'motors on and down
  If (and when) <MechanicalStopButton> is UNSECURE then
  Relay 13 = ON 'release mechanical stop brake and permit stop
  to be set
  Relay 14 = ON ' turn mechanical LED to white
  End if
  LOOP A
  Sub Yellow
    Relay1 = ON 'all LED lights turn yellow in color
  Sub Green
    Relay1 = OFF
    Relay2 = ON 'all LED lights turn green in color
    Relay10 = ON 'all pneumatics are activated; the barbell moves
freely up and down
  GripBase = GripCurrent
  Sub Red
    Flag1 = False
    Relay1 = OFF
    Relay2 = OFF
    Relay3 = ON 'all LED lights turn red in color
    Relay10 = OFF 'all pneumatics are deactivated and the barbell
cannot move lower
    Flag1 = False
    CablePosition1 = 0
    GripBase = 0
    GripCurrent1
```

It will be apparent to those skilled in the art that other algorithms and code could be employed to evaluate one or more of the qualifying conditions.

Figure 13A:
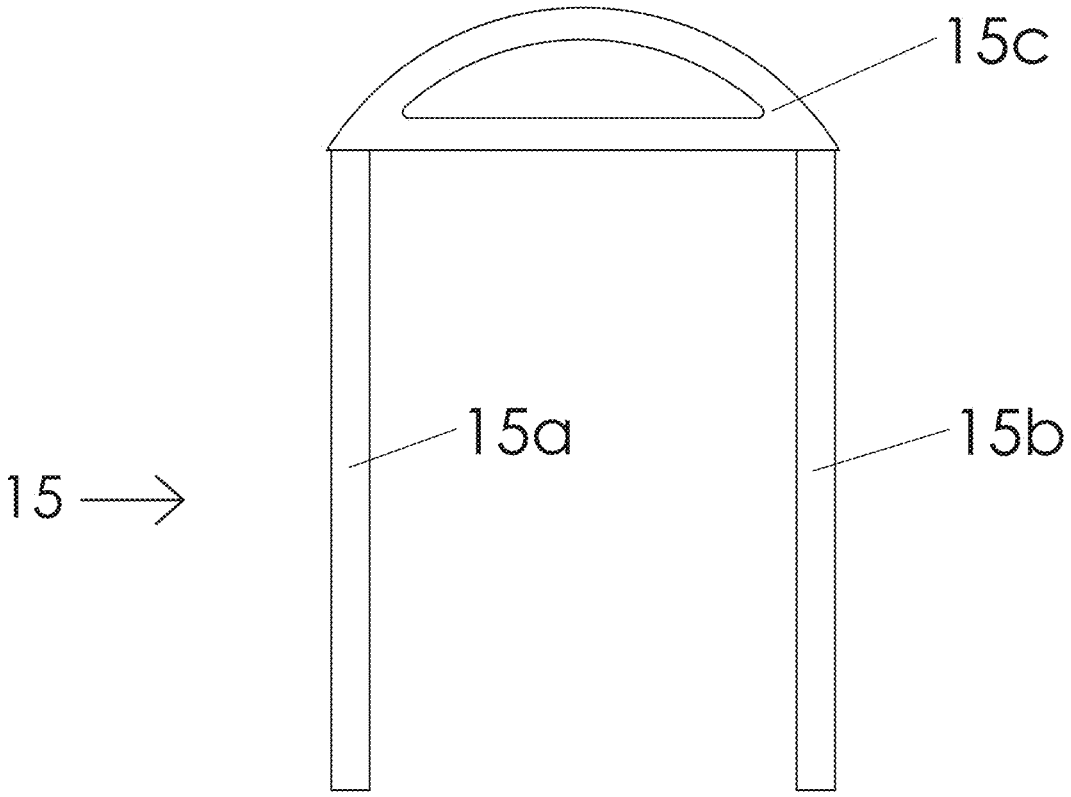
FIGS. 13A-13D are depictions of an exemplary mechanical stop in accordance with an embodiment of the present disclosure.
Figure 13B:
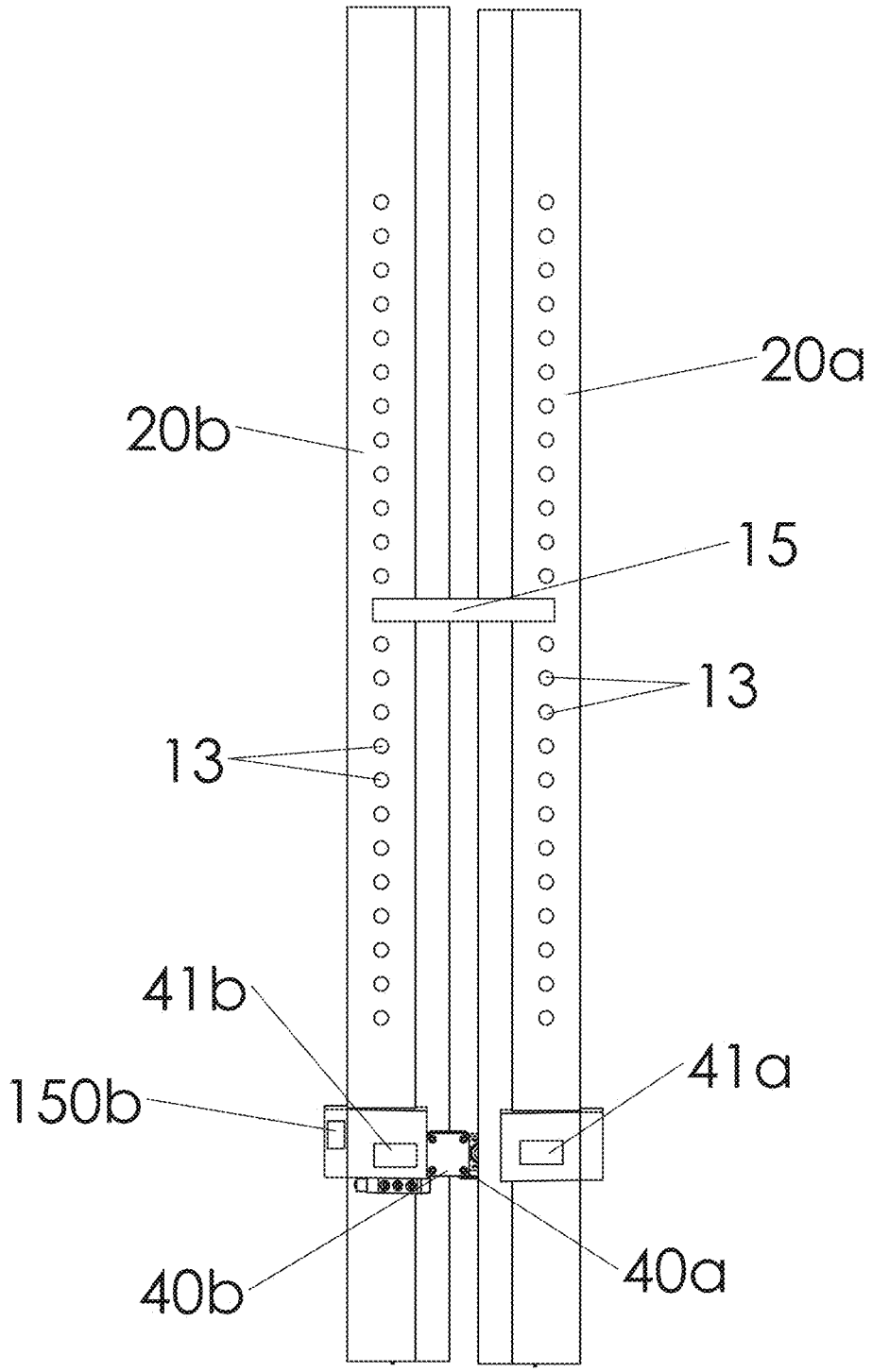
Figure 13C:
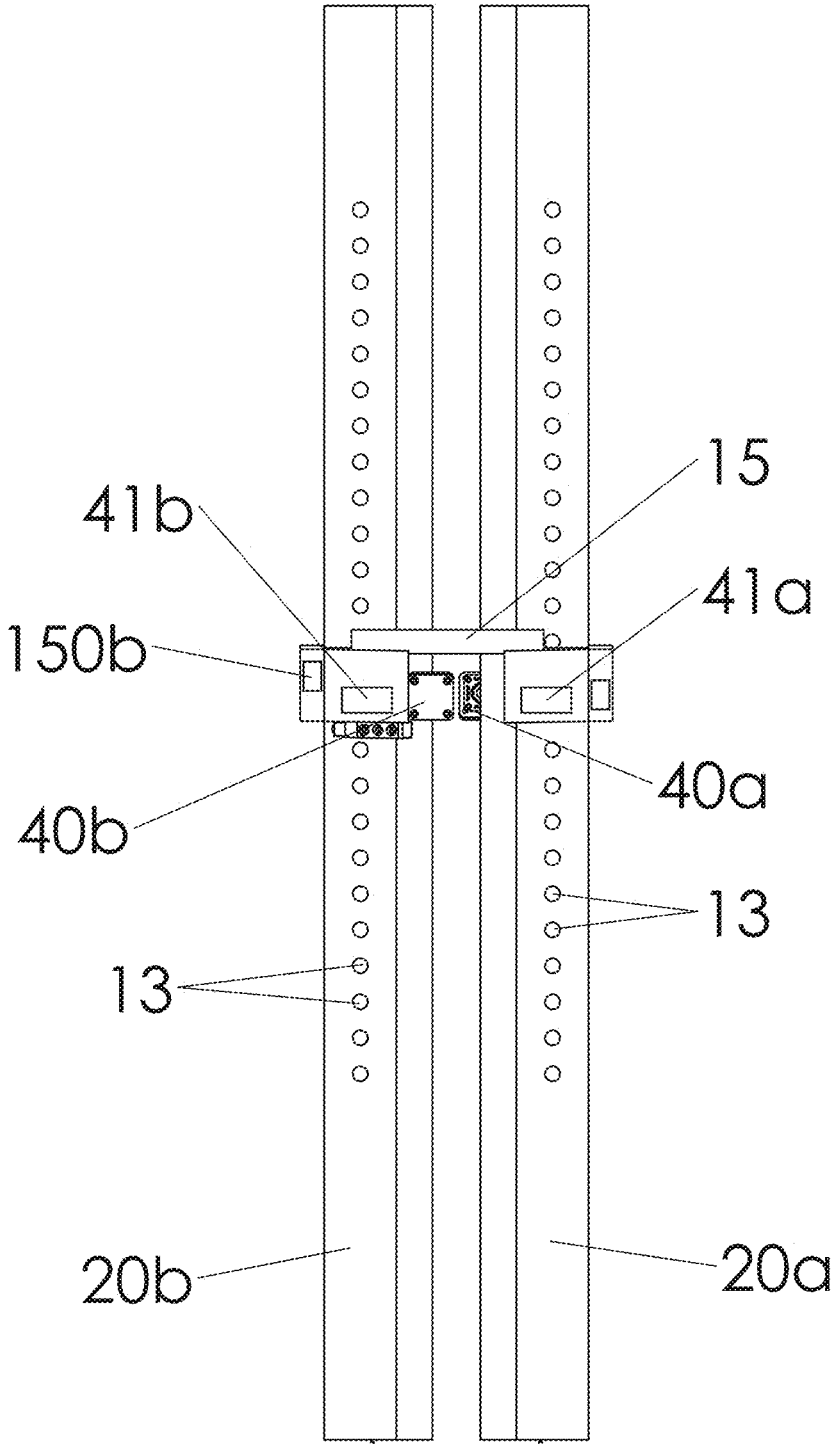
Figure 13D:
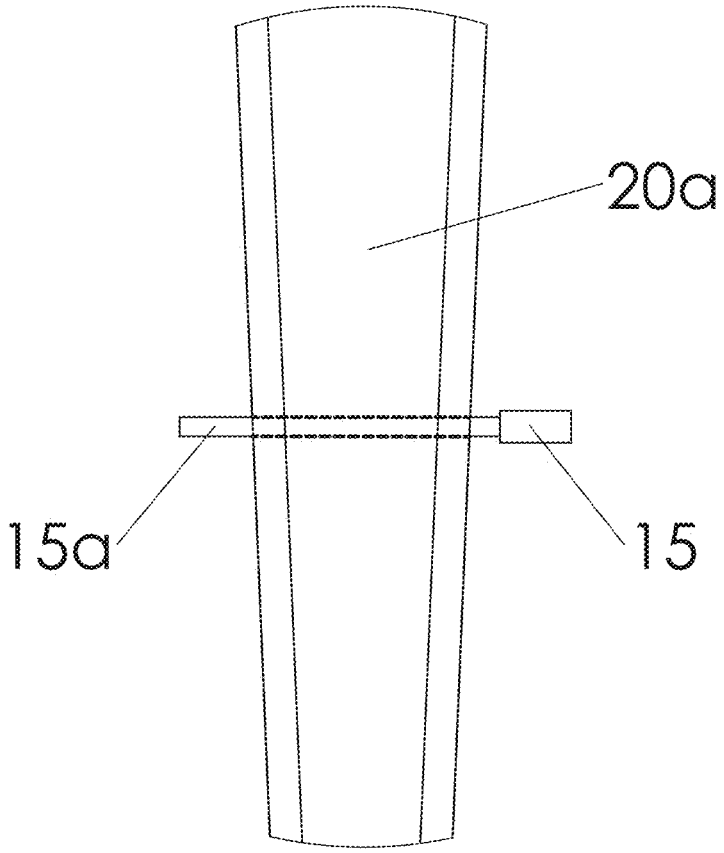
Figure 14:
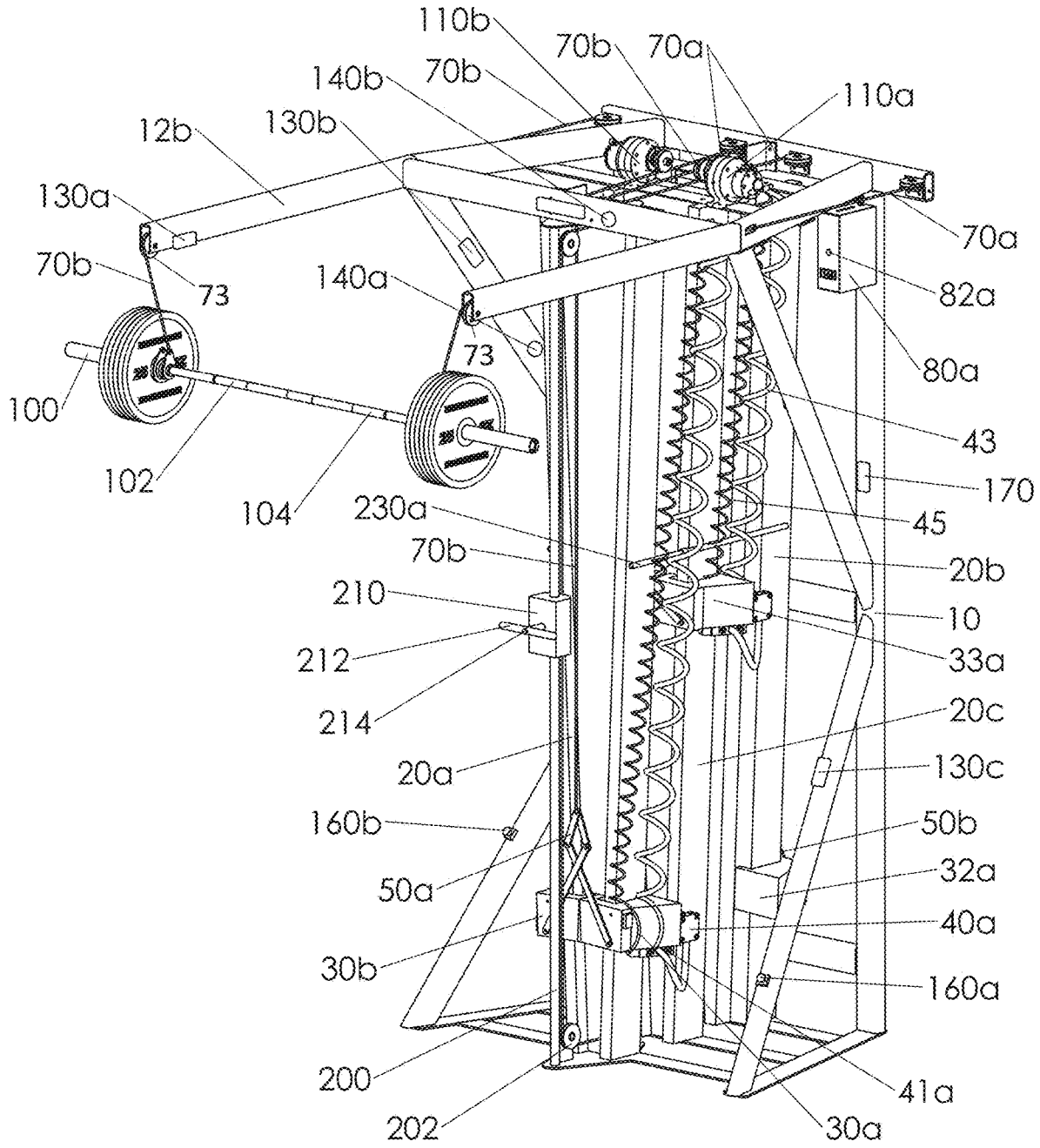
FIG. 14 is an elevated perspective view of a three-column apparatus including a mechanical stop apparatus in accordance with an embodiment of the present disclosure.
Figure 15:
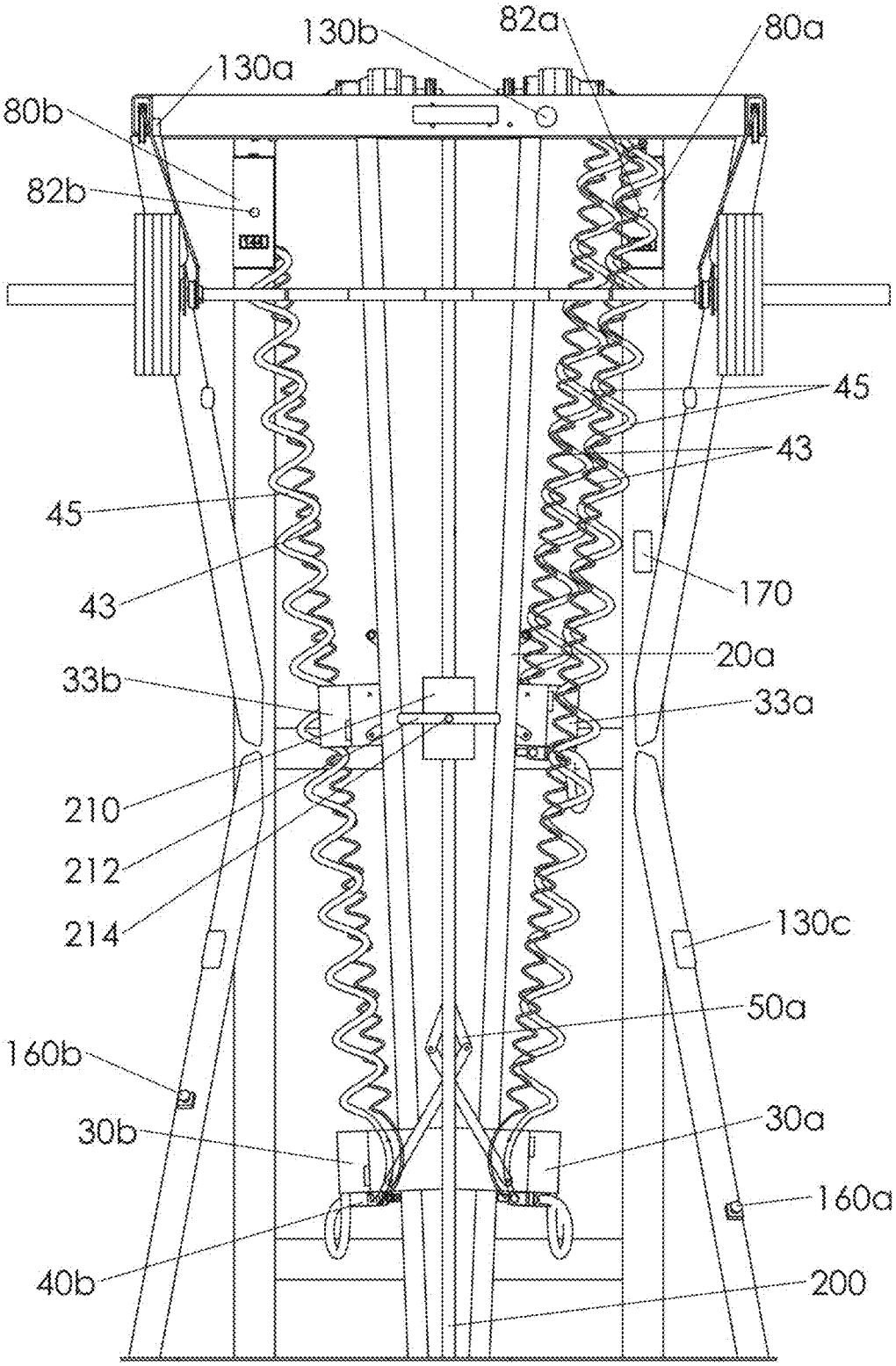
FIG. 15 is a front view of a three-column apparatus including a mechanical stop apparatus in accordance with an embodiment of the present disclosure.
Figure 16:
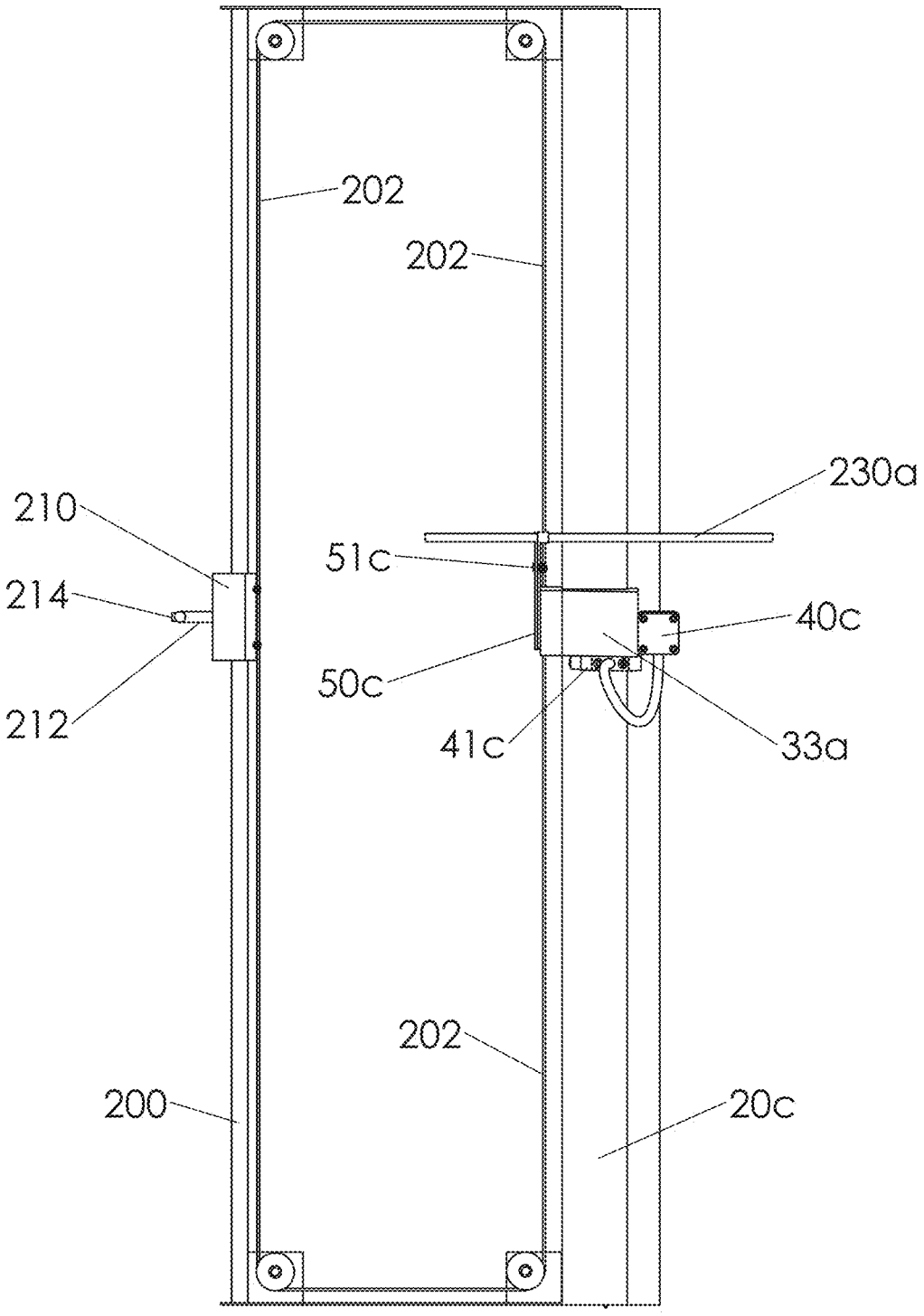
FIG. 16 is a side view of a mechanical stop apparatus of FIG. 15 in accordance with an embodiment of the present disclosure.
Figure 17:
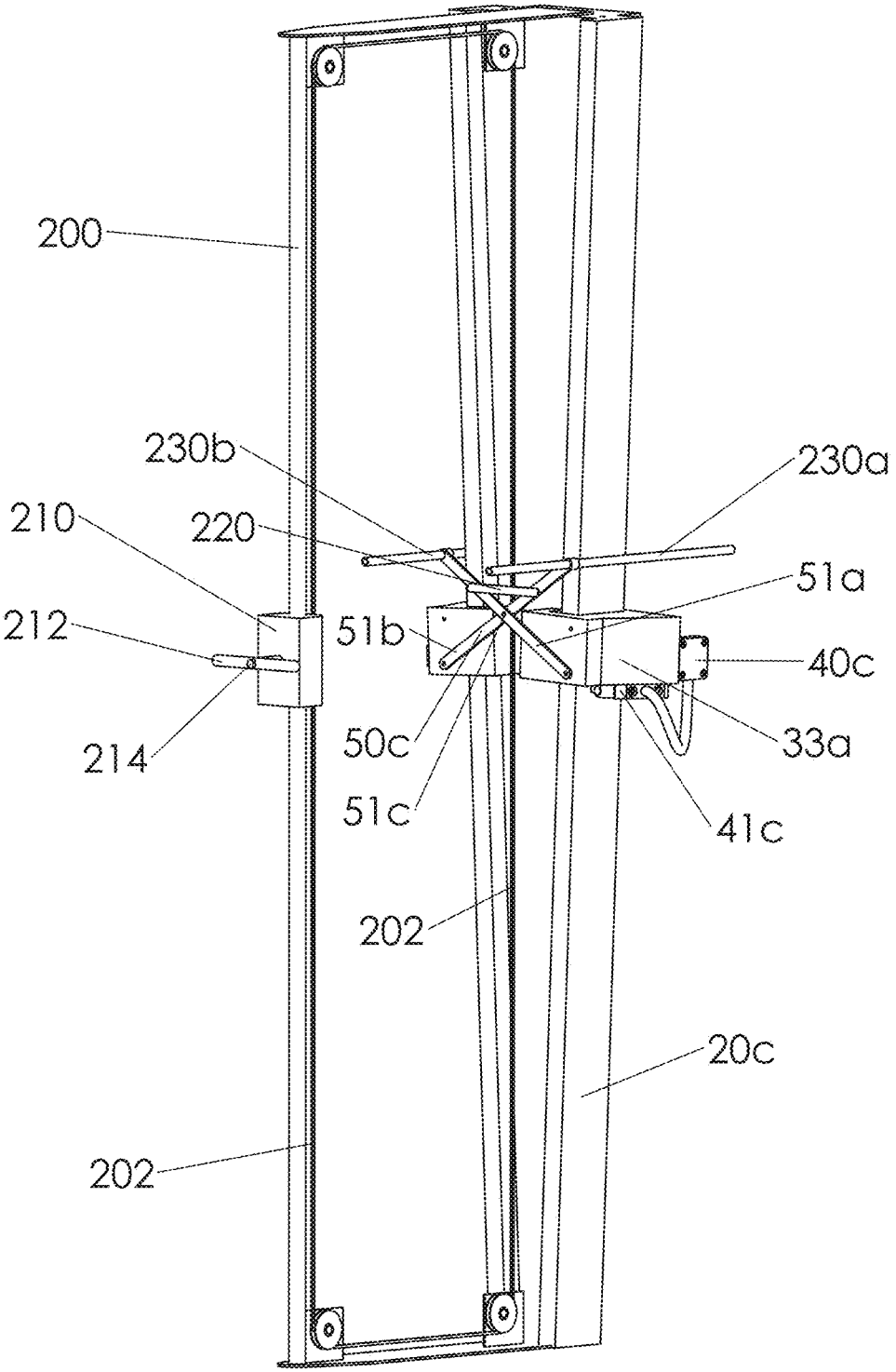
FIG. 17 is an elevated perspective view of the mechanical stop apparatus shown in FIG. 16 in accordance with an embodiment of the present disclosure.

Now referring to FIGS. 13A-13D, a mechanical stop tool 15 having pins 15*a* and 15*b* and handle 15*c* is disclosed useable with the barbell spotting apparatus 2. With further reference to FIGS. 13B-13D, the columns 20*a* and 20*b* include a plurality of holes 13 formed therein sized and configured to accommodate pins 15*a* and 15*b*, respectively. A user can insert the mechanical stop tool 15 into holes 13 at the level the user desires to establish a hard mechanical stop, which prevents the brakes shoes 30*a*, 30*b*, 32*a*, 32*b* from travelling beyond a certain height. It will be apparent to those skilled in the art the columns 20*a*, 20*b* may include holes 13 and separate pins may be employed to effect a mechanical stop.

With reference to FIGS. 14-17, in one or more embodiments, the barbell spotting apparatus 2 includes a mechanical stop assembly which includes a column 20*c* operably engaged to a pair of brake shoes 33*a*, 33*b* equipped similar to brake shoes described herein with an actuator 40*c* coupled to a solenoid block 41*c*. The brake shoes 33*a*, 33*b* are coupled to a tensioning device 50*c*. Tensioning device 50*c* as shown is a hinged cross member including two arms 51*a*, 51*b* coupled at hinge 51*c* wherein respective first arm ends are coupled to the brake shoes 33*a*, 33*b* and respective second, opposite arm ends are coupled to stop pins 230*a* and 230*b*. The tensioning device 50*c* further includes a resilient member 220 coupling the arms 51, 51*b*. Resilient member 220 may be a spring or an elastic band or strap. A vertical support 200 is provided to which a mechanical stop adjustment device 210 is slidably coupled. Mechanical stop adjustment device 210 is coupled to a cable 202 which is routed around a series of pulleys. Cable 202 is coupled to arm 51*b* in the region of the hinge 51*c* to the tensioning device 50*c* so that movement of the mechanical stop adjustment device 210 is operable to adjust the height of the brake shoes 33*a*, 33*b*. The mechanical stop adjustment device 210 may include handle 212 and button 214. Button 214 is operable to activate actuator 40*c* to release the brake shoes 33*a*, 33*b* so they can move freely along the column 20*c* so the stop pins 230*a*, 230*b* can be placed in a desired position. Once the button is released, the brake shoes 33*a*, 33*b* engage the column 20*c*. The button 214 may be hard-wired to the solenoid 41*c* or operate by wireless connection. In this embodiment the tapered column 20*c* and brake shoe arrangement provides an exceedingly robust safety measure. The stop pins 230*a*, 230*b* extend forward and rearward from column 20*c* so that they will stop movement of brake shoes 30*a*, 30*b* and 32*a*, 32*b* coupled to columns 20*a* and 20*b*, respectively. Upward force applied to the stop pins 230*a*, 230*b* by contact of the brake shoes 30*a*, 30*b* and 32*a*, 32*b* drives the brake shoes 33*a*, 33*b*, already in a locked position by virtue of the actuator 40*c* not being actuated, into even tighter contact with column 20*c*. In the extremely unlikely event that a solenoid becomes stuck in the open, unbraked position, the mechanical stop will arrest downward movement of the barbell 100 beyond the set point selected by the user. Moreover, the apparatus allows the user to use the mechanical stop adjustment device to set the stop pins 230*a*, 230*b* at any point along the path of travel. The user is not forced to select predefined, discrete points which may prove suboptimal.

Figure 18A:
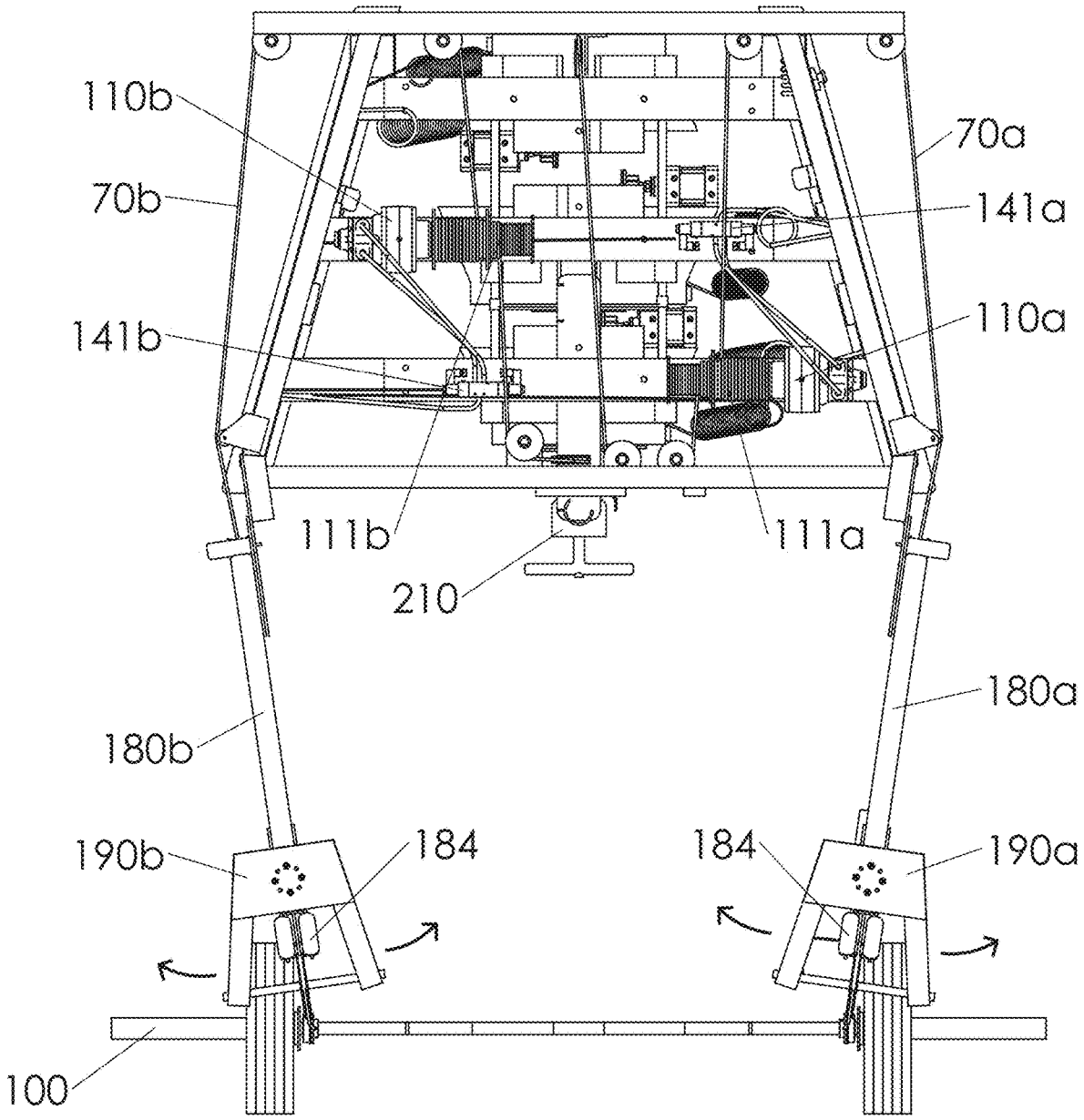
FIG. 18A is a top plan view of a barbell spotting apparatus in accordance with an embodiment of the present disclosure.
Figure 18B:
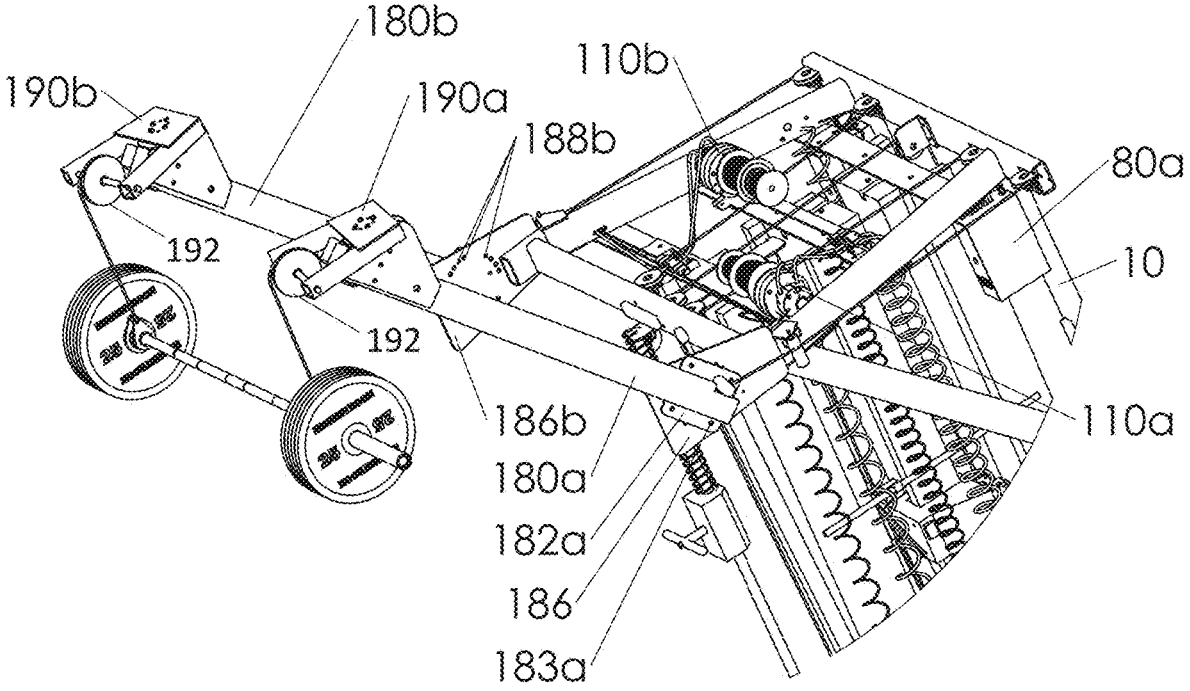
FIG. 18B is a top perspective view of a barbell spotting apparatus of FIG. 18A in accordance with an embodiment of the present disclosure.
Figure 18C:
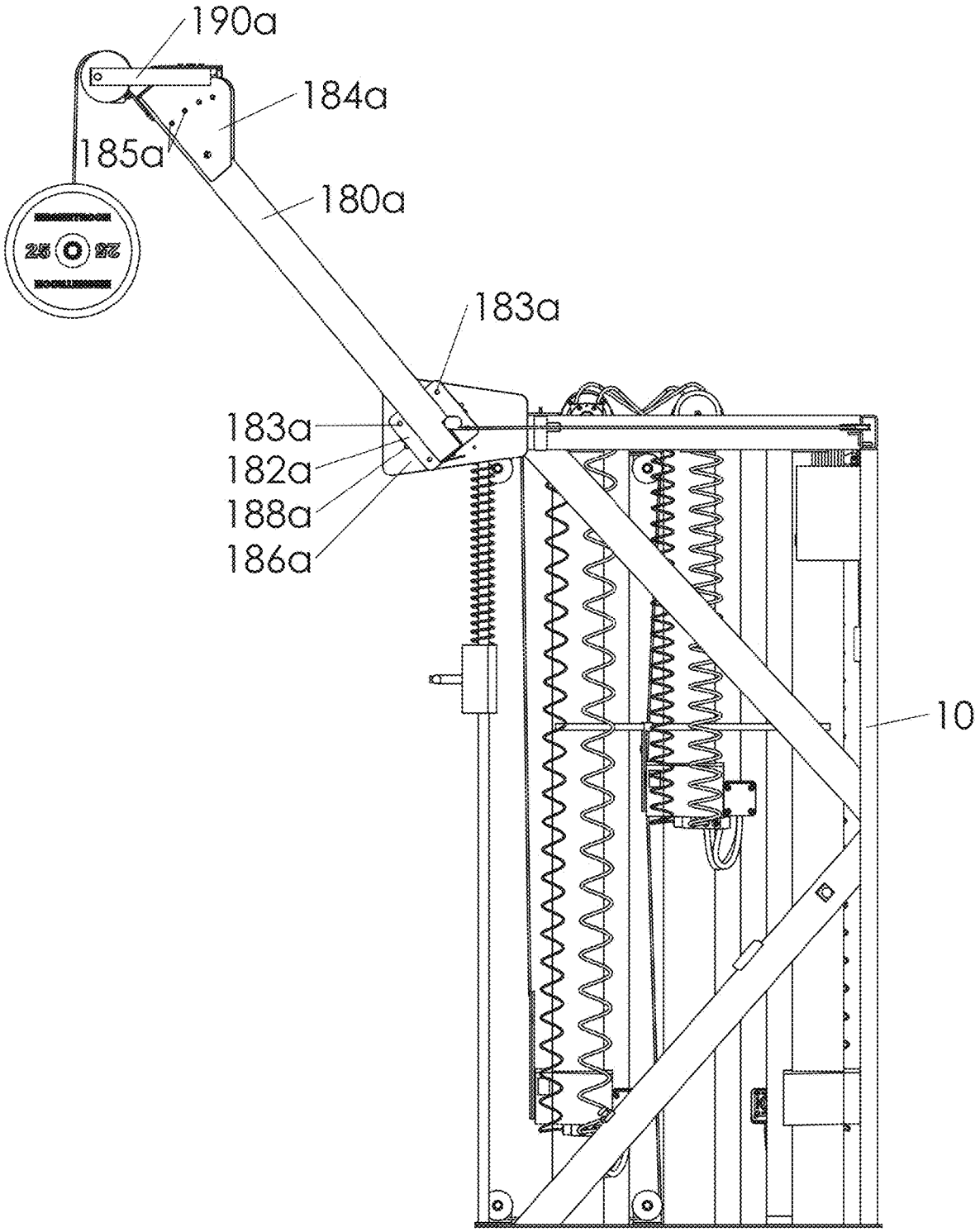
FIG. 18C is a side view of a barbell spotting apparatus of FIG. 18A in accordance with an embodiment of the present disclosure.
Figure 18D:
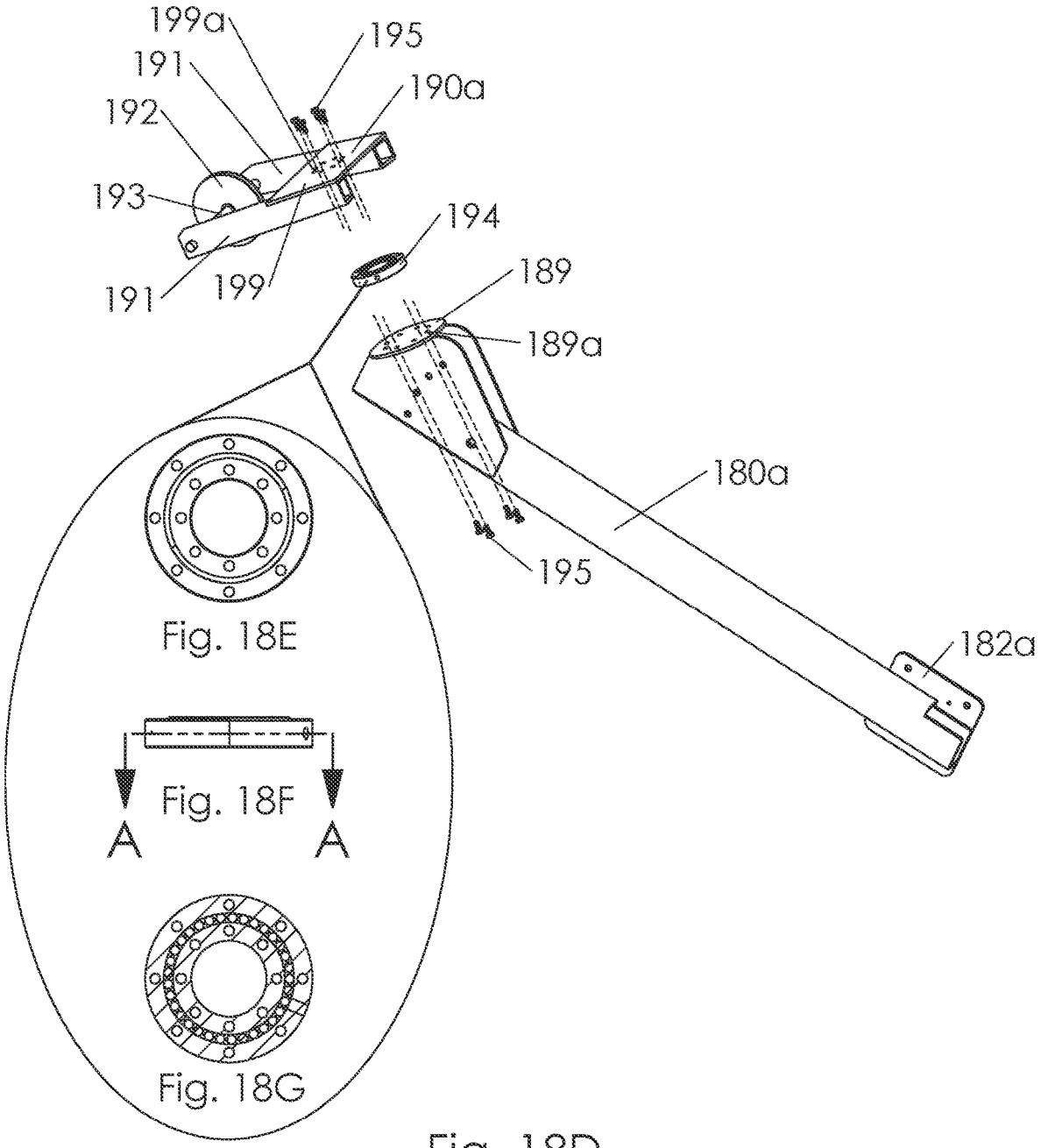
FIG. 18D is a perspective view of an extension fork in accordance with an embodiment of the present disclosure.
Figure 18H:
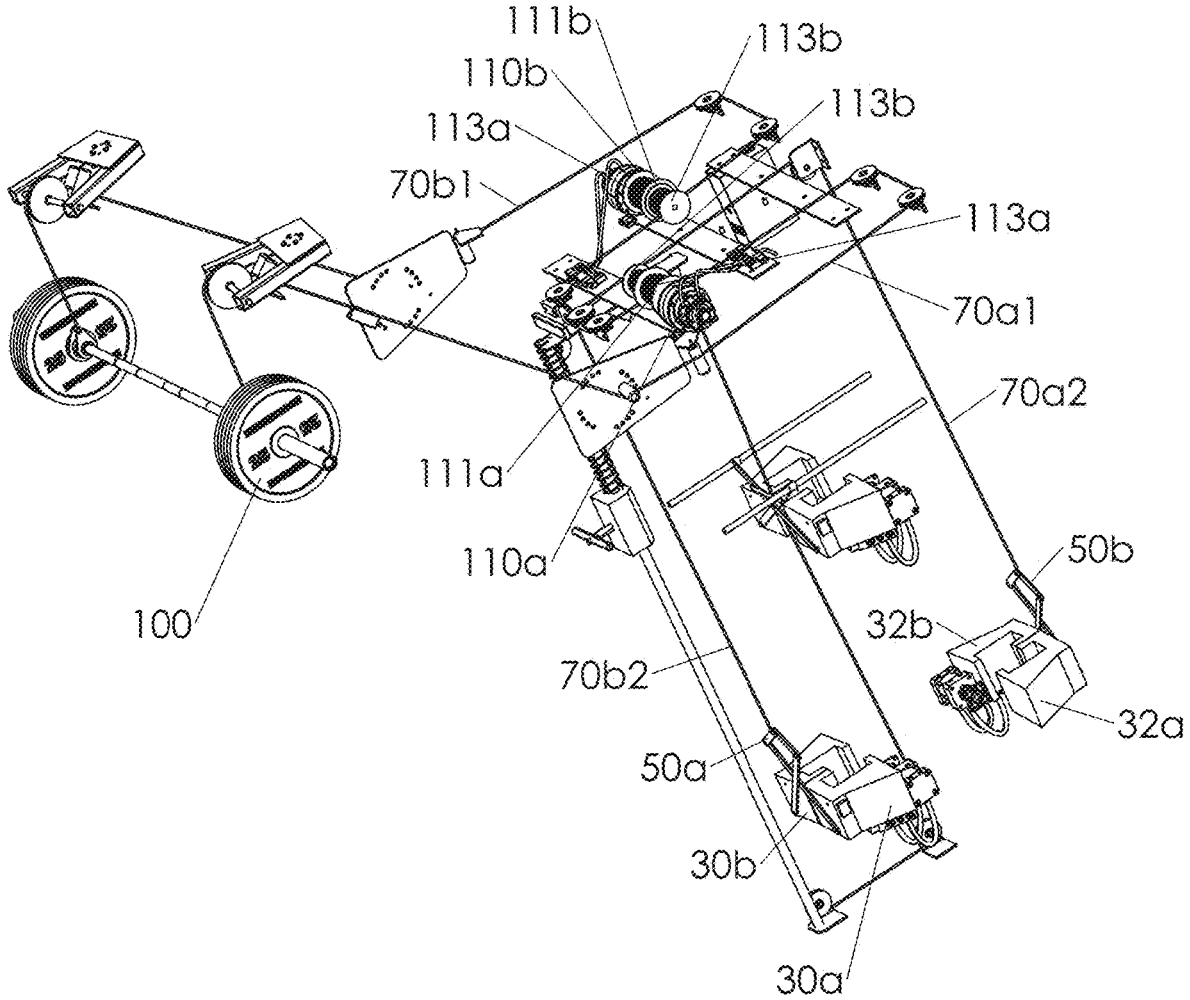
FIG. 18H is a schematic view of cable routing with respect to a barbell apparatus of FIG. 18A in accordance with an embodiment of the present disclosure.
Figure 18I:
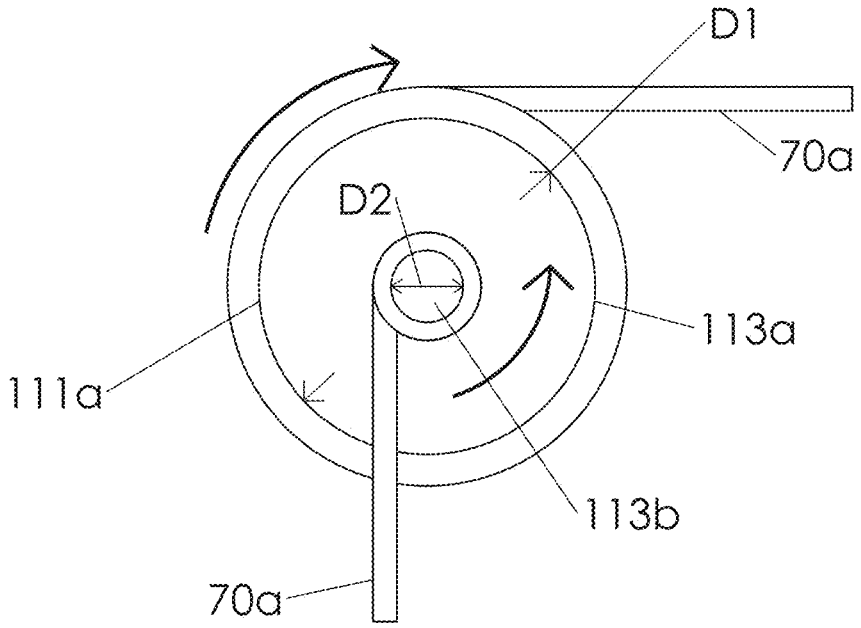
FIG. 18I is a schematic view of a cabling arrangement for a dual drum winch in accordance with an embodiment of the present disclosure.

Now referring to FIGS. 18A-18I, in one or more embodiments the cable winders 110*a*, 110*b* of apparatus 2 may be coupled to dual drum winches 111*a*, 111*b*, respectively rather than simple pulleys or sheaves, each including first and second drums 113*a*, 113*b*. For example, the double-drum winches 111*a*, 111*b* are mounted on or coupled to a motor shaft of the respective cable winders 110*a*, 110*b* so as to rotate therewith. Cable 70*a* is spooled on dual drum winch 111*a* with a portion of the cable 70*a* wound, in a first rotational direction (clockwise or counter-clockwise), on the first drum 113*a* of the dual drum winch 111*a* and a portion wound, in the opposite rotational direction of the first rotational direction, on the second drum 113*b* of the dual drum winch 111*a* such that such that as the motor shaft of cable winder 110*a* spins, with both drums 113*a*, 113*b* turning in the same direction, one drum pays out cable 70*a* and the other drum takes up cable 70*a*. For example, as shown in FIG. 18I, cable 70*a* is wound about the second drum 113*b* in a counterclockwise fashion, which cable 70*a* is wound about the first drum 113*a* in a clockwise fashion. With this arrangement, with clockwise rotation of the dual drum winch 111*a*, cable 70*a* is simultaneously paid out by the first drum 113*a* and taken up by the second drum 113*b*. With counterclockwise rotation of the dual drum winch 111*a*, the reverse effect is achieved, with the first drum 113*a* taking up cable 70*a* and the second drum 113*b* paying out the cable 70. The rotational orientations of the cable 70*a* may be switched. The dual drum winch 111*b* is configured in the same fashion as the dual drum winch 111*a*. In some embodiments, a planetary gear assembly may be attached to the motor shaft in order to attenuate the speed of rotation of the dual drum winches 111*a*, 111*b*. The inclusion of a planetary gear assembly can reduce both the travel distance and travel speed of cables 70*a*, 70*b*, including portions thereof, such as cables 70*a*2, 70*b*2 discussed below.

One end of cable 70*a* may extend from the barbell bar 102 of barbell 100 and be routed through pulleys the first drum 113*a*, while the other end of cable 70*a* may extend from the tensioning device 50*b* and routed via a series of pulleys to the second drum 113*b*. Similarly, cable 70*b* may be coupled at a first end to tensioning device 50*a* and routed via pulleys to the second drum 113*b* of dual drum winch 111*b*, and the other end of cable 70*b* may extend from the barbell bar 102 of barbell 100 to the first drum 113*a* of dual drum winch 111*b*.

As shown in FIG. 18I, for each of the dual drum winches 111*a*, 111*b*, it is preferred that the first and second drums 113*a*, 113*b* have different diameters D1, D2 to allow for different rates of take up and paying out. More preferably, the first drums 113*a* and provided with a diameter D1 which is larger than the diameter D2 of the second drums 113*b*. This difference in diameter allows for a difference in rate of paying out or taking up between the first and second drums 113*a*, 113*b*. With the diameter D1 being greater than the diameter D2, cable will be taken up or paid out about the first drums 113*a* faster than the rate of take up or pay out about the second drums 113*b* with simultaneous rotation of the first and second drums 113*a*, 113*b* at the same rate. In this manner, a fixed increment of movement of the cable 70*a*, 70*b* in response to movement of the barbell 100 results in a decreased increment (i.e., less than the fixed increment) of movement of the tensioning devices 50*a*, 50*b*. Advantageously, this permits the brake column to be shorter than the maximum traveling distance of the range of motion of the barbell 100 being spotted.

Those skilled in the art will recognize cables 70*a*, 70*b* may each be a single cable spooled on both drums of respective dual drum winches 111*a*, 111*b*. Preferably, as shown in FIG. 18H, cables 70*a*, 70*b* may be each provided in portions as two cables 70*a*1, 70*a*2 and 70*b*1, 70*b*2, respectively. Although the cables 70*a*, 70*b* may be provided in portions, the portions collectively act in the same manner as the cables 70*a*, 70*b* utilized as whole, single cables. The cable 70*a*1 may be connected to the barbell 100 and to the first drum 113*a* of the dual drum winch 111*a*, passing through a set of pulleys. The cable 70*a*2 may be connected to the tensioning device 50*b* associated with the brake shoes 32*a*, 32*b* and to the second drum 113*b* of the dual drum winch 111*a*. The cables 70*b*1, 70*b*2 are similarly arranged as the cables 70*a*1, 70*a*2, in being connected to the barbell 100, the tensioning device 50*a*, and the first and second drums 113*a*, 113*b* of the dual drum winch 111*b* in the same fashion. The dual drum winches 111*a*, 111*b* allow the cables 70*a*2, 70*b*2 to pay out or take up responsively to the cables 70*a*1, 70*b*1 being taken up or paid out due to movement of the barbell 100. With a qualifying event being detected, the brakes 30*a*, 30*b*, 32*a*, 32*b* are caused to be engaged, with the cables 70*a*2, 70*b*2 restricting rotation of the second drums 113*b* of the dual drum winches 111*a*, 111*b*. Consequently, rotation of the first drums 113*a* of the dual drum winches 111*a*, 111*b* is restricted resulting in restriction of downward movement of the barbell 100.

The dual drum winches 111*a*, 111*b* help ensure adequate tension exists on the cables 70*a*, 70*b* such that the brake assemblies function responsively. The drums of each dual drum winch may be grooved or smooth, and may have the same or different diameters. When the cable winders 110*a*, 110*b* are not engaged, for example, when the lifter is in control of the barbell, the cable winders 110*a*, 110*b* coast, allow the dual drum winches 111*a*, 111*b* to rotate freely, so that the cables 70*a*, 70*b* move freely, adding de minimis resistance and providing no assistance to the lifter. In the embodiments shown, the cable winders 110*a*, 110*b* are operably coupled to solenoid blocks 141*a* and 141*b*. Pneumatic power may be applied to the cable winders 110*a*, 110*b* via the solenoid blocks 141*a*, 141*b* to lift the barbell 100 under command of a lifter, or other user, to a desirable height for the start of an exercise or to a desired at-rest height awaiting further use. Suitable double drum winch assemblies are commercially available for example from Electrolift of Clifton, N.J.

The solenoid blocks 141*a*, 141*b* may be any suitable commercially available pneumatic valve manifold such as but are not limited to AVS-5 Series pneumatic directional control solenoid valves from Nitra Pneumatics.

The booms 12*a*, 12*b* may be modified to be angularly adjustable. Embodiments of the barbell spotting apparatus 2 may include booms 180*a*, 180*b* extending from an upper part of the frame 10 and forks 190*a*, 190*b* coupled to the booms 180*a*, 180*b*, respectively. The booms 180*a*, 180*b* may be any suitable construction. In one embodiment the booms 180*a*, 180*b* are tubular to accommodate the passage therethrough of cables 70*a*, 70*b*. The booms 180*a*, 180*b* may include cable guides 184. The angle of the booms 180*a*, 180*b* relative to the frame 10 may be varied to accommodate space and/or user requirement. Frame 10 may include mounting plates 186*a*, 186*b* each having a plurality of holes 188*a*, 188*b*, respectively. Booms 180*a*, 180*b*, other than being left and right hand versions of the same apparatus, have the same features, as do mounting plates 186*a*, 186*b*, so for purposes of brevity the following description of boom 180*a* and mounting plate 186*a* applies equally to boom 180*b* and mounting plate 186*b*. The boom 180*a* may include a mounting flange 182*a* with mounting apertures 183*a*. Boom 180*a* may be fixed at a desired angle relative to frame 10 by aligning selected mounting apertures 183*a* of mounting plate 186*a* with selected holes 188*a* of mounting flange 182*a* and securing the mounting flange 182*a* to the mounting plate 186*a* with fasteners such as bolts, screws or the like. Any number of mounting apertures 183*a* and holes 188*a* may be present to provide multiple angle possibilities. Boom 180*a* may include a mounting plate 184 with a plurality of apertures 185*a* so that the angle of the extension fork 190*a* may be adjusted.

The adjustable booms 180*a*, 180*b* permit the height of the frame 10 to be reduced without sacrificing range of movement for the lifter. For example, and not by way of limitation, the frame 10 in the embodiments shown in FIGS. 1-5, where booms 12*a*, 12*b* are not angularly adjustable, would need to be 12 feet high in order to allow a lifter a usable range of movement of up to 12 feet. There may be situations where a 12 foot high frame would simply not be practical. Such a frame would require a ceiling height of at least 12 feet and could create logistical issues with respect to shipping and set-up.

With the booms 180*a*, 180*b* angled upward to the desired height, the frame 10 and columns can be shorter, for example, 8 feet in height, and still provide a usable range of motion from 8 feet up to 11 or even-12 feet, allowing even the tallest lifters, including those having a standing overhead reach of 10.5 feet, to utilize the apparatus. For context, an individual who stands 6.5 feet tall with a 3 standard deviation arm length would have a standing reach of 9 feet 1 inch. Therefore, the overwhelming majority of users can enjoy the full range of overhead motion using the barbell spotting apparatus in places where ceilings are as low as 10 feet, which is extremely common in commercial construction. Facilities which have ceiling heights of just 9 feet will be able to provide users 8.75 feet of overhead motion. Of course, only a few barbell exercises require full overhead extension; thus, athletes taller than 6 feet 2 inches can still perform all other movements with full functionality of the apparatus.

Now referring to FIG. 18D, in certain embodiments each of forks 190*a*, 190*b* include fork arms 191, wheel 192, axle 193, and bearing 194. Forks 190*a*, 190*b* are each pivotably coupled to an end of respective booms 180*a*, 180*b*. Bearing 194 permits the forks 190*a*, 190*b* to swivel relative to the fixed booms 180*a*, 180*b*, facilitating swaying of the barbell, and, combined with other features disclosed herein, providing the lifter with unconstrained movement in three axes of motion. With further reference to FIGS. 18E-18G, bearing 194 may be any suitable bearing such as a slewing ring with roller bearings. Suitable slewing ring bearings are available commercially from Silverthin of Preston, Wash. The bearing 194 may be secured between bearing plates 189 and 199 using fasteners 195 such as bolts. The wheels 192 of the forks 190*a*, 190*b* may act as cable guides for the cables 70*a*, 70*b* with the cables 70*a*, 70*b* being suspended therefrom.

Figure 19A:
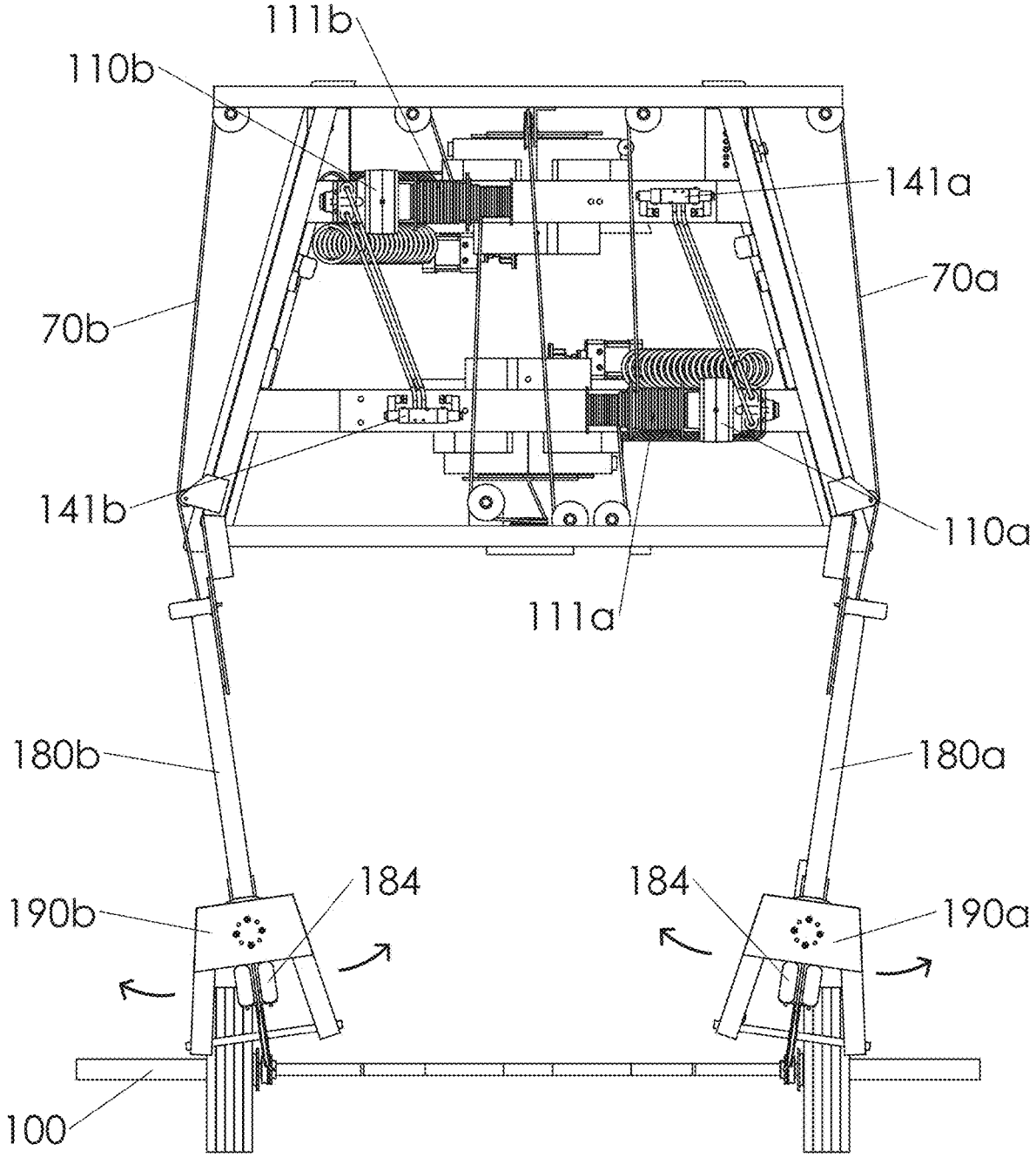
FIG. 19A is a top plan view of a barbell spotting apparatus in accordance with an embodiment of the present disclosure.
Figure 19B:
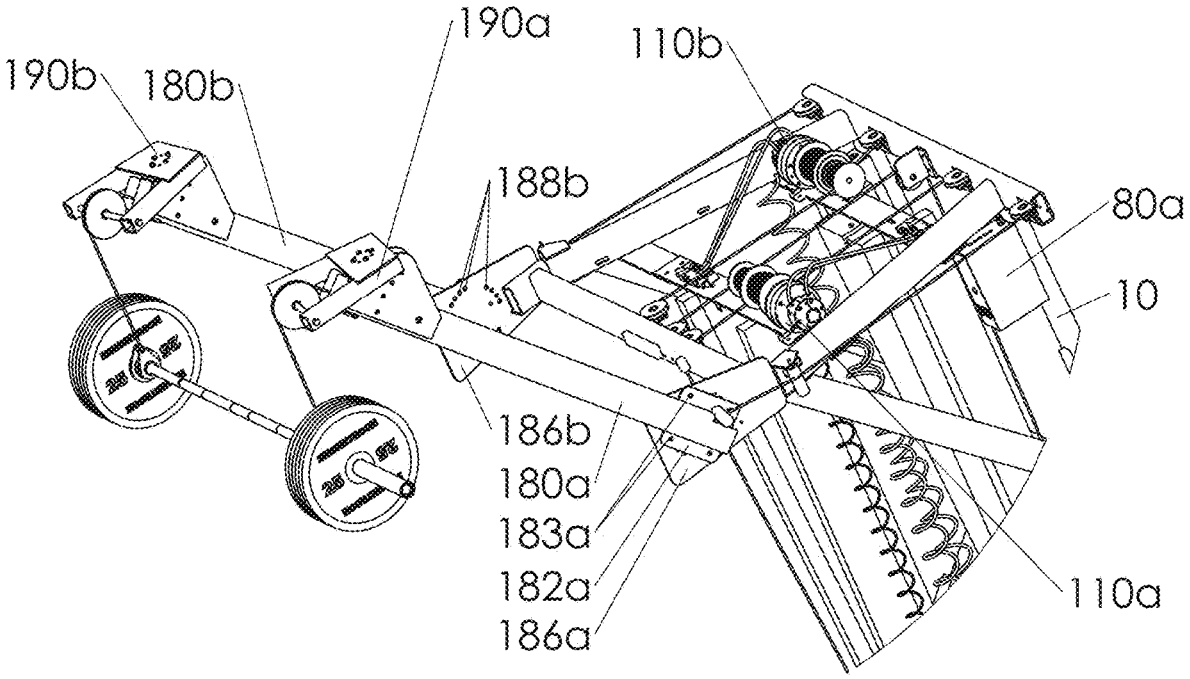
FIG. 19B is a top perspective view of a barbell spotting apparatus of FIG. 19A in accordance with an embodiment of the present disclosure.
Figure 19C:
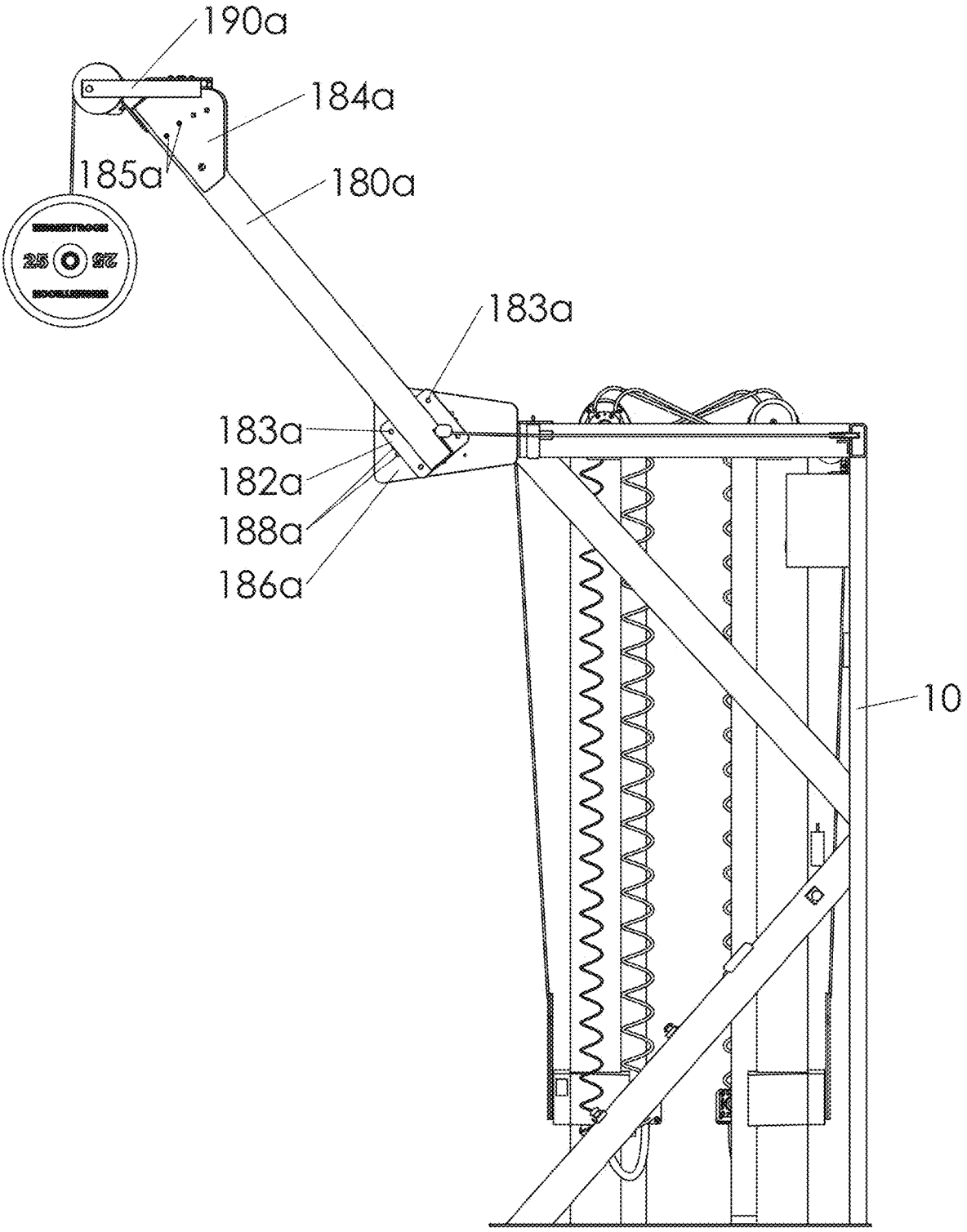
FIG. 19C is a side view of a barbell spotting apparatus of FIG. 19A in accordance with an embodiment of the present disclosure.
Figure 20A:
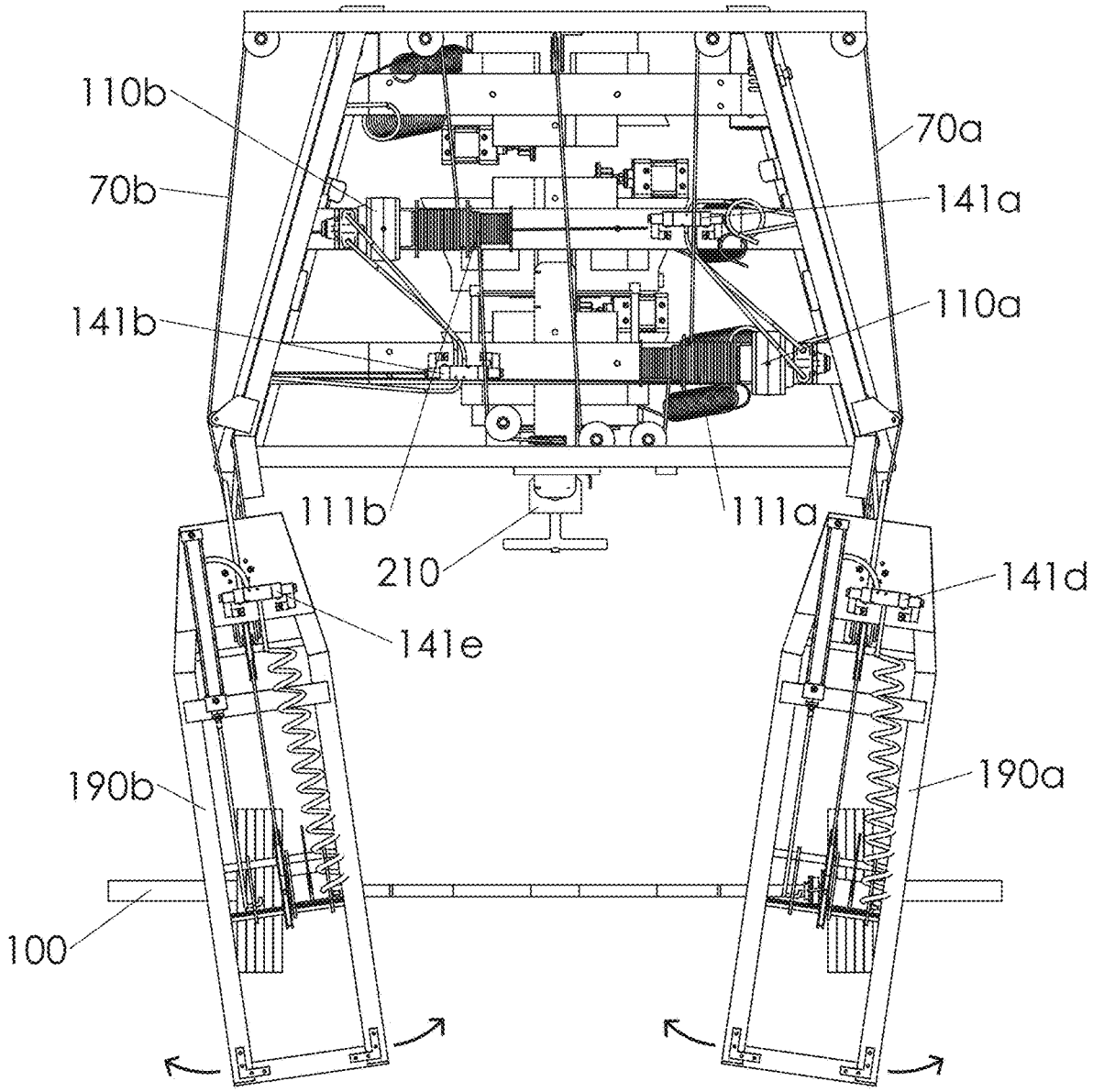
FIG. 20A is a top plan view of a barbell spotting apparatus in accordance with an embodiment of the present disclosure.
Figure 20B:
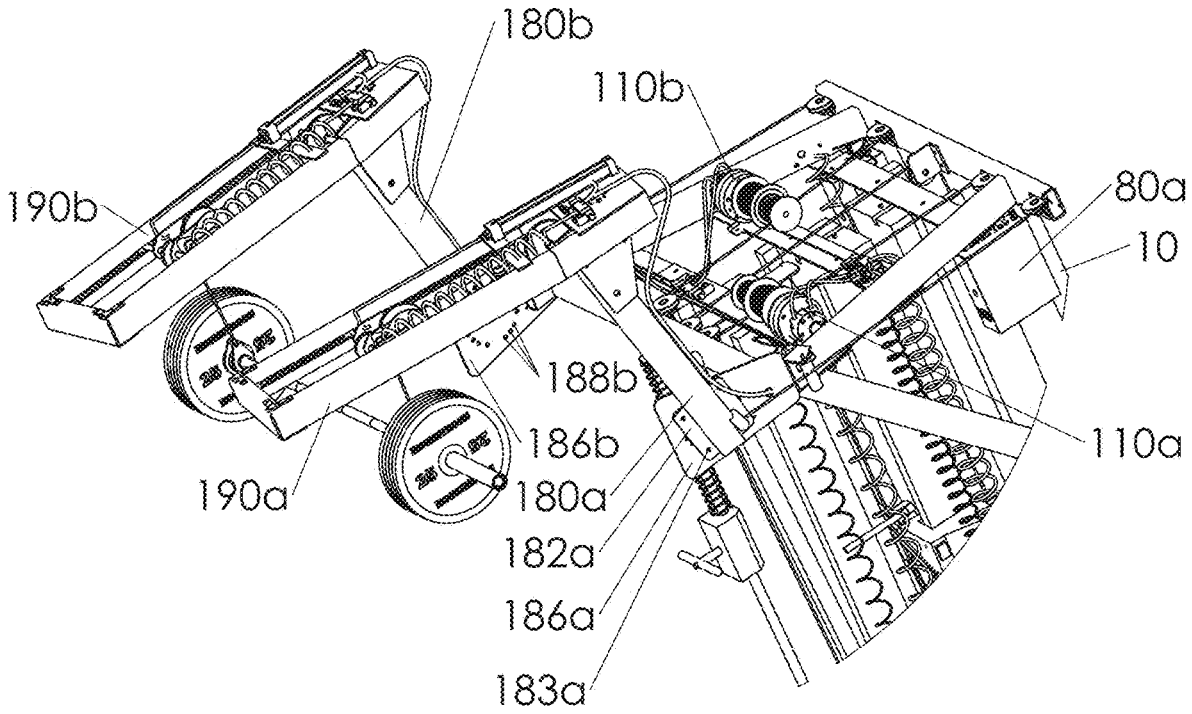
FIG. 20B is a top perspective view of a barbell spotting apparatus of FIG. 20A in accordance with an embodiment of the present disclosure.
Figure 20C:
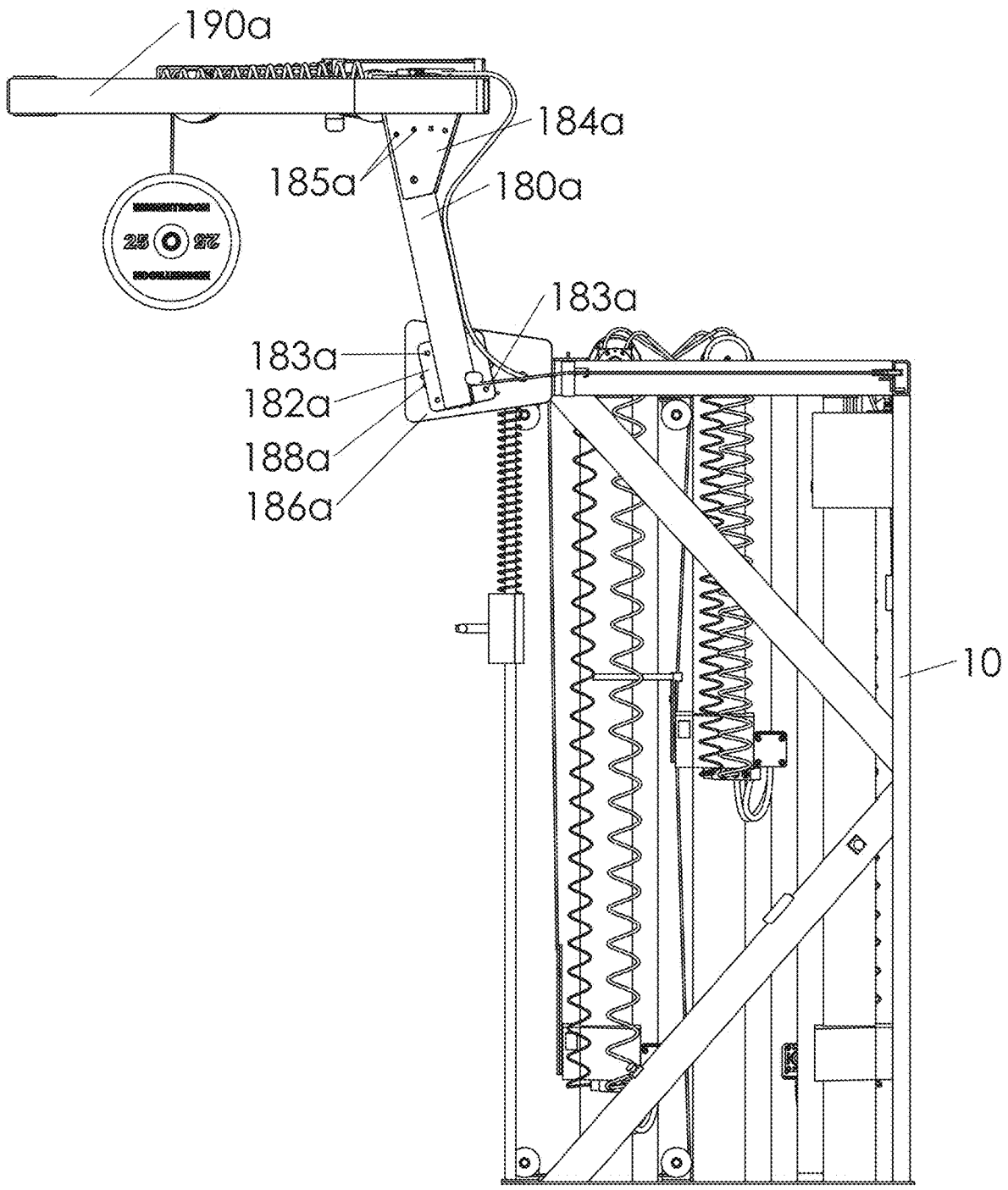
FIG. 20C is a side view of a barbell spotting apparatus of FIG. 20A in accordance with an embodiment of the present disclosure.
Figure 20D:
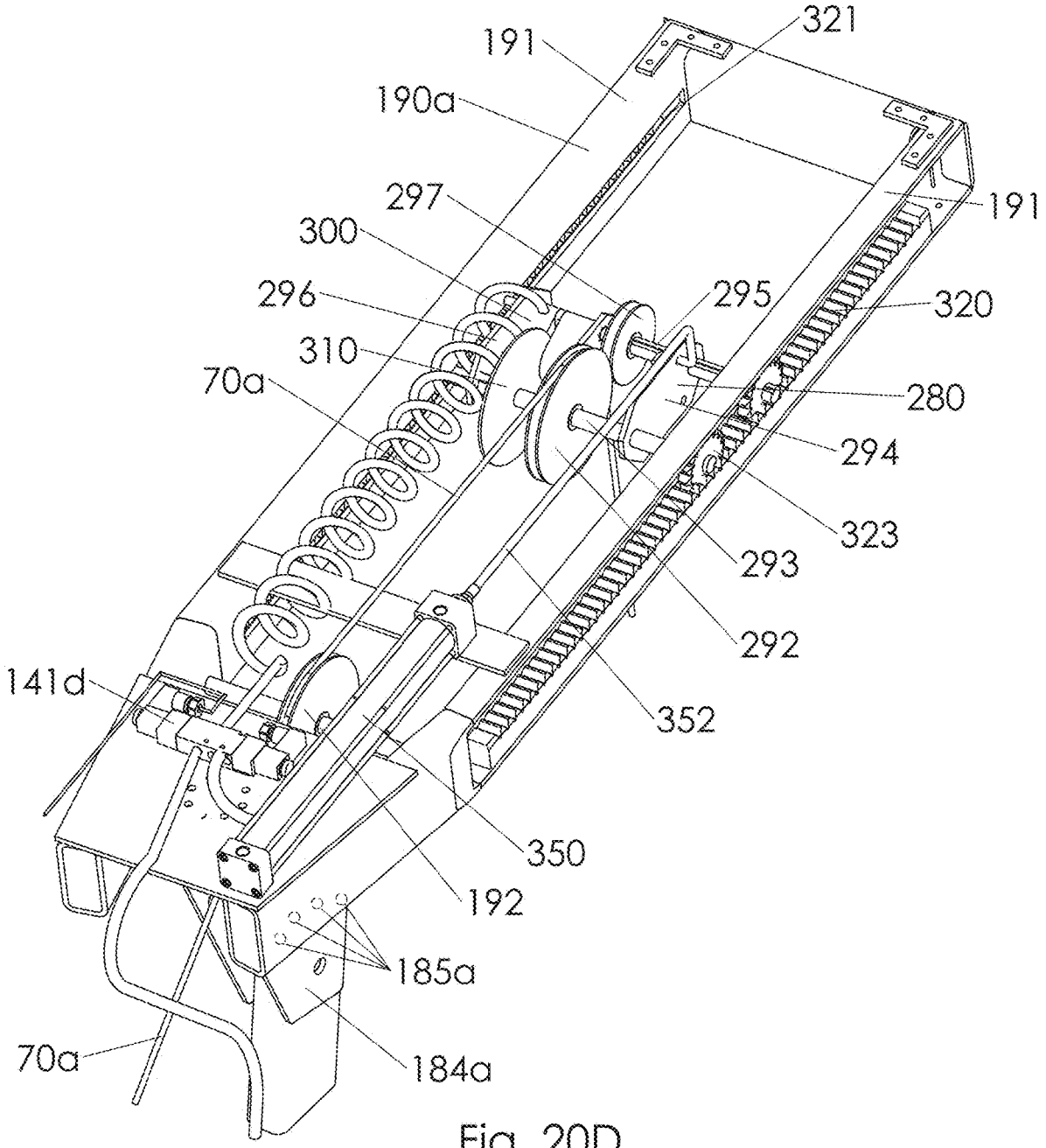
FIG. 20D is a perspective view of an extension fork and sled apparatus in accordance with an embodiment of the present disclosure.

The embodiment of FIGS. 18A-18I utilizes three columns 20*a*, 20*b*, 20*c*, as shown with the embodiment of FIGS. 14-17. Now referring to FIGS. 19A-19C, the embodiments described above with respect to FIGS. 18A-18I are applicable to embodiments of a barbell spotting apparatus having two columns 20*a*, 20*b*.

Now referring to FIGS. 20A-20D, in further embodiments, the barbell spotting apparatus 2 (whether it be a two or three column arrangement) the forks 190*a*, 190*b* may be each modified to include a sled assembly 280 slidably engaged with fork arms 191 and operable to move reciprocally in the direction shown by the arrows. The sled assembly 280 permits reciprocal movement (toward the lifter and away from the lifter) of the barbell 100 without compromising balance.

For purposes of brevity the following description with respect to extension fork 190*a* applies equally to extension fork 190*b*. The extension fork 190*a* is pivotably coupled to the boom 180*a* as described above. The sled assembly 280 includes axles 293 and 295 coupled to each other with brackets 294, 296. Axle 293 includes a pulley 292, brake disc 310 and toothed wheels 323, all of which are keyed to the axle 293 so they rotate with rotation of the axle. Axle 295 includes a secondary pulley 297, brake calipers 300 and toothed wheels 323. The wheels 323 on axle 295 rotate freely on the axle, which does not rotate. The toothed wheels 323 on both axles engage toothed tracks 320 positioned in each of the fork arms 191 through channels 321. Cable 70*a* extends over pulley 192 and pulley 292 to a barbell bar (not shown). Secondary pulley 297 prevents cable 70*a* from disengaging from pulley 292. Pulley 292 acts a cable guide from which cable 70*a* is suspended. Brake calipers 300 are operable to engage the brake disc 310 upon a triggering event, preventing rotation of the disc 310 and axle 293 and halting movement of the sled assembly 280 in either direction. The toothed wheels 323 and toothed tracks 320 are robust enough to prevent the sled assembly 280 from sliding when the brake calipers 300 are engaged. Suitable toothed wheels include but are not limited to spur gears commercially available from KH USA of Mineola, N.Y. Suitable toothed tracks include but are not limited to gear racks commercially available from KH USA. Brake calipers 300 may be electrically or pneumatically actuated. Suitable brake calipers include but are not limited to P20 pneumatic brake calipers commercially available from Tolomatic, Inc. of Hamel, Minn. In the embodiment, shown, the brake calipers 300 are pneumatically coupled to a solenoid block 141*d*, which in turn is pneumatically coupled to control box 80*a* and electrically coupled to the control box 80*b*. As with other braking devices disclosed herein, the brake calipers 300 may be triggered by a switch or detection by a sensor operable to detect one or more of the qualifying conditions, such as but not limited to a voice command, detection of a predetermined downward velocity or acceleration of the barbell, uneven barbell movement, a time period of no movement, eye or eyelid movement, emergency stop switch, or the like. Likewise, release of the brake caliper 300 may accomplished using a switch or sensor. For example, and not by way of limitation, the resting state of the sled 280 may be immobile, with the brake calipers 300 engaged with the brake disc 310 to prevent any movement of the sled 280. A triggering event such as but not limited to upward movement of greater than a predetermined distance, e.g., 3 inches, activation by a switch, etc. triggers release of the brake calipers 300, allowing free reciprocal movement of the sled 280. A further triggering event, such as but not limited to a sudden drop of the weight, activation of a switch such as an emergency stop button, uneven descent, etc. will cause the brake calipers 300 to engage the brake disc 310 to immobilize the sled 280.

In some embodiments, one or both of the extension fork 190*a*, 190*b* may further include a pneumatic cylinder 350 pneumatically coupled to the solenoid valve block 141*d*. The pneumatic cylinder 350 includes an extension rod 352 coupled to bracket 294. The pneumatic cylinder 350 is actuated by a switch electrically coupled to the control box 80*b* to move the sled assembly 280 to a desired position. Suitable switches include but are not limited to a four-way joystick switch commercially available from Eaton Corporation.

Figure 21:
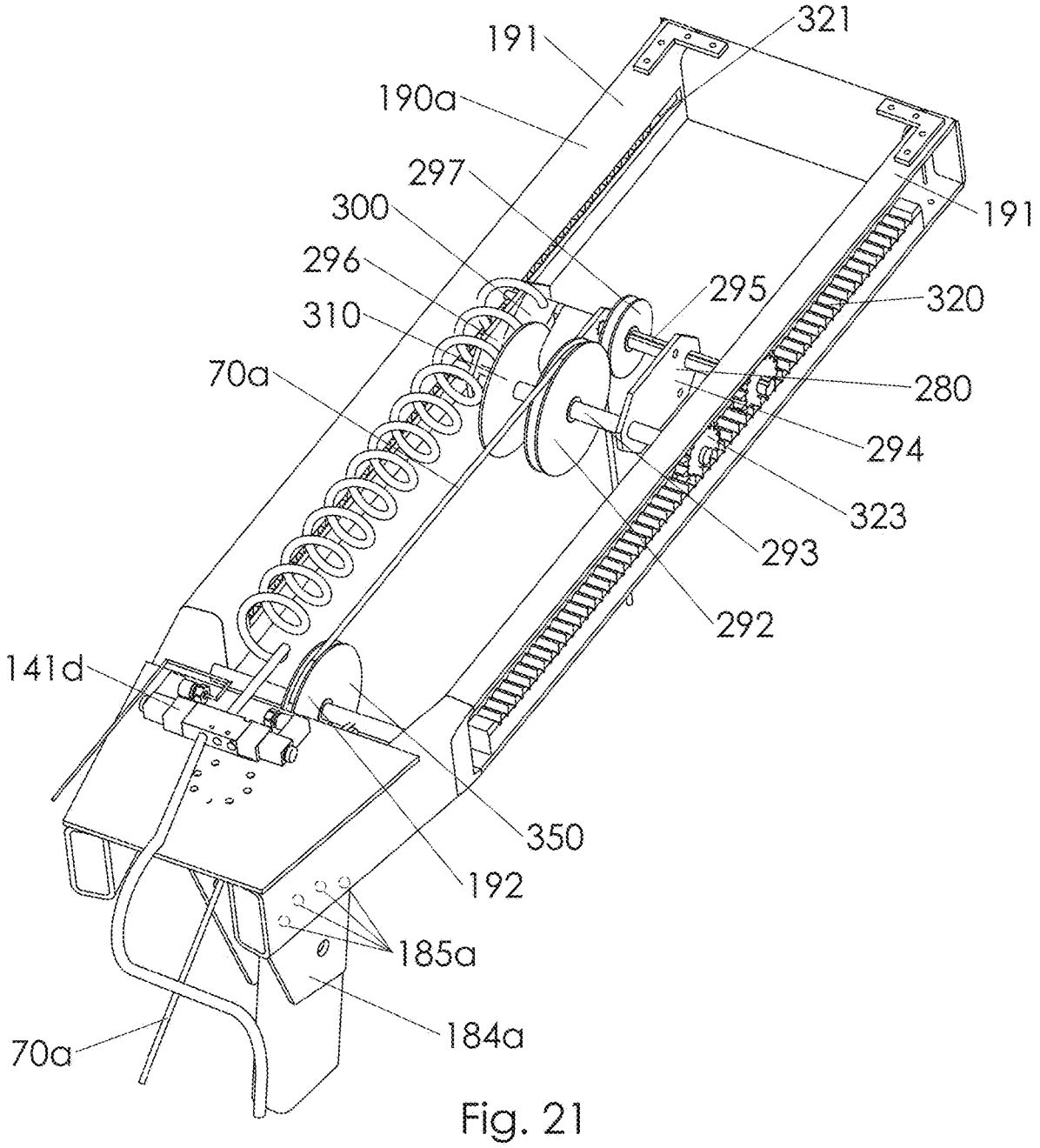
FIG. 21 is a perspective view of an extension fork and sled apparatus in accordance with an embodiment of the present disclosure.

Now referring to FIG. 21, in one embodiment one or both of the forks 190*a*, 190*b* may not include a pneumatic cylinder.

Figure 22A:
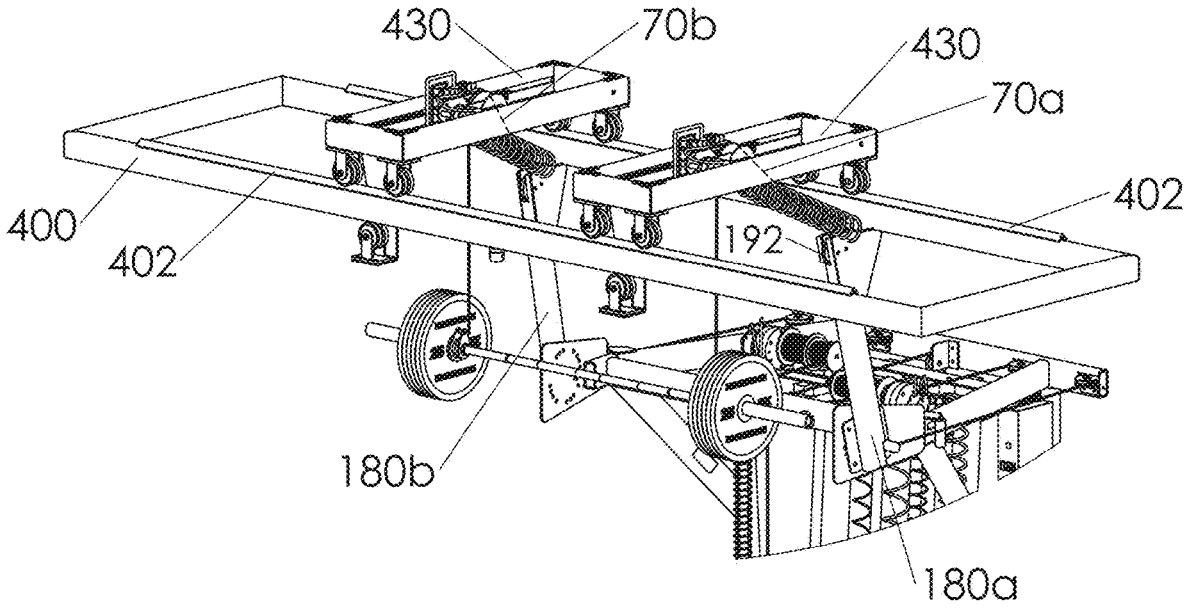
FIG. 22A is a perspective view of a trolley support frame coupled to a barbell spotting apparatus and trolleys positioned on the trolley support frame in accordance with an embodiment of the present disclosure.
Figure 22B:
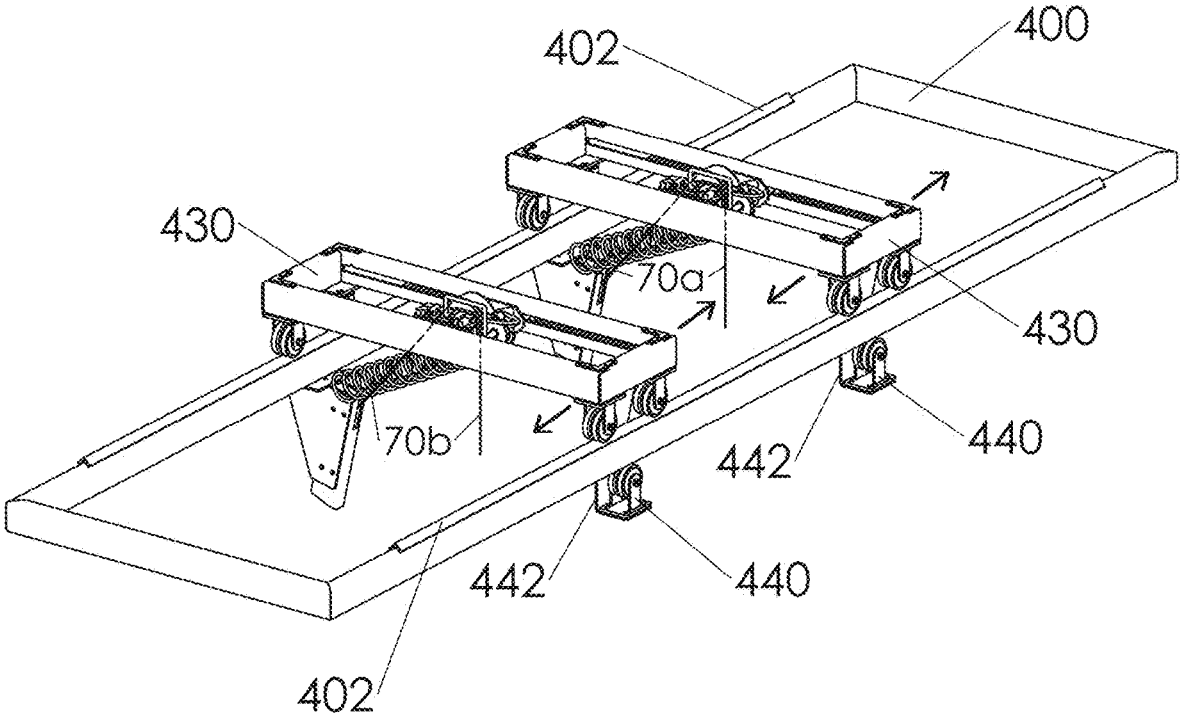
FIG. 22B is a perspective view of a trolley support frame and trolleys positioned on the trolley support frame in accordance with an embodiment of the present disclosure.
Figure 22C:
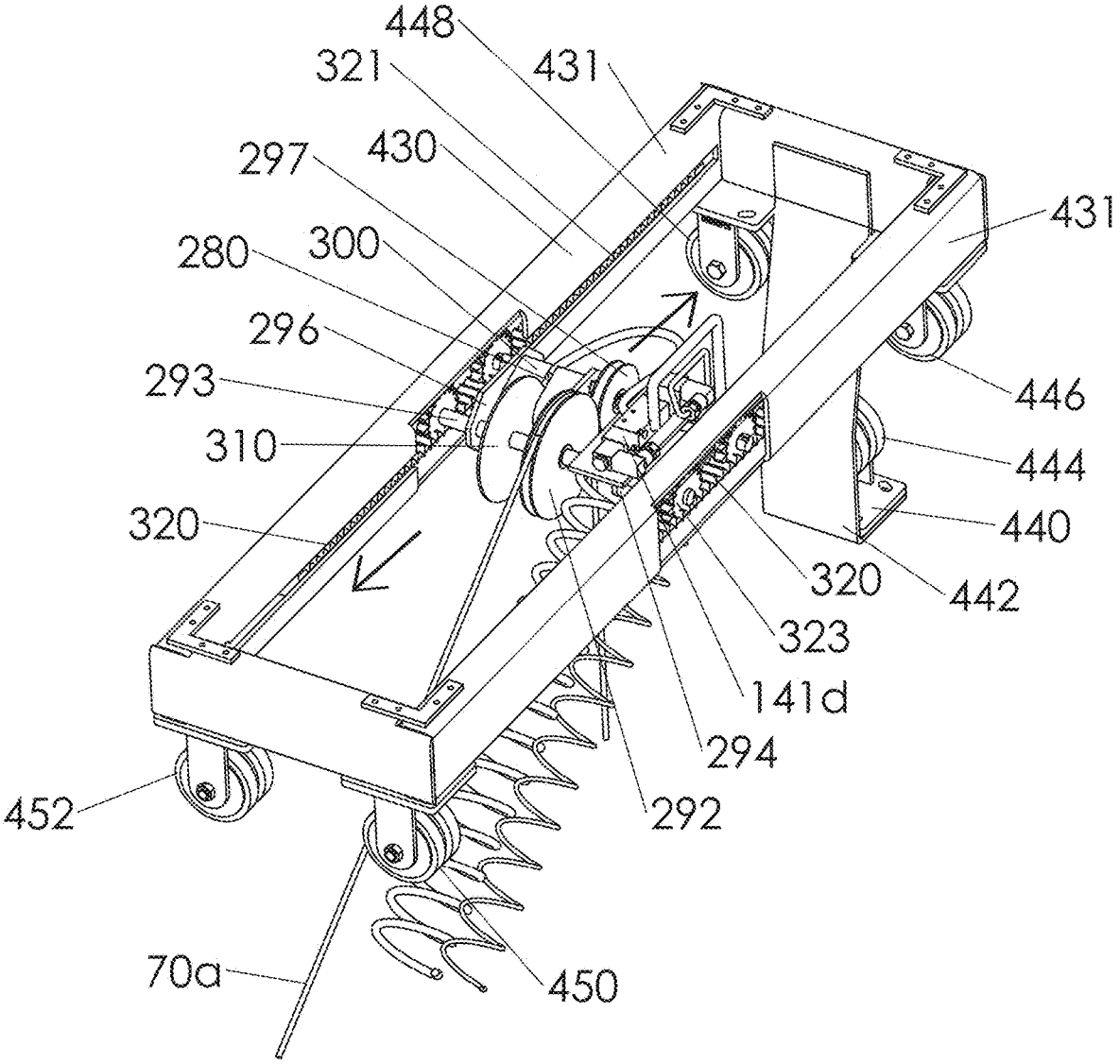
FIG. 22C is an elevated perspective view of a trolley and sled apparatus in accordance with an embodiment of the present disclosure.

Now referring to FIGS. 22A-C, in a further embodiment, rather than forks, the barbell spotting apparatus 2 (whether it be a two or three column arrangement) may include a trolley support frame 400 extending from booms 180*a*, 180*b*. The trolley support frame 400 is configured to support trolleys 430 on wheel guides 402. Each trolley 430 includes a trolley frame 431, bottom wheel bracket assembly 440 which includes bracket 442 extending from trolley frame 431 and wheel 444 rotatably coupled to the bracket 444, wheels 446 and 448 extending from the bottom of one end of the trolley frame 431 on the same side as the bottom wheel bracket assembly 440, wheels 450 and 452 extending from the bottom of the trolley frame 431 at the end opposite wheels 446 and 448, and sled assembly 280 slidably mounted on trolley 430. Each sled assembly 280 includes axles 293 and 295 coupled to each other with brackets 294, 296. Axle 293 includes a pulley 292, brake disc 310 and toothed wheels 323, all of which are keyed to the axle 293 so they rotate with rotation of the axle. Axle 295 includes a cable guide 297, brake calipers 300 and toothed wheels 323. The wheels 323 on axle 295 rotate freely on the axle, which does not rotate. The toothed wheels 323 on both axles engage toothed tracks 320 positioned in each of the channels 321. Cable 70*a* extends from pulley 192 over pulley 292 to a barbell bar (not shown). Pulleys 192 may be pivotable to accommodate the side-to side motion of the trolleys 430. Cable guide 297 prevents cable 70*a* from disengaging from pulley 292. Brake calipers 300 are operable to engage the brake disc 310 upon a triggering event, preventing rotation of the disc 310 and axle 293 and halting movement of the sled assembly 280 in either direction.

In the embodiment, shown, the brake calipers 300 are pneumatically coupled to a solenoid block 141*d*, which in turn is pneumatically coupled to control box 80*a* and electrically coupled to the control box 80*b*. The solenoid block 141*d* may be mounted to the sled 280, for example, to bracket 294, so that it moves along with the sled 280. As with other braking devices disclosed herein, the brake calipers 300 may be triggered by a switch or detection by a sensor operable to detect one or more of the qualifying conditions, such as but not limited to a voice command, detection of a predetermined downward velocity or acceleration of the barbell, uneven barbell movement, a time period of no movement, eye or eyelid movement, emergency stop switch, or the like. Likewise, release of the brake caliper 300 may accomplished using a switch or sensor. For example, and not by way of limitation, the resting state of the sled 280 may be immobile, with the brake calipers 300 engaged with the brake disc 310 to prevent any movement of the sled 280. A triggering event such as but not limited to upward movement of greater than a predetermined distance, e.g., 3 inches, activation by a switch, etc. triggers release of the brake calipers 300, allowing free reciprocal movement of the sled 280. A further triggering event, such as but not limited to a sudden drop of the weight, activation of a switch such as an emergency stop button, uneven descent, etc. will cause the brake calipers 300 to engage the brake disc 310 to immobilize the sled 280.

Each trolley 430 is mounted to the trolley support frame 400 by virtue of the engagement of wheels 444, 446 and 448 on one side of the trolley support frame 400 and wheels 450 and 452 on the opposite side of the trolley support frame 400. The wheels 444, 446, 448, 450 and 452 may be any suitable wheel such as but not limited to a V-grooved track wheel or caster commercially available for example from Hamilton Caster of Hamilton, Ohio. Wheel guides 402 are configured to fit in grooves of the wheels 444, 446, 448, 450 and 452 such that the wheels are guided along the trolley support frame 400. As shown the wheel guides 402 are only visible on the top surface of the trolley support frame 400, but one skilled in the art will recognize wheel guides are present on the bottom surface (opposite the top surface) of the trolley support frame 400 to engage wheels 444 of the trolleys 430. The trolleys 430 are independently freely movable along the trolley support frame 400. In some embodiments one or both of the trolleys 430 may include a bottom wheel bracket assembly 440 at each end of the trolley(s) 430. Trolley support frame 400 may include stops (not shown) positioned at the ends of the wheel guides 402.

The following are some exemplary arrangements.

The brake columns are 8 feet tall and the maximum range of vertical motion is 12 feet for the barbell; the ratio of these distances is (8 feet/12 feet)=0.67.

Each of the two cable winders is set-up such that the double drum winch has drums of two different diameters. The grooved drum assembly coupled by cable to the brake assembly has a diameter of about 67% of that of the grooved drum assembly coupled by cable to the barbell.

Booms may be coupled to the frame at the below angles for the following situations:

| Overhead Height Below Booms (Permissible Height for Overhead Lifts) | Boom Angle | Accommodated Athlete Height |
|---|---|---|
| 11.75 feet | 50 degrees | tallest of athletes, full overhead movement |
| 10.75 feet | 36.9 degrees | athletes up to 7'6", Full overhead movement |
| 9.75 feet | 22.5 degrees | athletes up to 6'9", full overhead movement |
| 8.75 feet | 9.5 degrees | athletes up to 6'2", full overhead movement |

In any of the embodiments utilizing the booms (whether adjustable or not), one or more of the columns 20*a*, 20*b*, 20*c* may be filled with sand or water to provided additional weight in the respective column(s). This creates a counterweight effect against the barbell 100. It is preferred that sufficient counterweight be provided to allow barbell 100 to be suspended in front of the booms for free movement of the barbell 100. The resulting moment is counteracted by the counterweight effect of the column(s) 20*a*, 20*b*, 20*c*.

Now referring to FIGS. 23A-I, in a further embodiment of the barbell spotting apparatus 2, frame 10 includes trolley support frame 400 supported on each end by legs 3, which include bases 4 and supports 6. Columns 20*a* and 20*b* are positioned at opposite ends of the frame 10 adjacent the legs 3. Columns 20*c* are positioned adjacent columns 20*a* and 20*b*. Trolley support frame 400 may include stops 403 positioned at the ends of the wheel guides 402.

The frame 10 may include one or more cameras 130*a*, 130*b*, microphones 140 and/or LED lights 82 positioned thereon as described hereinabove.

A first pair of brake shoes 30*a*, 30*b* are coupled to column 20*a* and second pair of brakes shoes 32*a*, 32*b* are coupled to column 20*b* as described above. Brake shoes 30*a*, 30*b* are coupled to a first end of tensioning device 50*a*, and brake shoes 32*a*, 32*b* are coupled to a first end of tensioning device 50*b*. Cable 70*a* is coupled at a first end to tensioning device 50*b* and routed via cable winder 110*a* through a series of pulleys 500, 510, 520 and 530 positioned on a first trolley 430 positioned on the trolley support frame 400 proximal to the column 20*b*, and coupled at a second end to a barbell bar 102 of barbell 100. Cable 70*b* is coupled at a first end to tensioning device 50*a* and routed via cable winder 110*b* through a series of pulleys 500, 510, 520 and 530 positioned on a second trolley 430 positioned on the trolley support frame 400 proximal to the column 20*a*, and coupled at a second end to a barbell bar 102 of barbell 100. The cables 70*a*, 70*b* are coupled to the barbell bar 102 in a spaced-apart configuration so as not to interfere with the grip of a lifter. The cable winders 110*a*, 110*b* may be provided with the dual drum winches 111*a*, 111*b* in the same manner as described above, including with the cables 70*a*, 70*b* being in multiple portions.

Figure 23A:
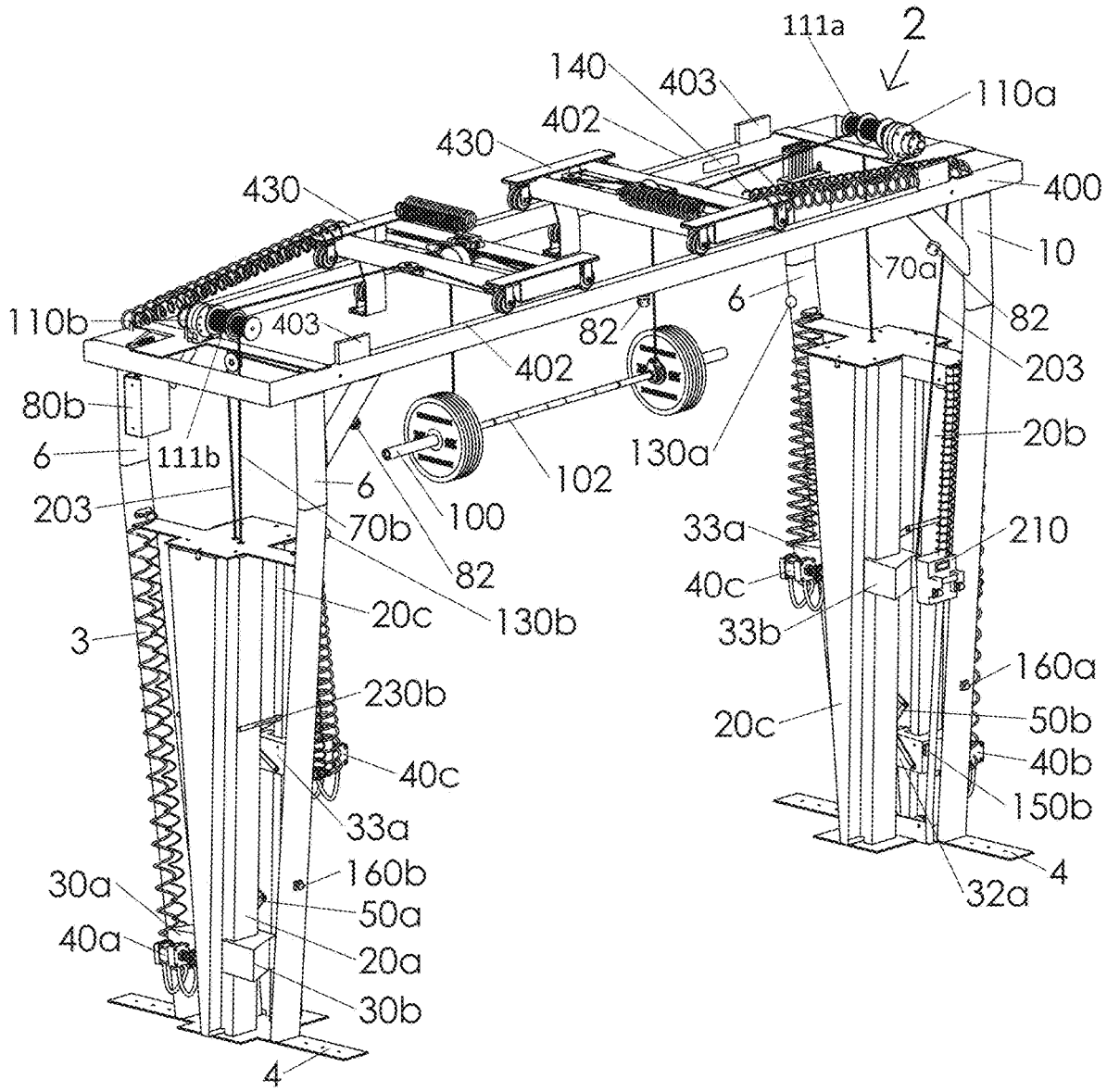
FIG. 23A is a perspective view of a barbell spotting apparatus in accordance with an embodiment of the present disclosure.
Figure 23B:
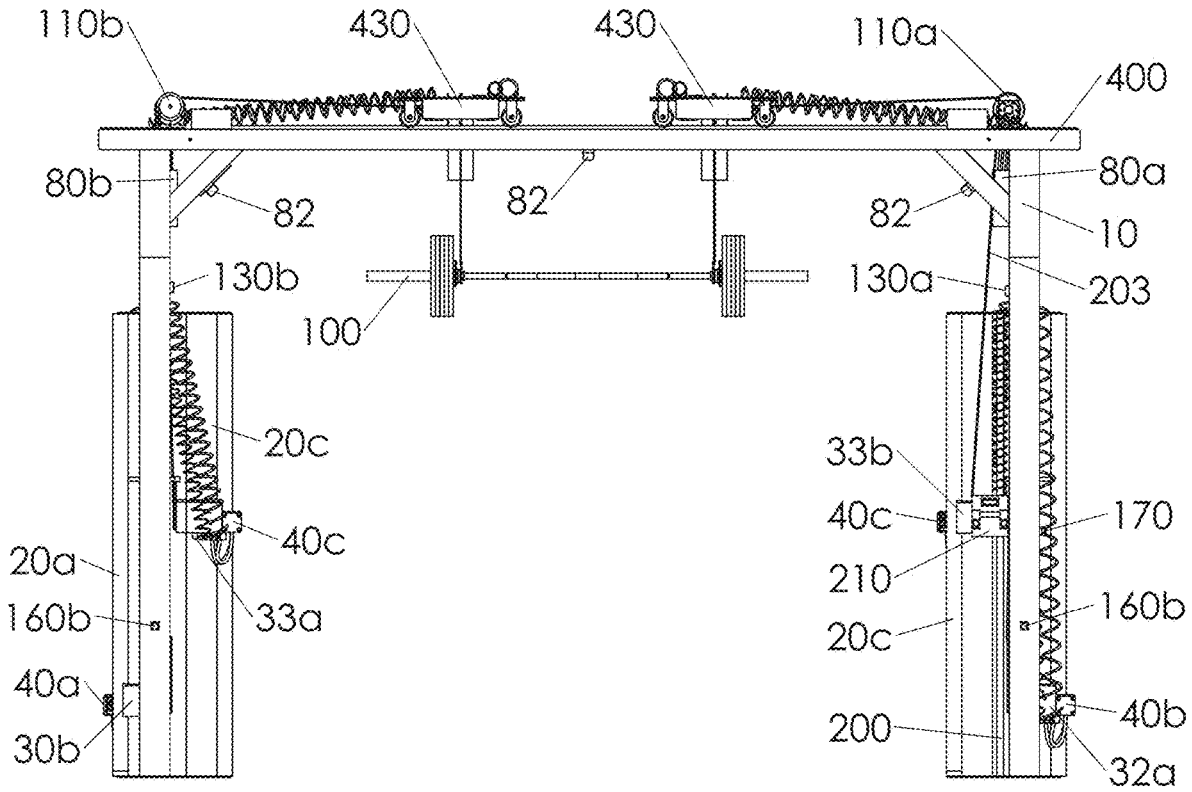
FIG. 23B is a front view of a barbell spotting apparatus of FIG. 23A in accordance with an embodiment of the present disclosure.
Figure 23C:
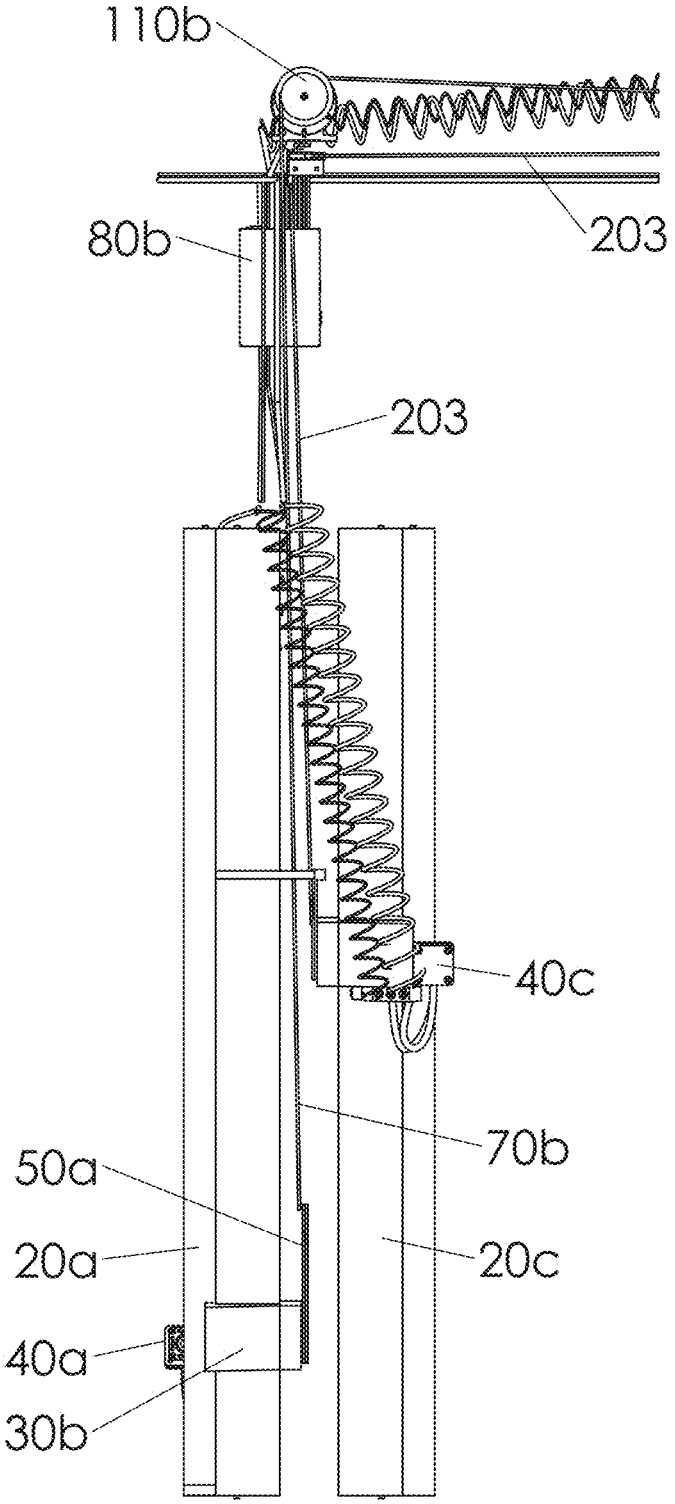
FIG. 23C is a front view of column 20*a* and a column 20*c* of the barbell spotting apparatus of FIG. 23A with a support removed in accordance with an embodiment of the present disclosure.
Figure 23D:
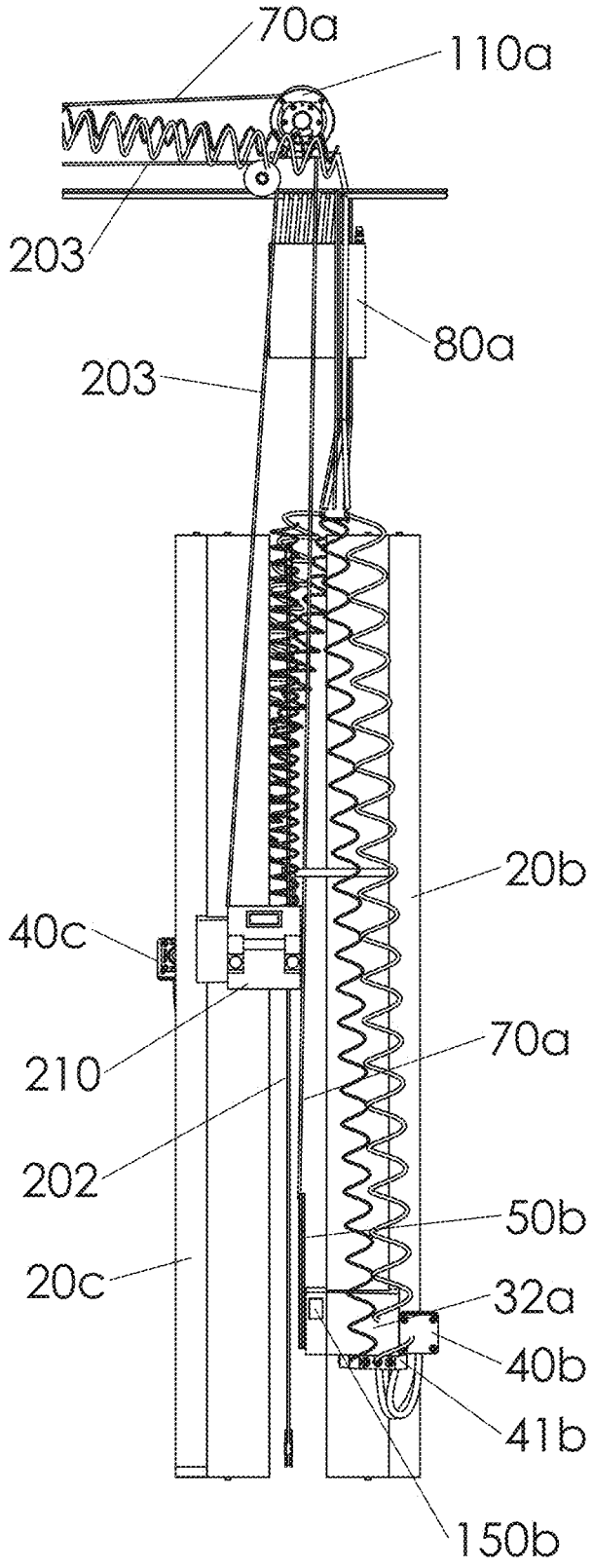
FIG. 23D is a front view of column 20*b* and a column 20*c* of the barbell spotting apparatus of FIG. 23A with a support removed in accordance with an embodiment of the present disclosure.
Figure 23E:
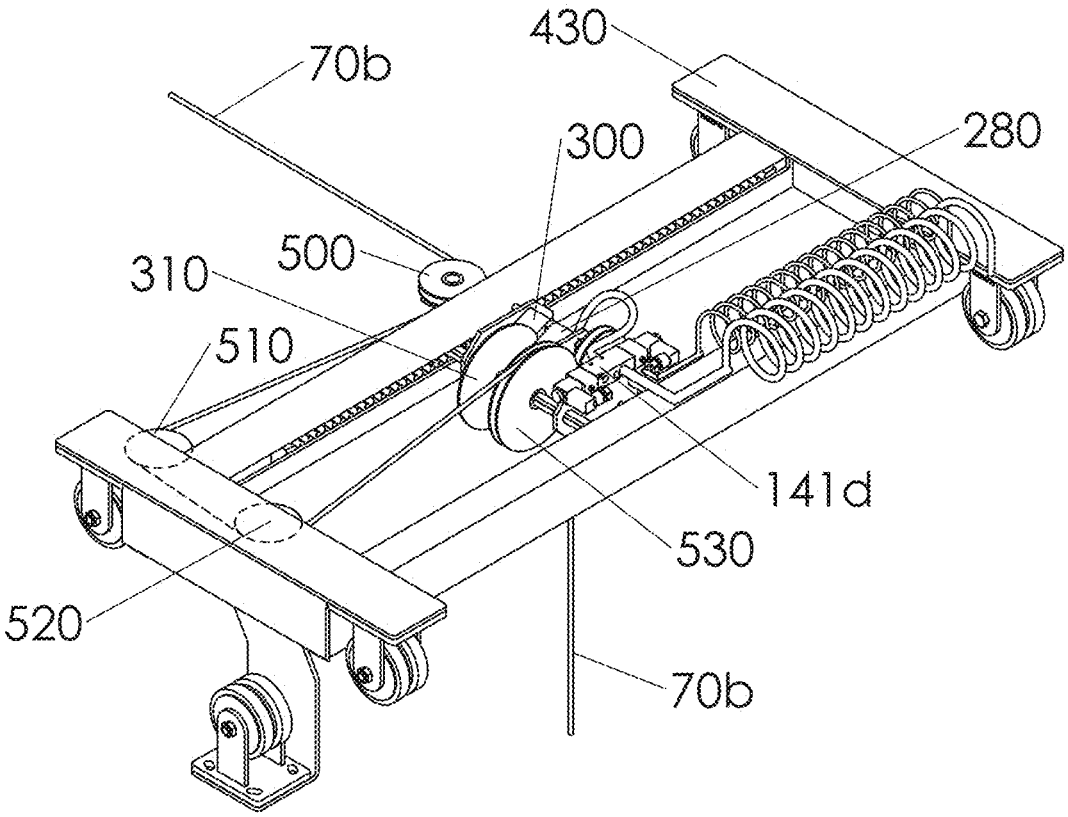
FIG. 23E is an elevated perspective view of a trolley and sled apparatus of FIG. 23A in accordance with an embodiment of the present disclosure.
Figure 23F:
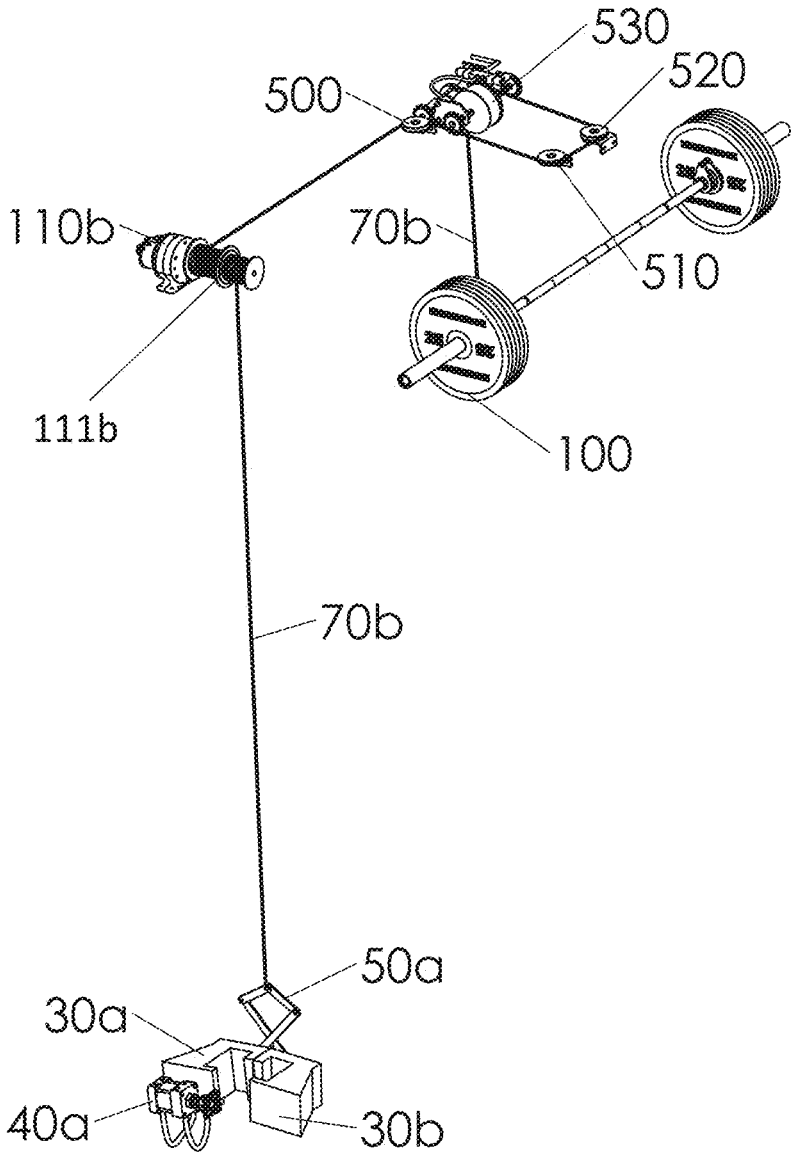
FIG. 23F is a schematic view of cable routing with respect to cable 70*b* of the barbell apparatus of FIG. 23A in accordance with an embodiment of the present disclosure.
Figure 23G:
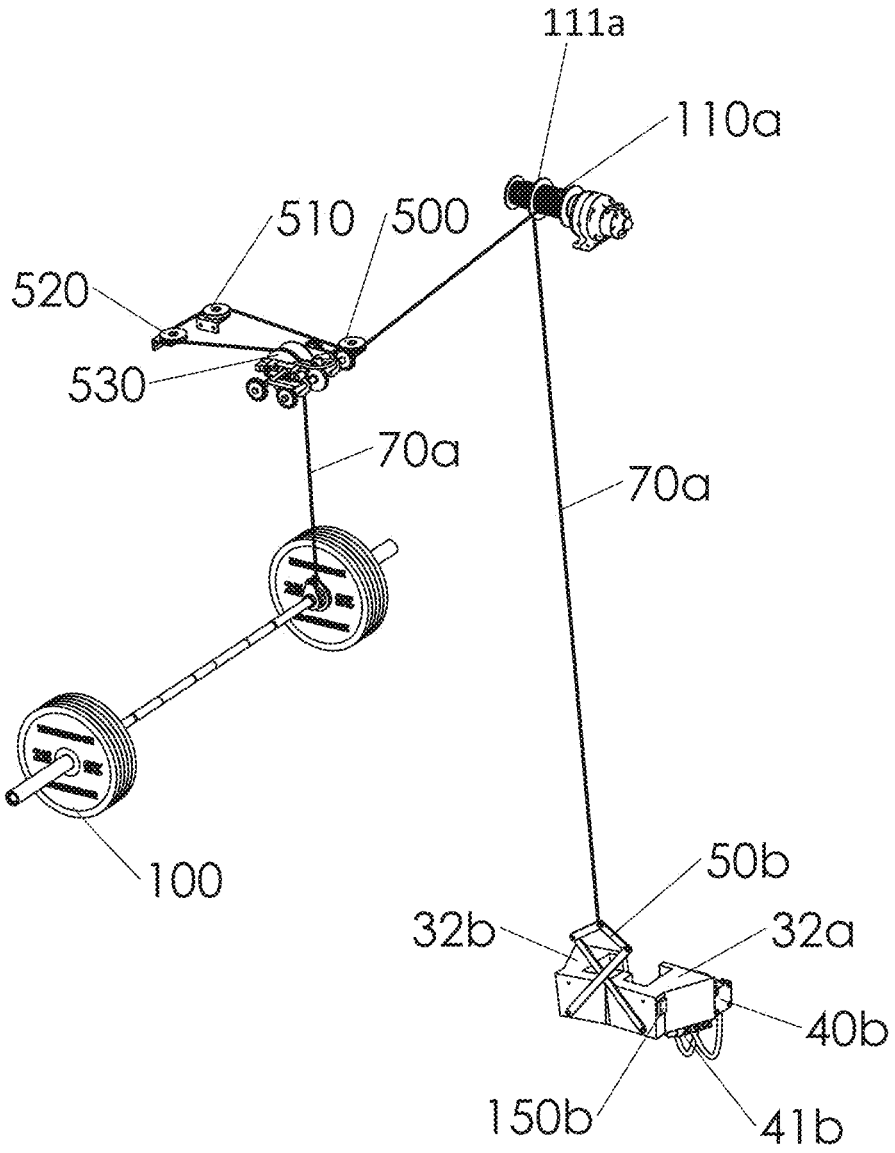
FIG. 23G is a schematic view of cable routing with respect to cable 70*a* of the barbell apparatus of FIG. 23A in accordance with an embodiment of the present disclosure.
Figure 23H:
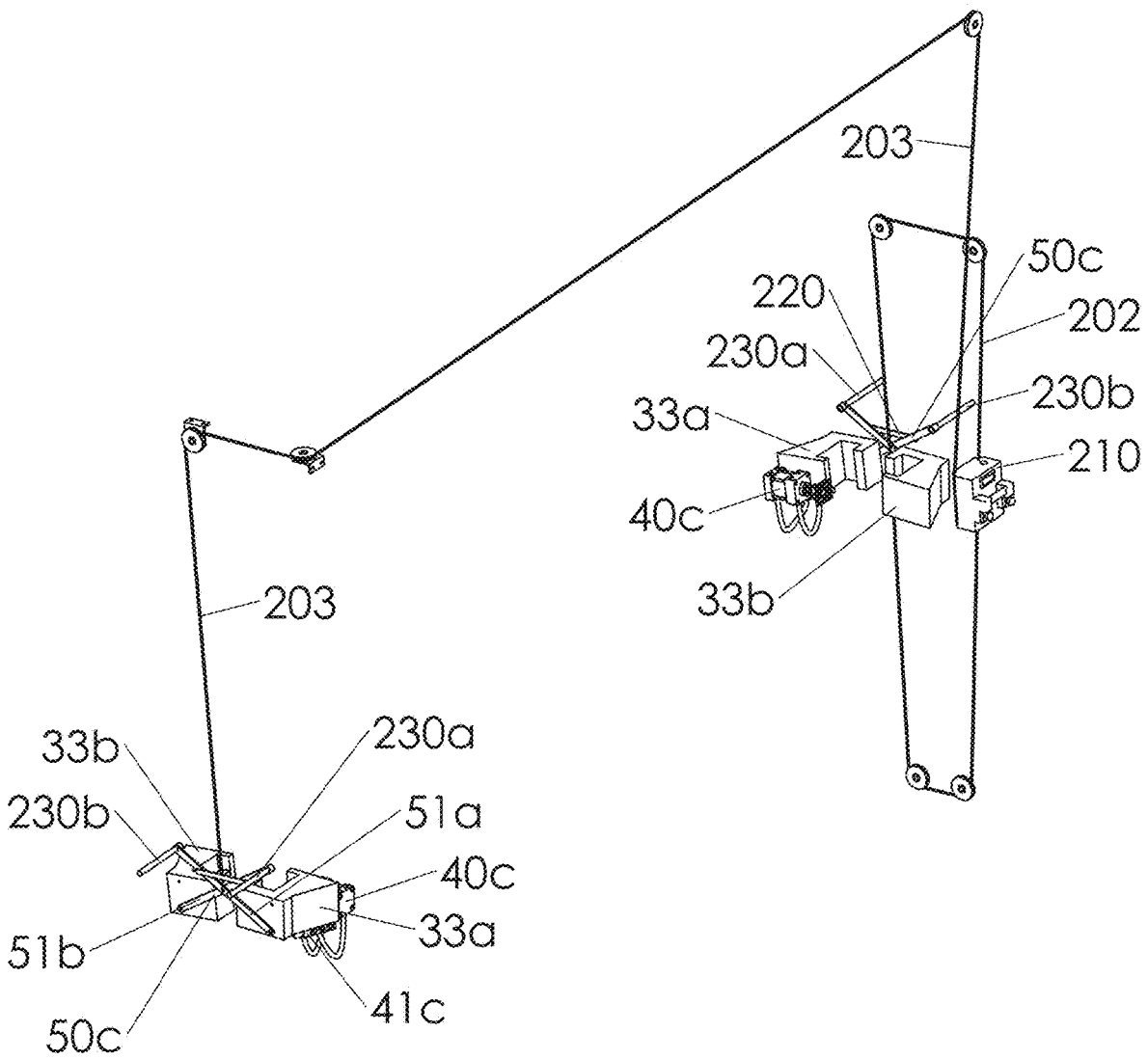
FIG. 23H is a schematic view of cable routing with respect to cables 202 and 203 of the barbell apparatus of FIG. 23A in accordance with an embodiment of the present disclosure.

With reference to FIG. 23E, each of trolleys 430 include a sled assembly identical to that described above with respect to FIG. 22C. As noted each of the trolleys 430 includes pulleys 500, 510, 520 and 530 positioned thereon for routing the cables 70*a*, 70*b* as described. FIG. 23E is shown with respect to cable 70*b*. However, it will be apparent to those skilled in the art the trolleys 430 are identical with the exception that the wheel bracket assembly 440 in the trolley 430 coupled to cable 70*b* is positioned on the same side as the pulley 520, while in the other trolley 430 coupled to cable 70*a* the wheel bracket assembly 440 is positioned on the side of the trolley 430 opposite the pulley 520. In some embodiments one or both of the trolleys 430 may include a bottom wheel bracket assembly 440 at each end of the trolley(s) 430. The trolleys 430 are independently freely movable laterally along the trolley support frame 400, subject to a triggering event as described. Similarly, the sled assemblies 280 of the trolleys 430 are independently movable subject to a triggering event as described. Cable routing for cables 70*b* and 70*a* are shown in FIGS. 23F and 23G, respectively, with the frame and other elements removed for purposes of clarity. As shown, pulleys 530 may act as cable guides with the cables 70*a*, 70*b* being suspended therefrom.

One or more switches 170 may be operably coupled to the cable winders 110*a*, 110*b* and/or the solenoid blocks 141*d* to move the trolleys 430 and/or sleds 280 to desired positions. The apparatus may include emergency stop buttons 160*a* and 160*b*.

Columns 20*c* are each positioned adjacent columns 20*a* and 20*b*. Columns 20*c* are operable to provide a mechanical stop assembly as described above with respect to FIGS. 14-17. Each of columns 20*c* is operably engaged to a pair of brake shoes 33*a*, 33*b* equipped similar to brake shoes described herein with an actuator 40*c* coupled to a solenoid block 41*c*. The brake shoes 33*a*, 33*b* are each coupled to a tensioning device 50*c* as described above. Adjacent one of the columns 20*c*, as shown, the column 20*c* adjacent column 20*b*, a vertical support 200 is provided to which a mechanical stop adjustment device 210 is slidably coupled. Mechanical stop adjustment device 210 is coupled to cables 202, 203 which are each independently routed around a series of pulleys. Cable 202 is coupled to a first of the tensioning devices 50*c* positioned on the same side of the apparatus 2 as column 20*b*, so that movement of the mechanical stop adjustment device 210 is operable to adjust the height of the brake shoes 33*a*, 33*b* on the column 20*c* on that side (the column 20*b* side) of the apparatus. Cable 203 is coupled to a second of the tensioning devices 50*c* positioned on the same side of the apparatus 2 as column 20*a*, so that movement of the mechanical stop adjustment device 210 is operable to adjust the height of the brake shoes 33*a*, 33*b* on the column 20*c* on that side (the column 20*a* side) of the apparatus. The mechanical stop adjustment device 210 may include handle 212 and buttons 214. Buttons 214 are operable to activate actuators 40*c* to release the brake shoes 33*a*, 33*b* on each of the columns 20*c* so they can move freely along the columns 20*c* so the stop pins 230*a*, 230*b* can be placed in a desired position. Once the button is released, the brake shoes 33*a*, 33*b* engage the columns 20*c*. The buttons 214 may be hard-wired to the solenoids 41*c* or operate by wireless connection. The stop pins 230*a*, 230*b* so that they will stop movement of brake shoes 30*a*, 30*b* and 32*a*, 32*b* coupled to columns 20*a* and 20*b*, respectively. Upward force applied to the stop pins 230*a*, 230*b* by contact of the brake shoes 30*a*, 30*b* and 32*a*, 32*b* drives the brake shoes 33*a*, 33*b*, already in a locked position by virtue of the actuator 40*c* not being actuated, into even tighter contact with the respective columns 20*c*. In the extremely unlikely event that a solenoid becomes stuck in the open, unbraked position, the mechanical stop will arrest downward movement of the barbell 100 beyond the set point selected by the user. Moreover, the apparatus allows the user to use the mechanical stop adjustment device to set the stop pins 230*a*, 230*b* at any point along the path of travel.

Though not shown, the embodiments in FIGS. 23A-23I, as discussed below in connection with FIGS. 24A-24K, may not include any columns 20*c*, mechanical stop adjustment device 210, cables 202, 203, brake shoes 33*a*, 33*b*, actuator 40*c* or solenoid 41*c*, or tensioning devices 230*a*, 230*b*. In still further embodiments, the barbell spotting apparatus 2 includes a mechanical stop apparatus as described in connection with FIGS. 13A-13D.

Figure 23I:
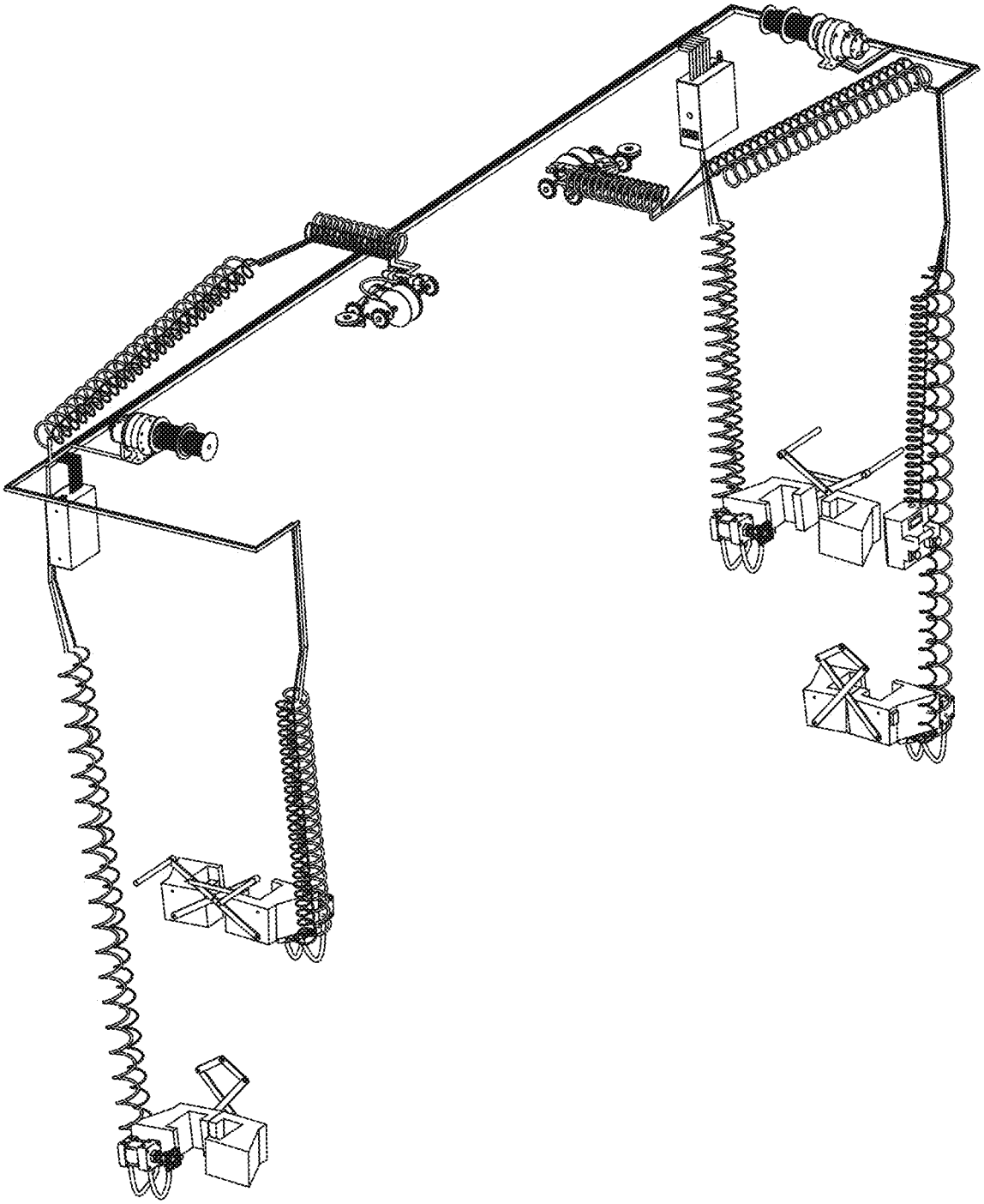
FIG. 23I is a schematic view of pneumatic and electrical routing of the barbell apparatus of FIG. 23A in accordance with an embodiment of the present disclosure.

FIG. 23I shows exemplary electrical and pneumatic routing with the frame and other elements removed for the sake of clarity. It will be apparent to those skilled in the art that any suitable electrical and pneumatic routing may be employed. In addition, the wiring paths selected for sensors and switches disclosed herein is a matter of design choice. In some embodiments the sensors and switches may be wirelessly coupled to the control box 80*b*. In some embodiments, the actuators may be electrically powered rather than pneumatically powered.

With reference to FIGS. 24A-24K, the frame 10 is provided with no columns 20*c*. Here, the cable winders 110*a*, 110*b* are configured to provide braking in place of the brake shoes 33*a*, 33*b*.

Figure 24A:
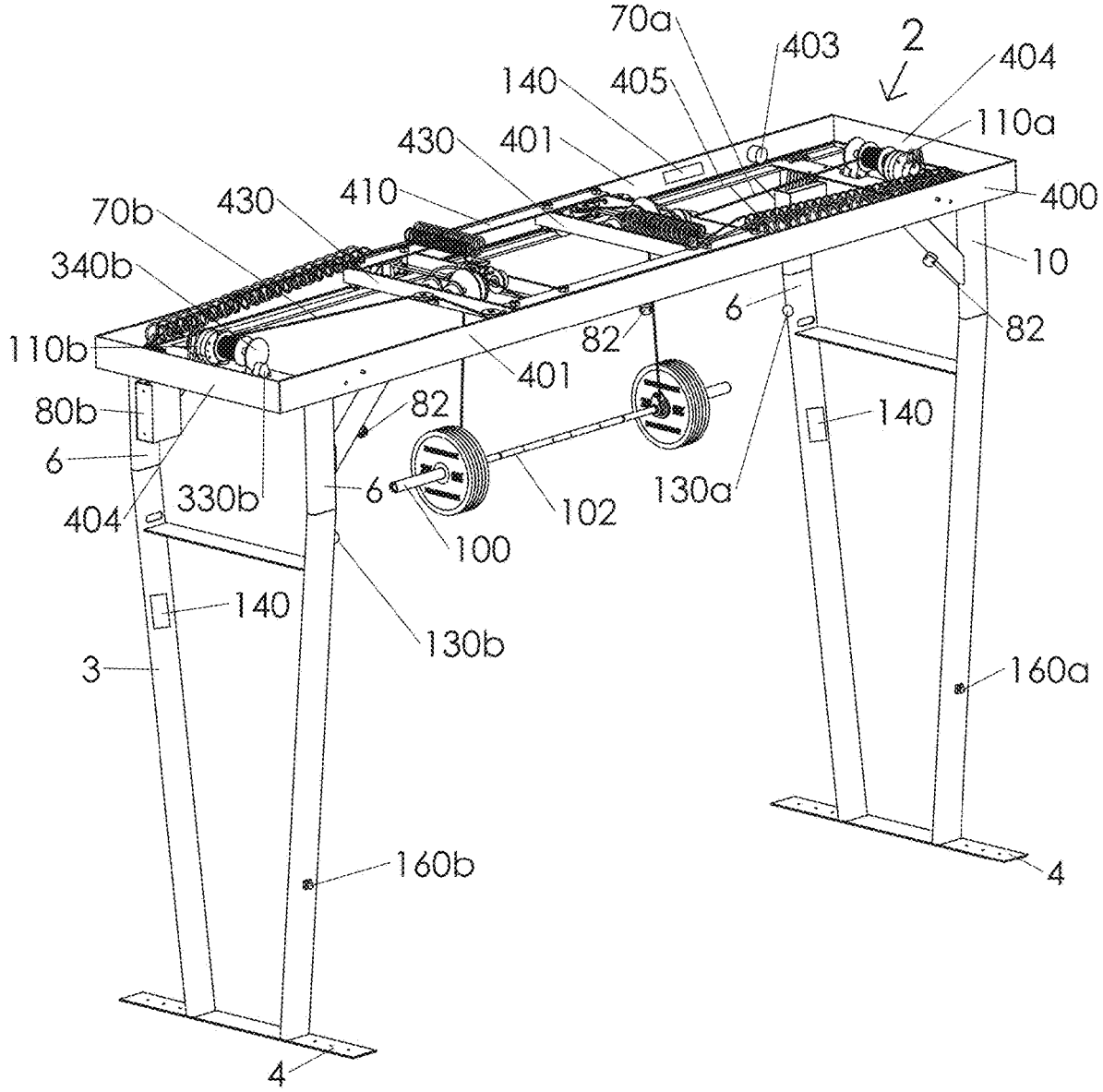
FIG. 24A is a perspective view of a barbell spotting apparatus in accordance with an embodiment of the present disclosure.
Figure 24B:
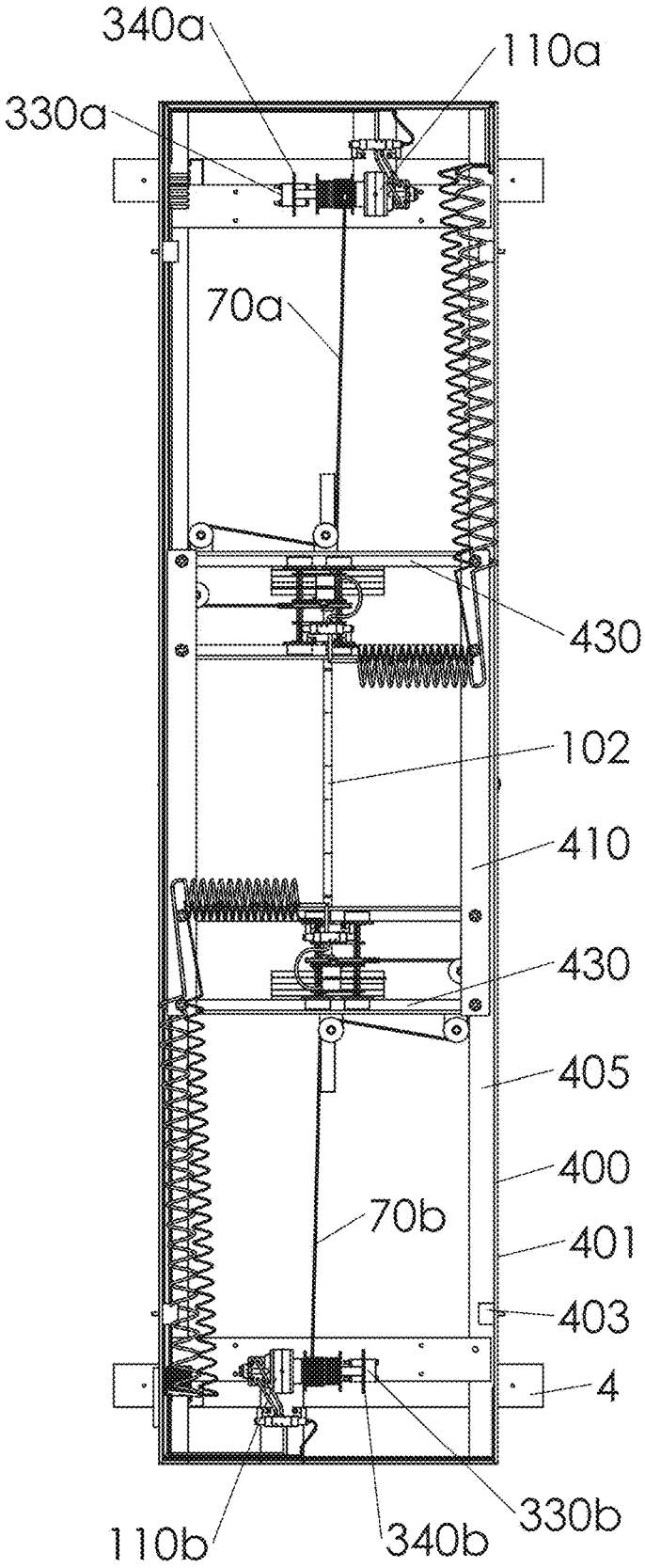
FIG. 24B is a top view of a barbell spotting apparatus of FIG. 24A in accordance with an embodiment of the present disclosure.
Figure 24C:
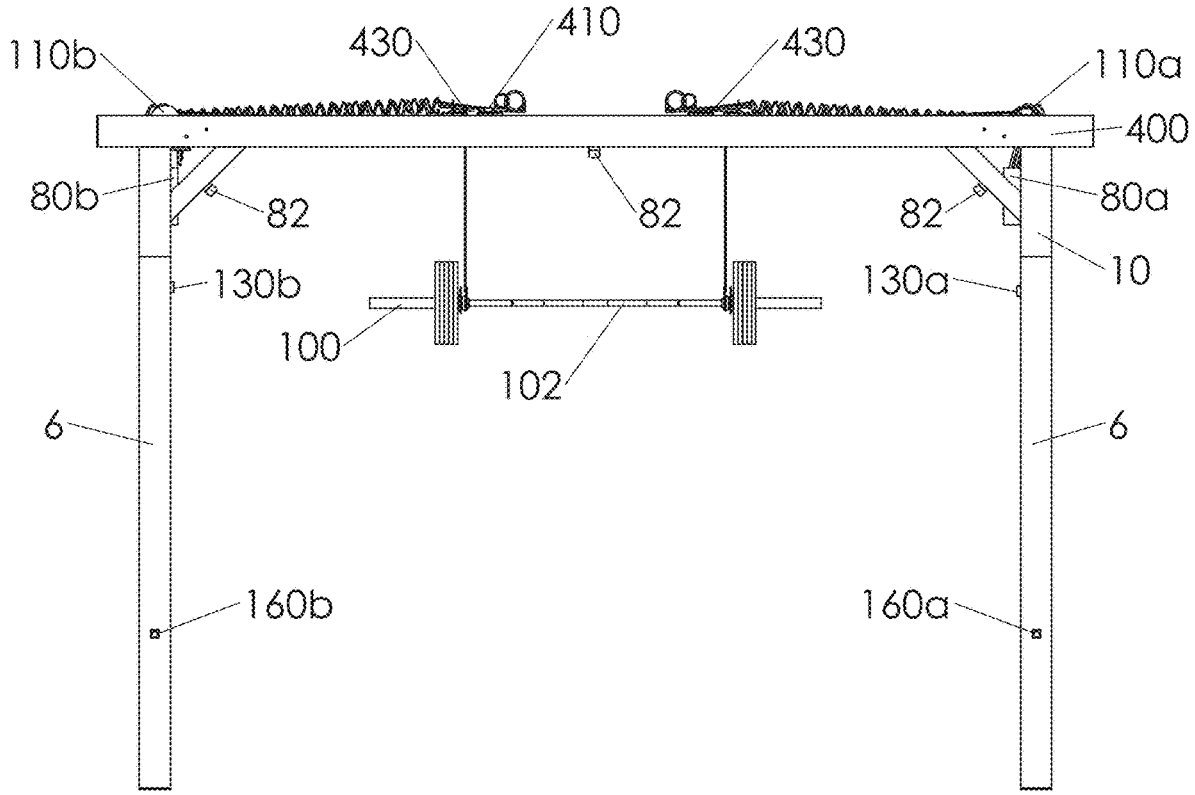
FIG. 24C is a front view of a barbell spotting apparatus of FIG. 24A in accordance with an embodiment of the present disclosure.
Figure 24D:
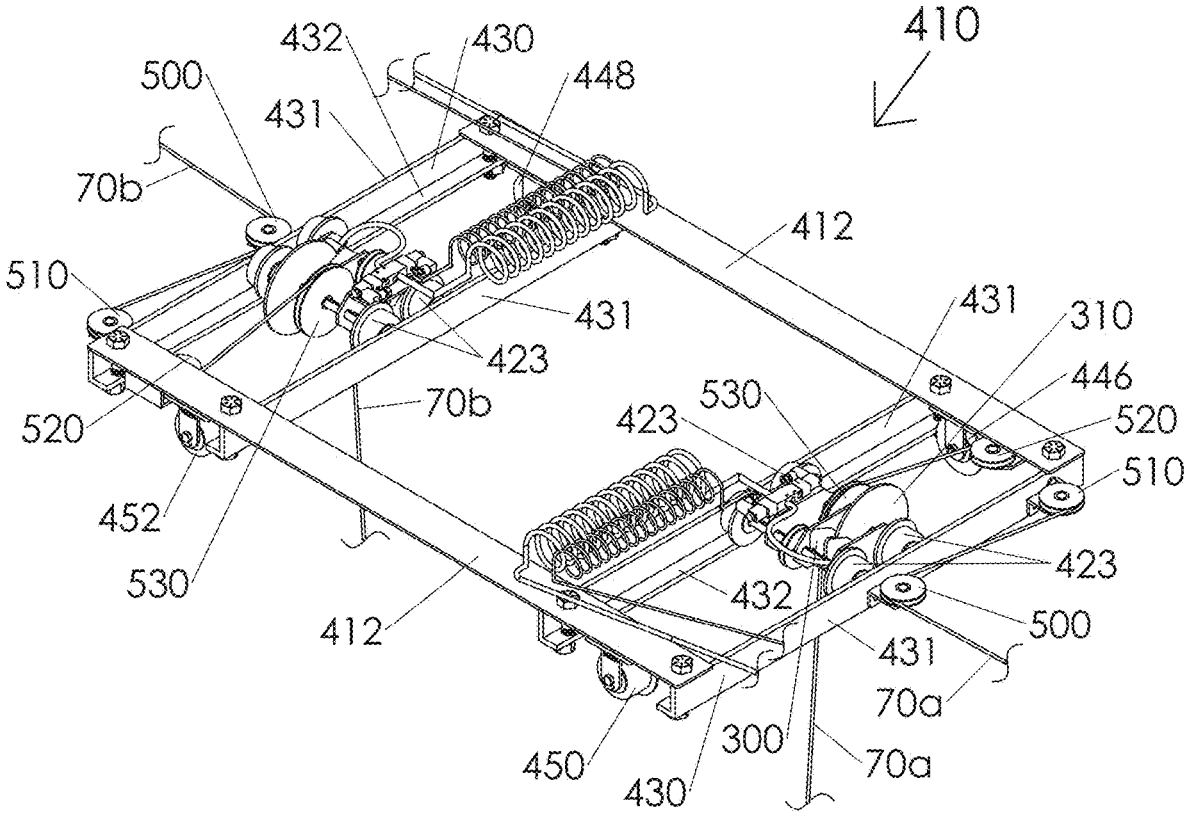
FIG. 24D is a perspective view of a trolley and sled apparatus of FIG. 24A in accordance with an embodiment of the present disclosure.
Figure 24E:
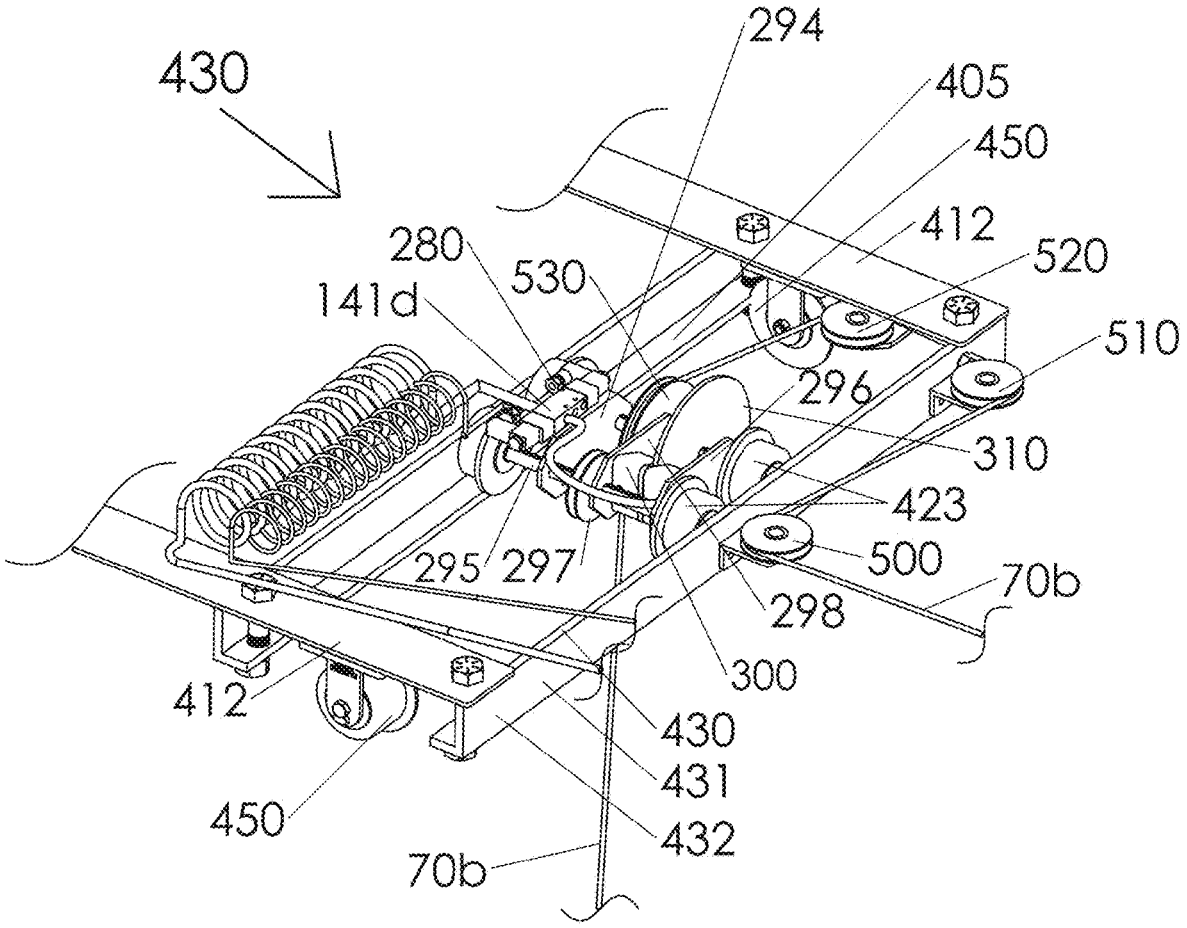
FIG. 24E is an enlarged perspective view of a trolley and sled apparatus of FIG. 24D in accordance with an embodiment of the present disclosure.
Figure 24F:
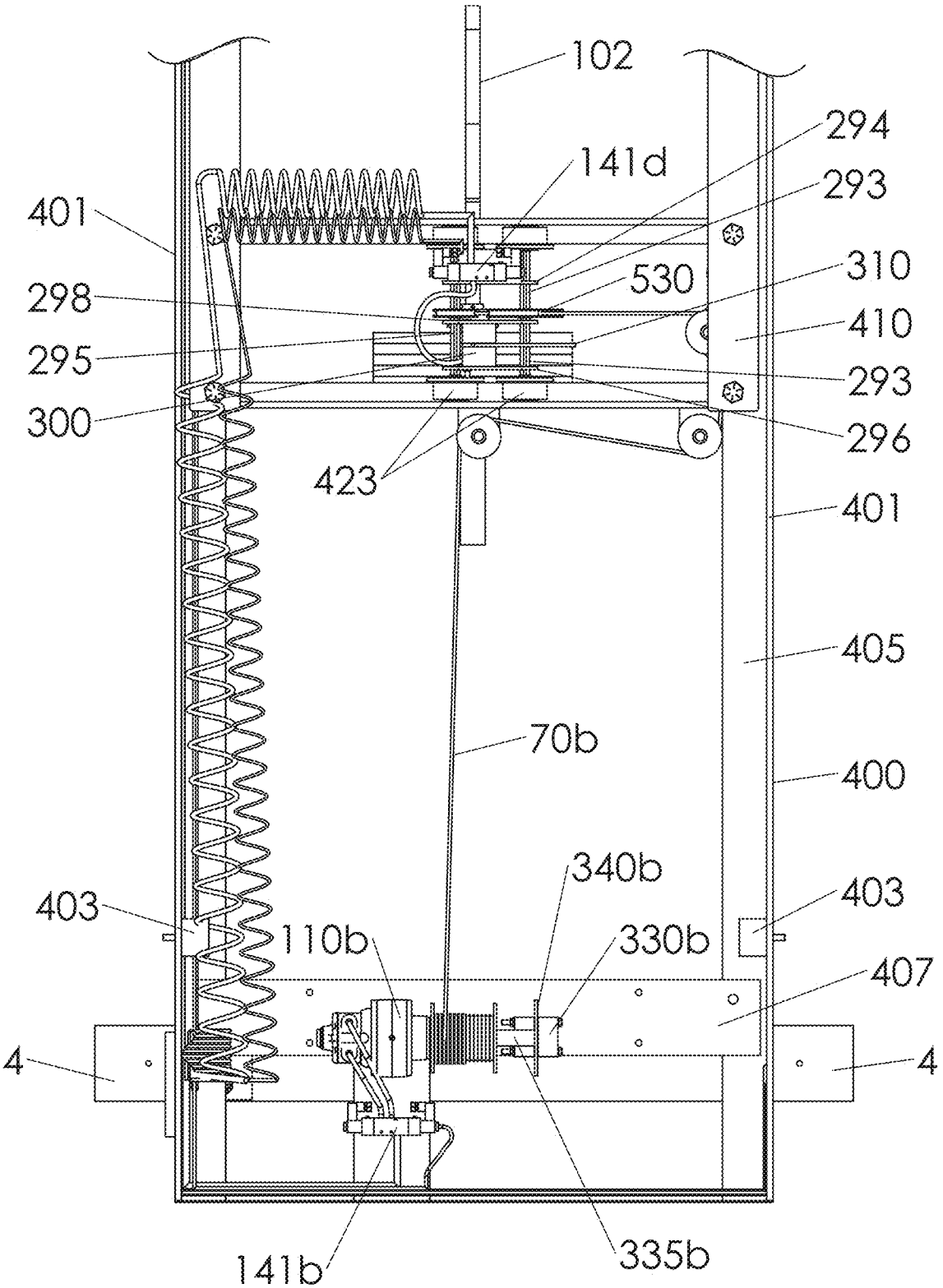
FIGS. 24F and 24G are partial top views of a barbell spotting apparatus of FIG. 24A in accordance with an embodiment of the present disclosure.
Figure 24G:
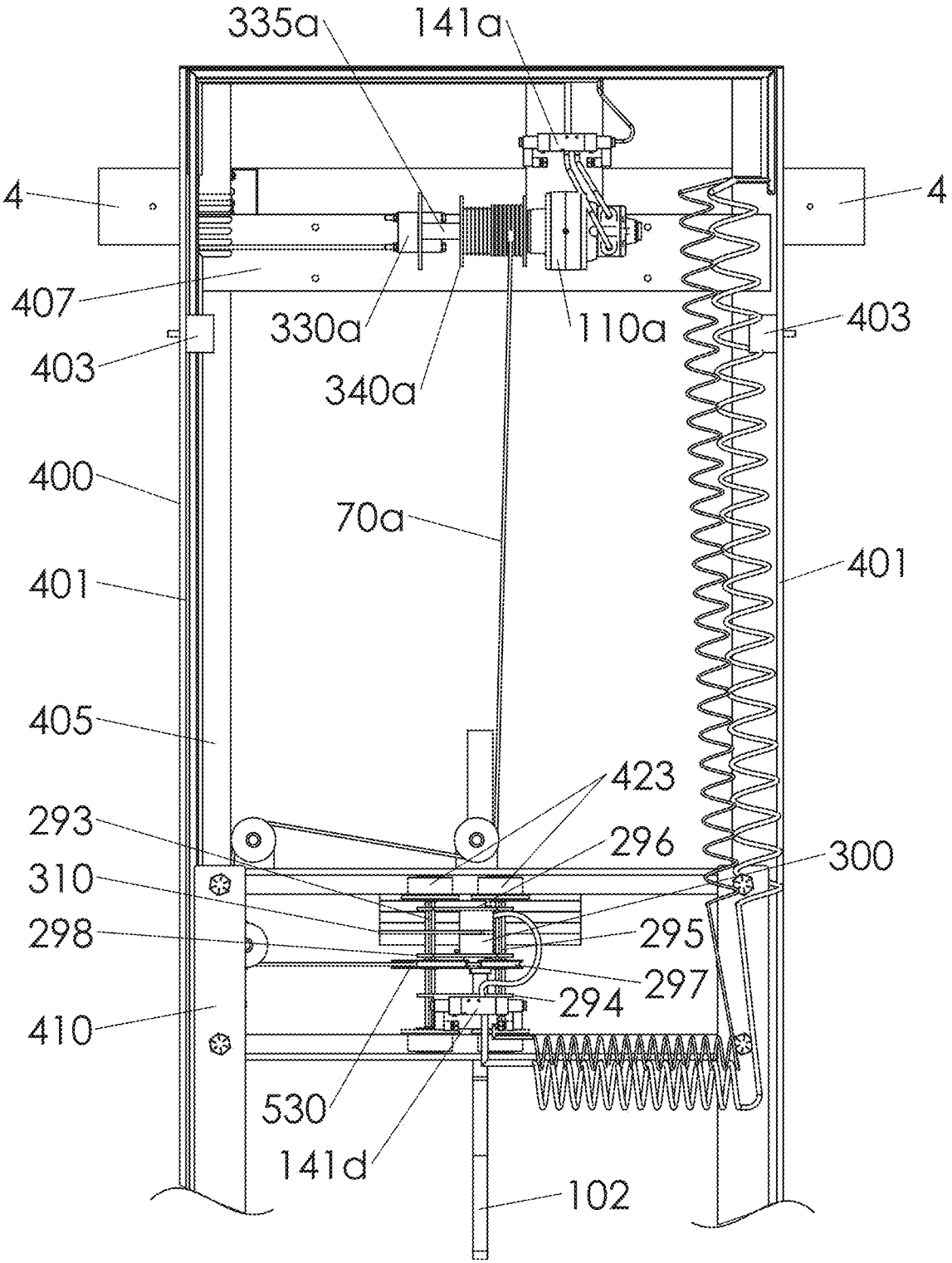
Figure 24H:
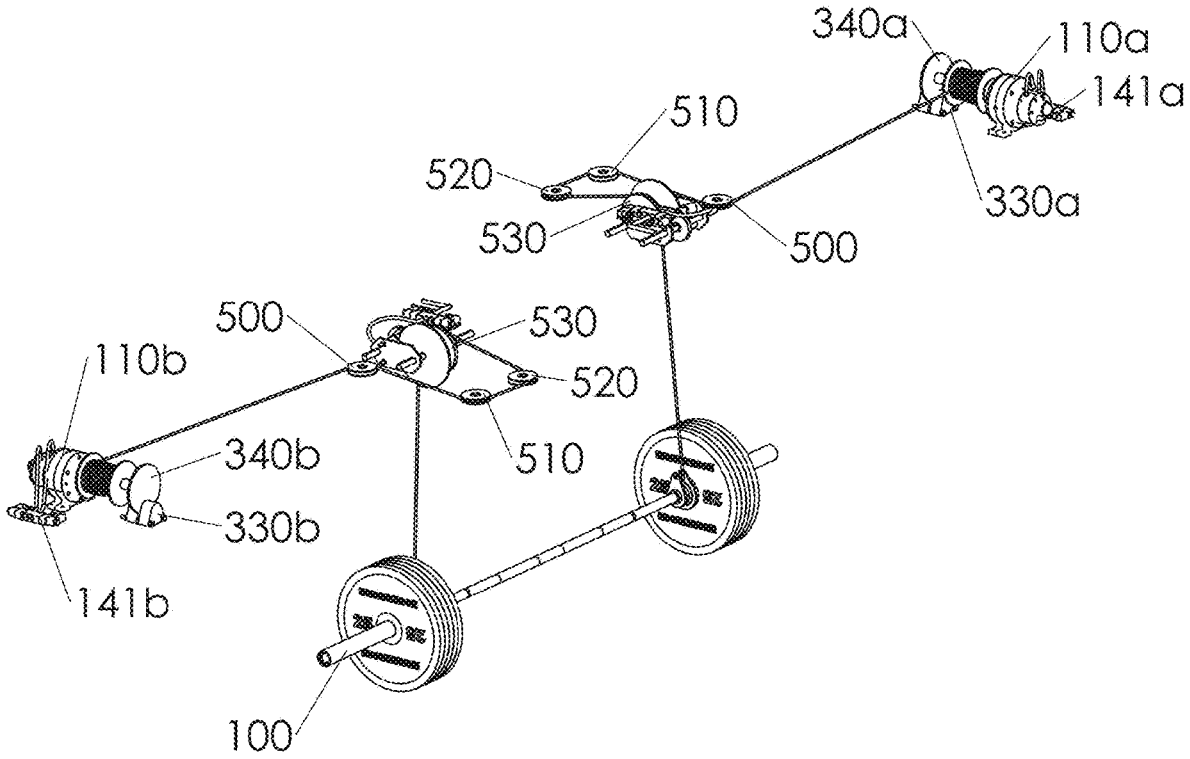
FIG. 24H is a schematic view of cable routing with respect to a barbell apparatus of FIG. 24A in accordance with an embodiment of the present disclosure.
Figure 24I:
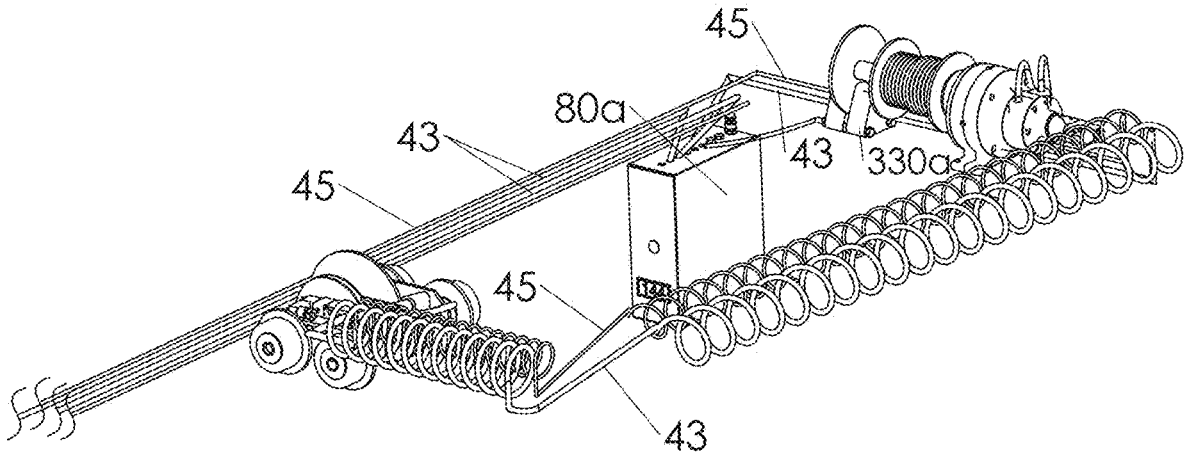
FIGS. 24I-K are schematic views of pneumatic and electrical routing of a barbell apparatus of FIG. 24A in accordance with an embodiment of the present disclosure.
Figure 24J:
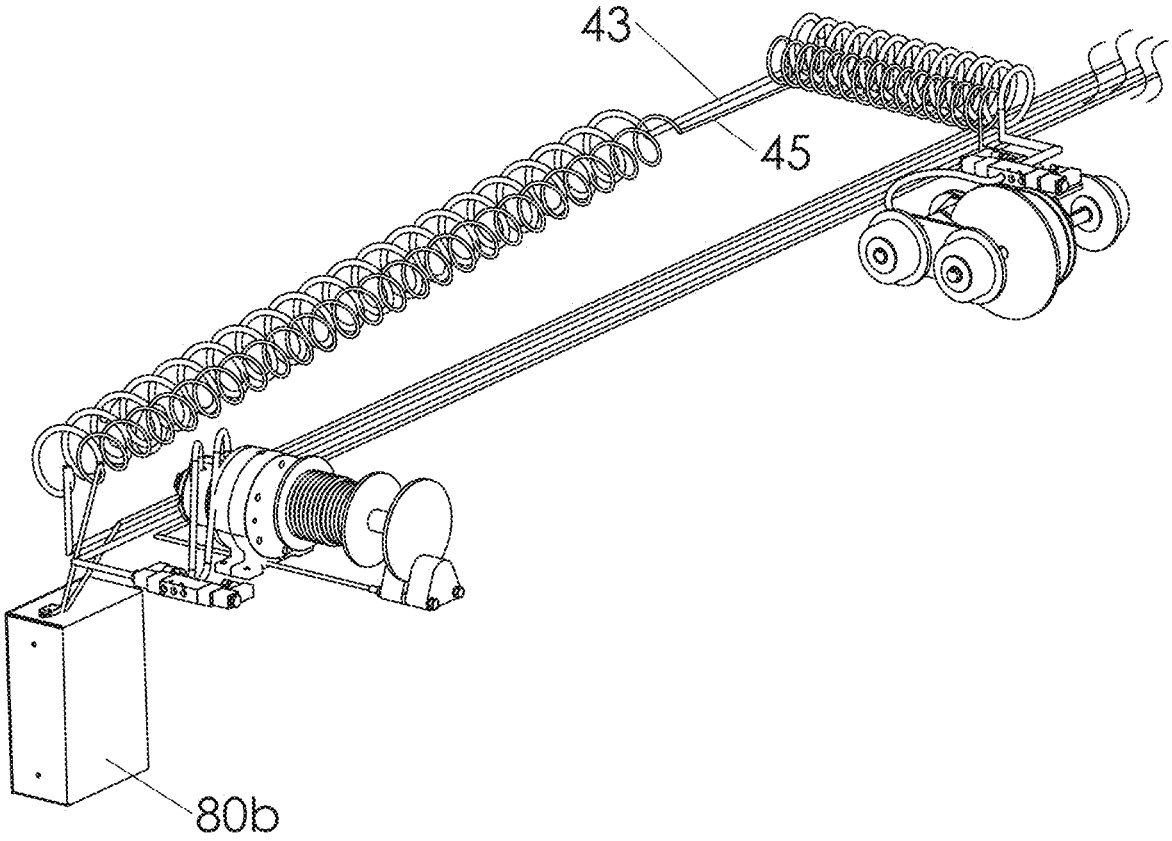
Figure 24K:
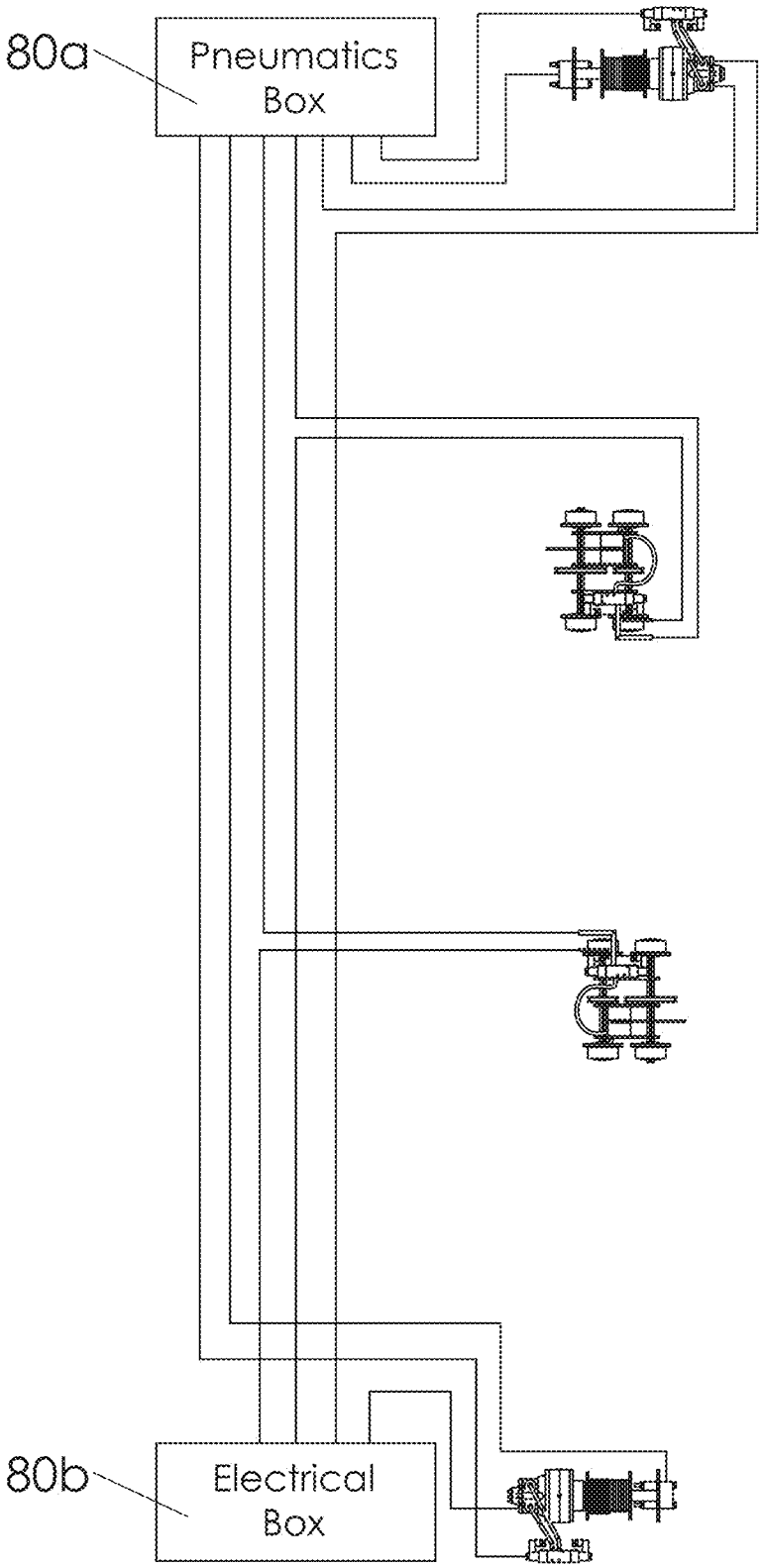

As shown in FIGS. 24F-24G, the cable winders 110*a*, 110*b* are mounted to cross beams 407 which span across the interior of the trolley support frame 400. Braking axles 335*a*, 335*b* extend from the cable winders 110*a*, 110*b* to which brake discs 340*a*, 340*b* are coupled so as to rotate with the cable winders 110*a*, 110*b*. The braking axles 335*a*, 335*b* each extends along an axis of rotation of the respective cable winder 110*a*, 110*b*. Brakes 330*a*, 330*b* are mounted to the cross beams 407, adjacent to the cable winders 110*a*, 110*b*, to engage the brake discs 340*a*, 340*b* in controllably inhibiting rotation thereof. As best shown in FIG. 24I, the brakes 330*a*, 330*b* each includes a housing with a central open slot into which the brake discs 340*a*, 340*b* may extend and rotate through. The brakes 330*a*, 330*b* may be configured as caliper brakes with pneumatically powered brake shoes (not shown) configured, when activated, to apply pressure to the brake discs 340*a*, 340*b* in causing rotational movement thereof to cease. As an alternative, the brake discs 340*a*, 340*b* may be formed from a ferrous material (or other magnetic material) with the brakes 330*a*, 330*b* being configurable as energizable electromagnets which generate a magnetic braking force upon actuation to cause rotational movement of the brake discs 340*a*, 340*b* to cease.

One or both of the brakes 330*a*, 330*b* may be caused to be activated with at least one of the qualifying conditions calling for braking, as discussed above, is met. The same sensors may be used. In this embodiment, the cable winders 110*a*, 110*b* provide the braking, thus, obviating the need for the brakes 33*a*, 33*b* or columns 20*a*, 20*b*, or 20*c*. The cable winders 110*a*, 110*b*, during normal operation, are configured to take up and pay out the cables 70*a*, 70*b*. During normal use, the cable winders 110*a*, 110*b* will coast, not providing any advantage to a lifter. Upon a qualifying condition being met, one or both of the brakes 330*a*, 330*b* is activated to cause the respective brake disc 340*a*, 340*b* to stop rotating in limiting the cables 70*a*, 70*b* from being further paid out from the cable winders 110*a*, 110*b*, thus, limiting descent of the barbell. As will be appreciated by those skilled in the art, the cable winders 110*a*, 110*b* operate independently of each other. Likewise, the brakes 330*a*, 330*b* may operate independently of each other. This allows for independent braking of each side of the barbell. This may be particularly beneficial where one end of the barbell 100 is in rapid descent, e.g., due to a weightlifter slipping. A false reading may be had on the non-slipped end of the barbell 100, thus, not indicating the need for spotting.

The brakes 330*a*, 330*b*, as discussed above, may be pneumatically powered. As shown in FIG. 24I, one or more air lines 43 may be coupled to the brakes 330*a*, 330*b* to provide compressed air for activation. Compressed air may be provided by the pneumatic control box 80*a*, which may be configured to receive an activation signal in response to a qualifying condition. The pneumatic control box 80*a* may include a compressor to pressurize air on demand. A pneumatic control box 80*a* may be provided adjacent each of the cable winders 110*a*, 110*b*, which allows for independent braking. In addition, close proximity of the pneumatic control box 80*a* to the corresponding cable winder 110*a*, 110*b* provides for a short flow path from the pneumatic control box 80*a* to the corresponding brake 330*a*, 330*b*, thus providing relatively short response time.

In addition, one or more electrical lines 45, from the electrical control box 80*b*, may be coupled to the brakes

330*a*, 330*b* to provide electrical power, as needed, e.g., if the brakes 330*a*, 330*b* are configured as electromagnets.

The trolleys 430 of the embodiment of FIGS. 23A-23I may be connected together to form a single trolley assembly 410. In particular, as shown in FIG. 24D connecting strips 412 may be rigidly affixed to both of the trolleys 430, e.g., by screws, rivets, welding, and so forth. The connecting strips 412 are sufficiently rigid to maintain a fixed spacing between the trolleys 430. In addition, the trolley support frame 400 may be provided with side walls 401 having inwardly extending base flanges 405 for supporting the trolleys 430. The wheels 446, 448, 450, 452 are formed, in this embodiment, for rolling engagement with the base flanges 405, thus, enabling rolling movement of the trolley assembly 410 within, and along, the side walls 401. This allows for side-to-side movement of the trolley assembly 410 in response to a weightlifter's movements. The stops 403 may be located interiorly of the side walls 401 to limit the extent of movement of the trolley assembly 410.

The trolleys 430 are configured in similar fashion as in the embodiment of FIGS. 23A-23I to re-direct the cables 70*a*, 70*b* utilizing the pulleys 500, 510, 520, 530. In addition, the trolleys 430 are each provided with a sled assembly 280 which may be formed in the same manner as the embodiment of FIGS. 23A-23I. Alternatively, as shown in FIGS. 24D-24E, the frames 431 may be provided with bottom flanges 432, with each of the sled assemblies 280 including casters 423 for rolling engagement with the bottom flanges 432. This rolling movement allows for the sled assemblies 280 to move bidirectionally transverse to the bidirectional movement of the trolley assembly 410. Movement of the casters 423 may be inhibited by the brake calipers 300 under force provided by the solenoid block valve 141*d*, in the same manner as described above.

Figure 26F:
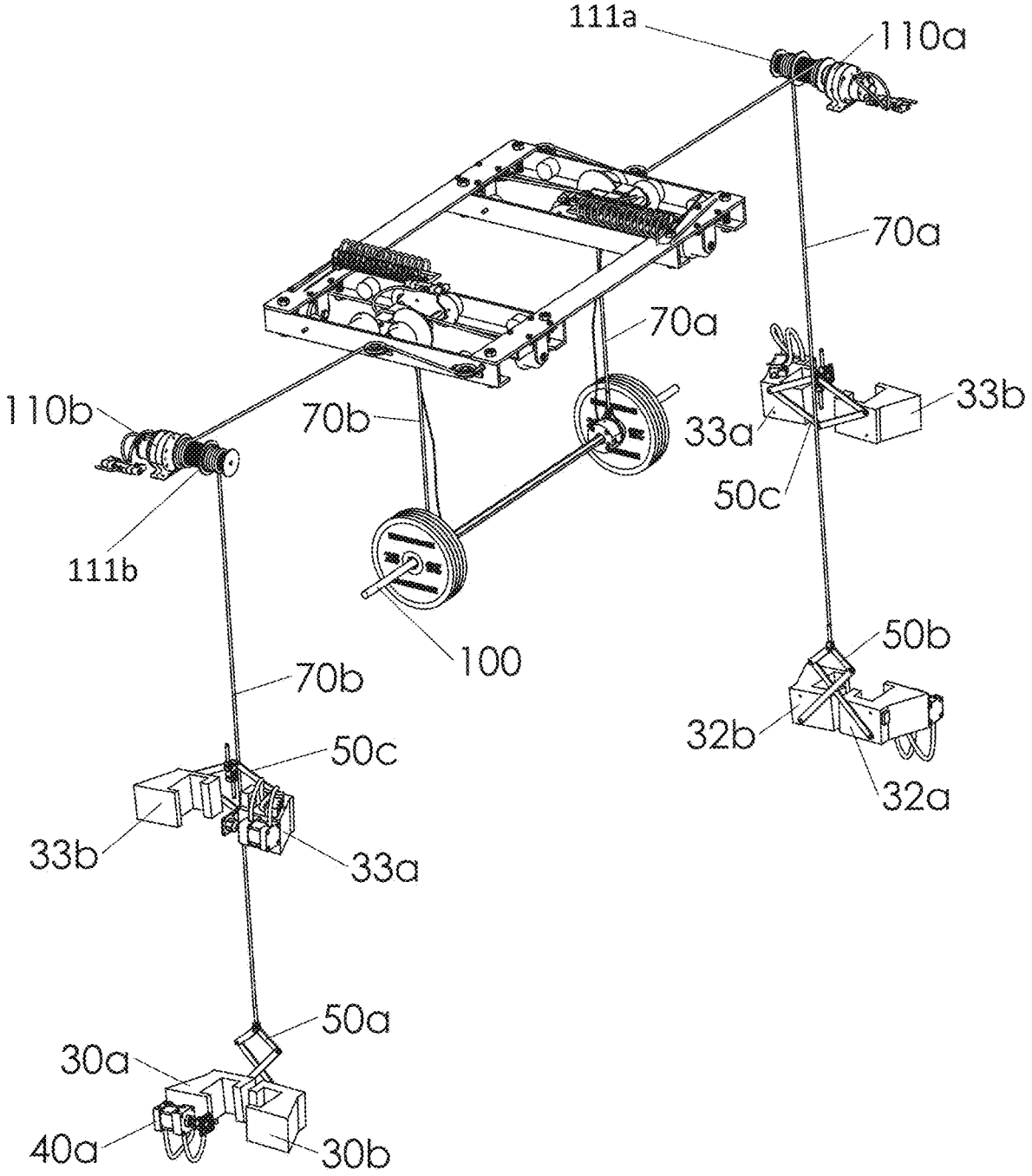
FIG. 26F is a schematic view of cable routing with the barbell apparatus of FIG. 26A in accordance with an embodiment of the present disclosure.
Figure 26G:
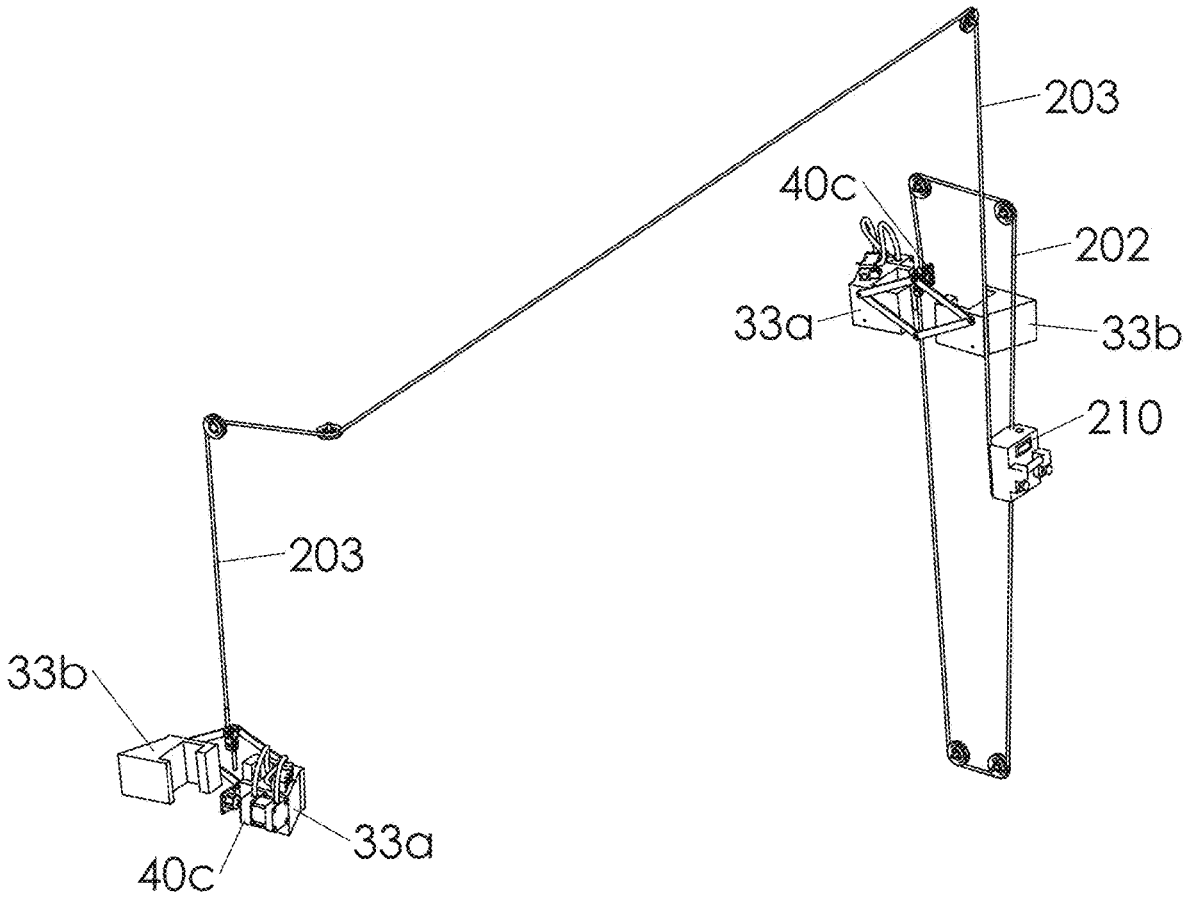
FIG. 26G is a schematic view of cable routing with respect to cables 202 and 203 of the barbell apparatus of FIG. 26A in accordance with an embodiment of the present disclosure.
Figure 26H:
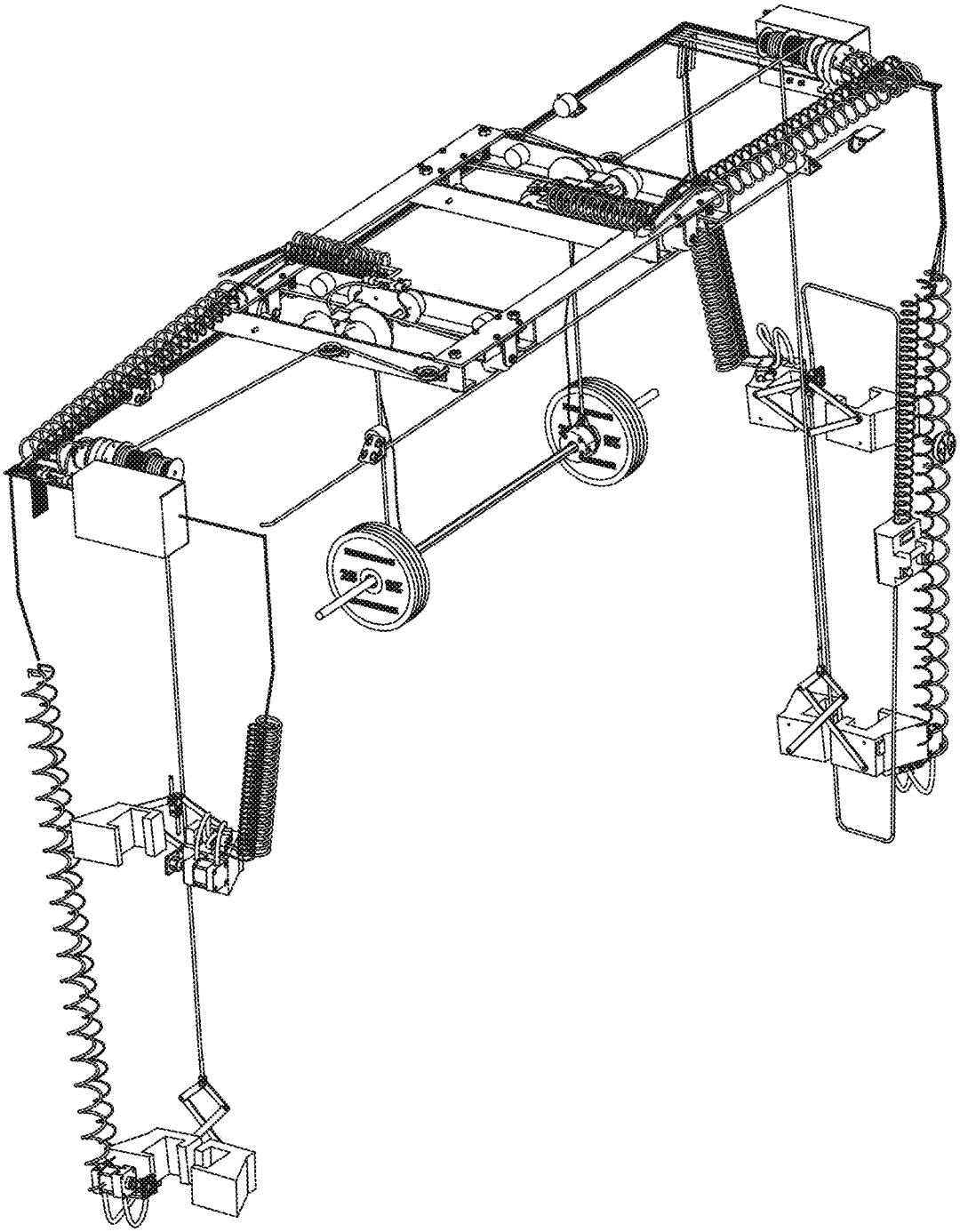
FIG. 26H is a schematic view of pneumatic and electrical routing of the barbell apparatus of FIG. 26A in accordance with an embodiment of the present disclosure.

FIGS. 26A-26H shows a further embodiment of the barbell spotting apparatus 2. Here, the trolley assembly 410, as described with the embodiment of FIGS. 24A-24K, is utilized in combination with the embodiment of FIGS. 23A-23I. Moreover, the embodiment of FIGS. 26A-26H utilizes only a single column 20*c*. As shown in FIG. 26F, the brake shoes 30*a*, 30*b* may be vertically aligned with the brake shoes 33*a*, 33*b* along one of the columns 20*c*, with the brake shoes 32*a*, 32*b* being vertically aligned with the brake shoes 33*a*, 33*b* along the other of the columns 20*c*.

In each of the embodiments, provision is therefore made for movement of a barbell in virtually any plane of movement without any torque or twisting of the barbell due to tension on any cable during a controlled lift. When the brakes of the apparatus are not engaged, the weight is freely movable up, down, forward, backward (toward and away from the lifter), side to side relative to the lifter, and rotationally around the axis of the lifter. Such freedom of movement is not possible in any prior art barbell spotting apparatus. Cable guides, from which cables are suspended for connecting to the barbell, are provided which may be movable in multiple axes relative to the supporting frame. For example, cable guides may be supported on a pivoting fork, moving trolley, and moving sled, allowing for movement is response to a weightlifter's movements.

Figure 27A:
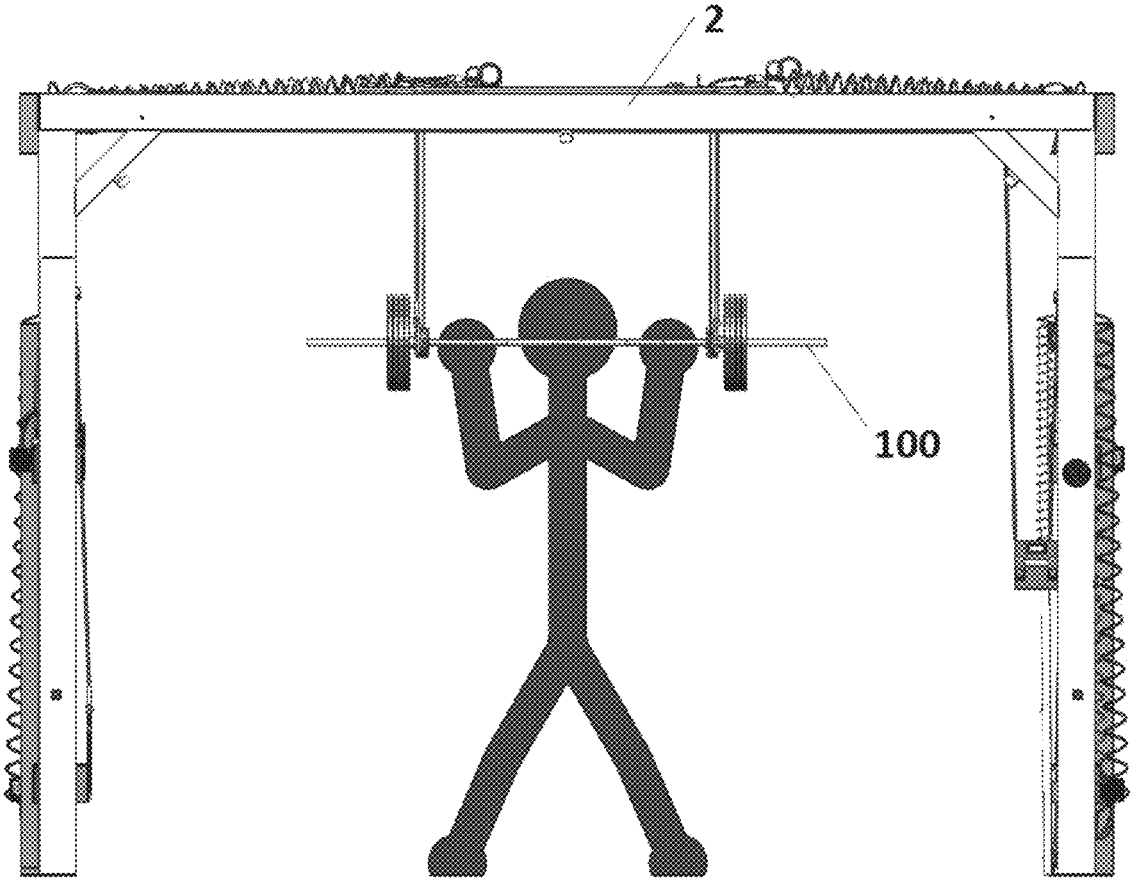
FIGS. 27A-27F and FIGS. 28A-28C show a barbell spotting apparatus in use in accordance with embodiments of the present disclosure.

With reference to FIGS. 27A-27F and FIGS. 28A-28C, the barbell spotting apparatus 2 is shown with a weightlifter exercising using the barbell 100. As shown in FIG. 27A, the barbell 100 may be suspended at various heights as a start position with braking engaged, thereby resisting downward movement of the barbell 100. The start height may be adjusted by the weightlifter, e.g., by voice command, to a point of useful movement as a starting position. The athlete does not need to transport the loaded barbell from a rack to the starting position. With engagement of the barbell 100 by the weightlifter, the indicator lights 82*a*, 82*b* may turn red to confirm that the barbell 100 is still suspended and cannot move downwardly.

Figure 27B:
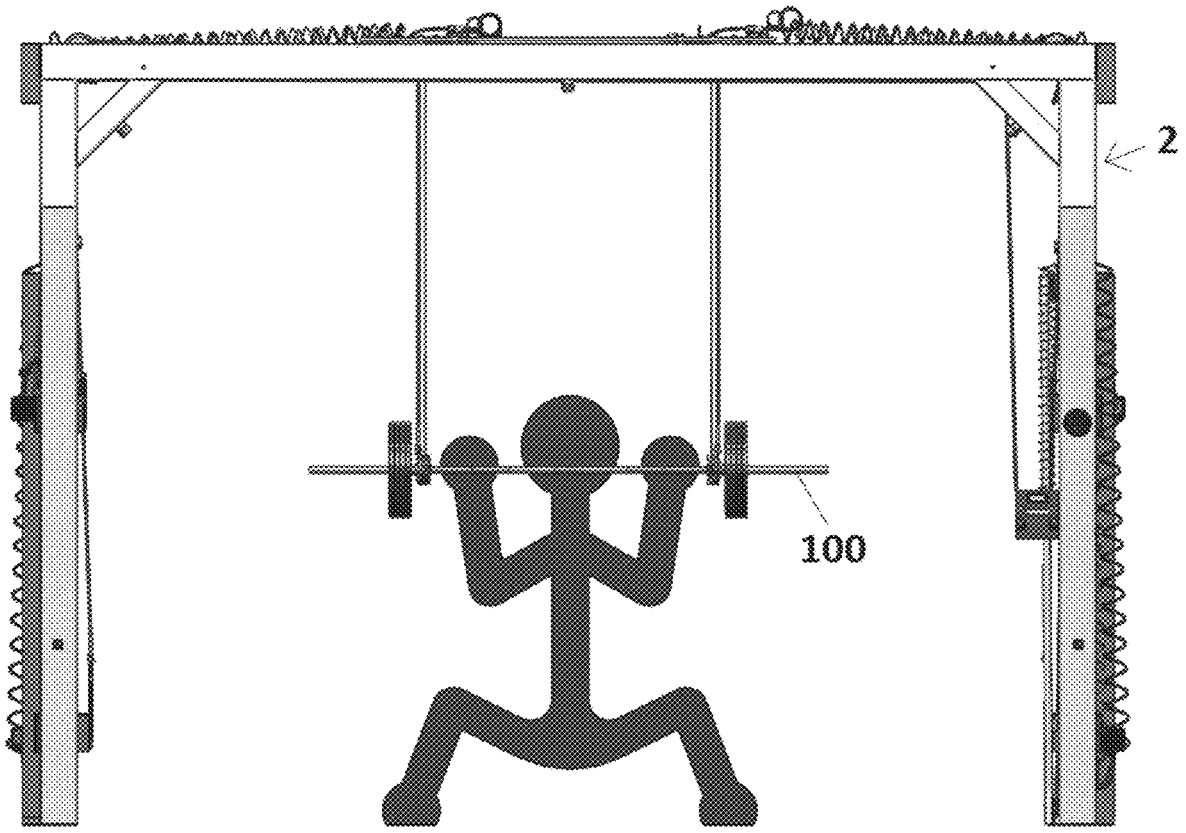

With the barbell 100 engaged by the weightlifter, the weightlifter may push the barbell up, thereby initiating the exercise. With initial upward movement of the barbell 100, the indicator lights 82*a*, 82*b* may turn yellow with braking being maintained. As the upward movement of the barbell 100 exceeds a predetermined range, e.g., three inches, the indicator lights 82*a*, 82*b* may turn green and braking may be disengaged to allow the barbell 100 to freely move in multiple degrees of freedom, including downwardly, as shown in FIG. 27B.

Figure 27C:
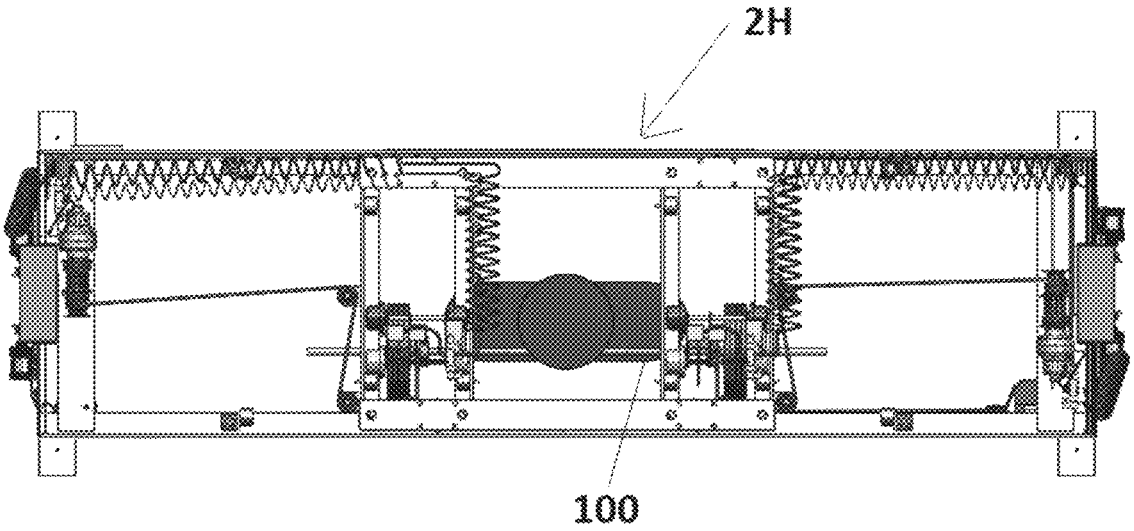
Figure 27D:
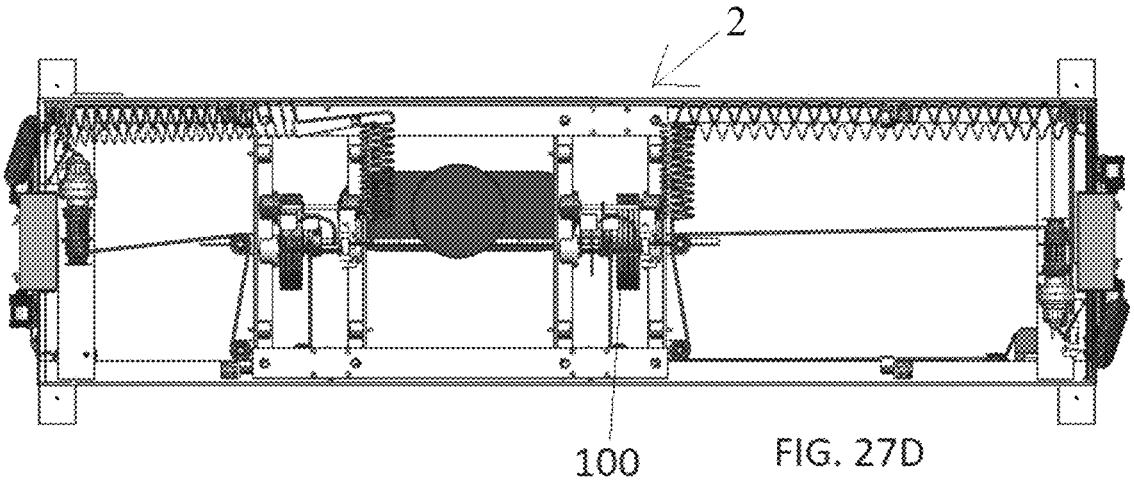
Figure 27E:
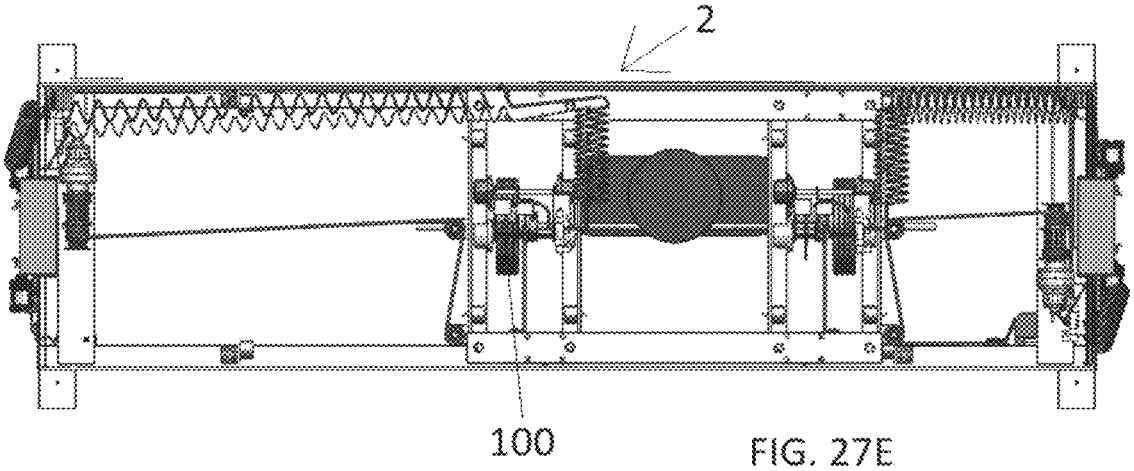
Figure 27F:
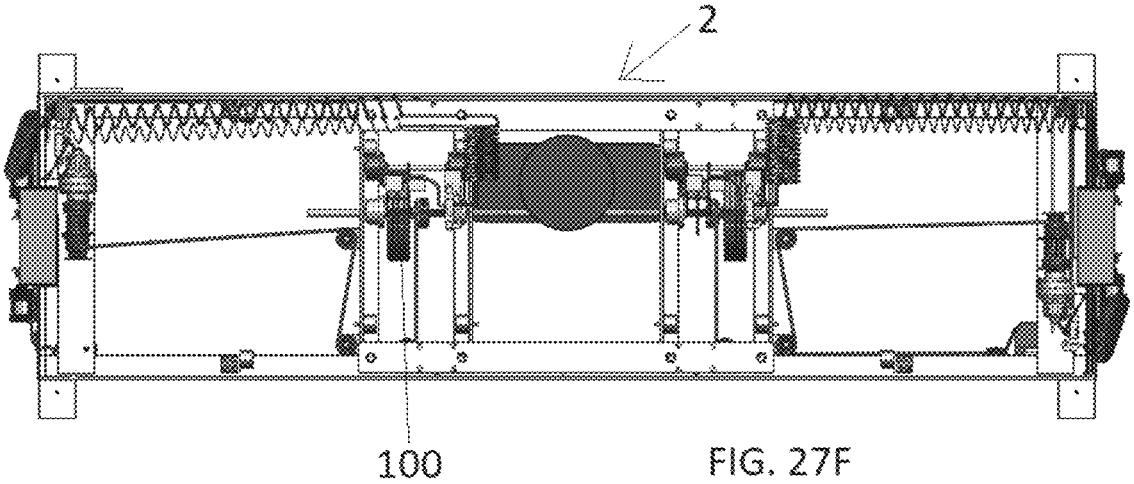

As shown in FIGS. 27C-27F, the barbell spotting apparatus 2 may be configured to respond to movement of the weightlifter. In particular, cable guides may adjust in response to movement of the weightlifter so as to be directly overhead. As shown in FIG. 27C, the apparatus 2 may respond to forward or backward movement of the weightlifter, and, as shown in FIGS. 27D-27E, the apparatus 2 may respond to lateral movements of the weightlifter. At least two advantages are gained by maintaining the cable guides directly overhead: 1. undesired force vectors (e.g., lateral forces) are minimized; and, 2. the barbell may be maintained at a given point, without need for the barbell to return to a starting point. Moreover, the ends of the barbell can move independently, with each end's movement being addressed.

The subject invention permits the full range of movement that athletes expect from conventional barbell resistance training (i.e., using free weights) while maintaining the spotting capability. The apparatus follows the movement of the athlete; the athlete does not compromise range of movement. If the weightlifter experiences any difficulties, one or more of the qualifying conditions may be met to cause the brakes to be engaged and the barbell 100 suspended, restricted from downward movement. The indicator lights 82*a*, 82*b* may turn red with braking engaged.

Once the exercise is completed, the weightlifter may cause one or more of the qualifying conditions with the brakes being engaged and the barbell be maintained at a desired height. This avoids the need to re-rack the barbell and minimizes injury. The indicator lights 82*a*, 82*b* may turn red with braking engaged.

Figure 28A:
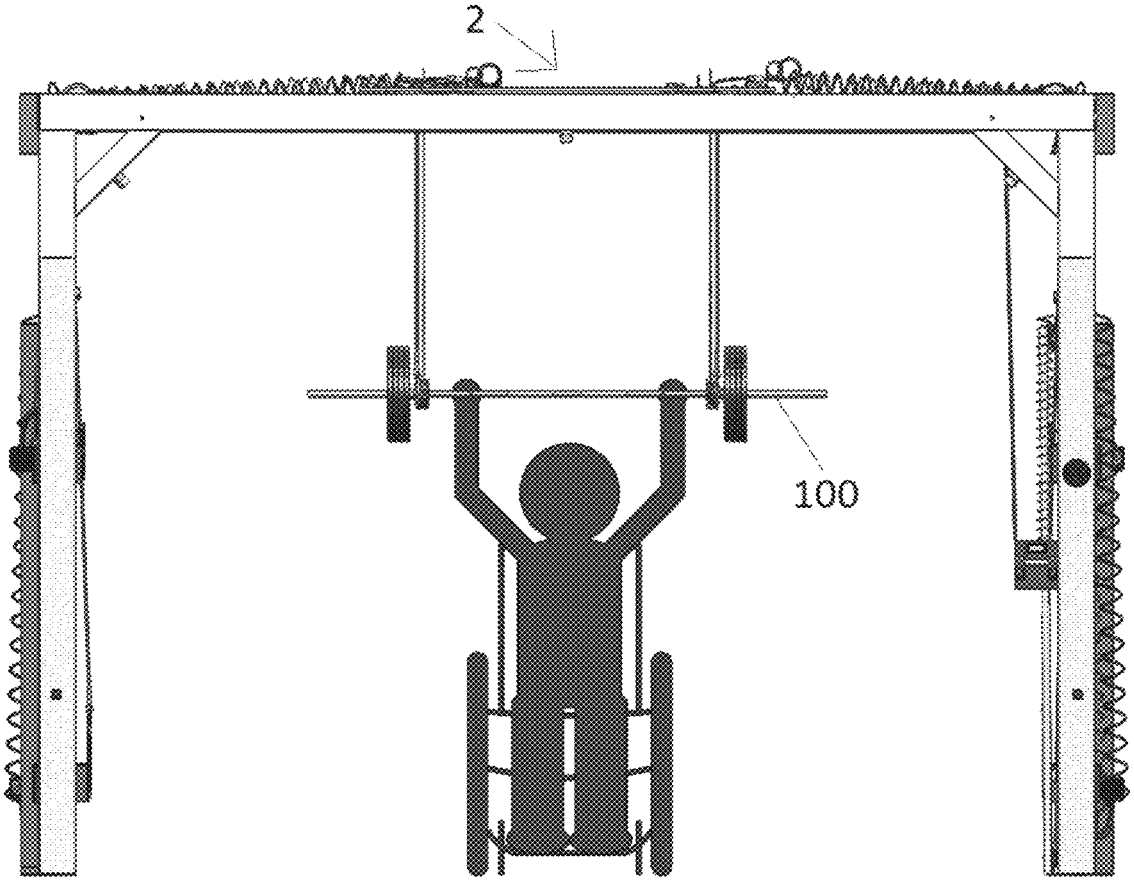
Figure 28B:
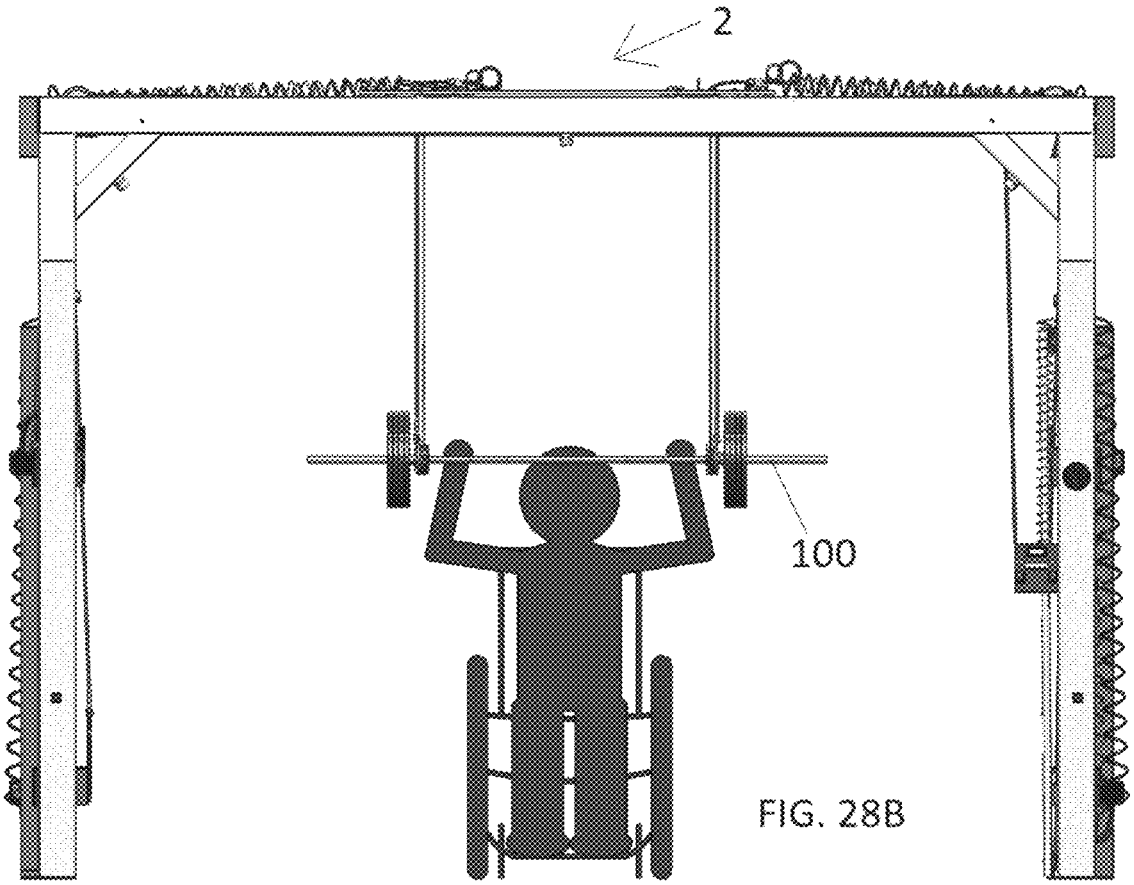
Figure 28C:
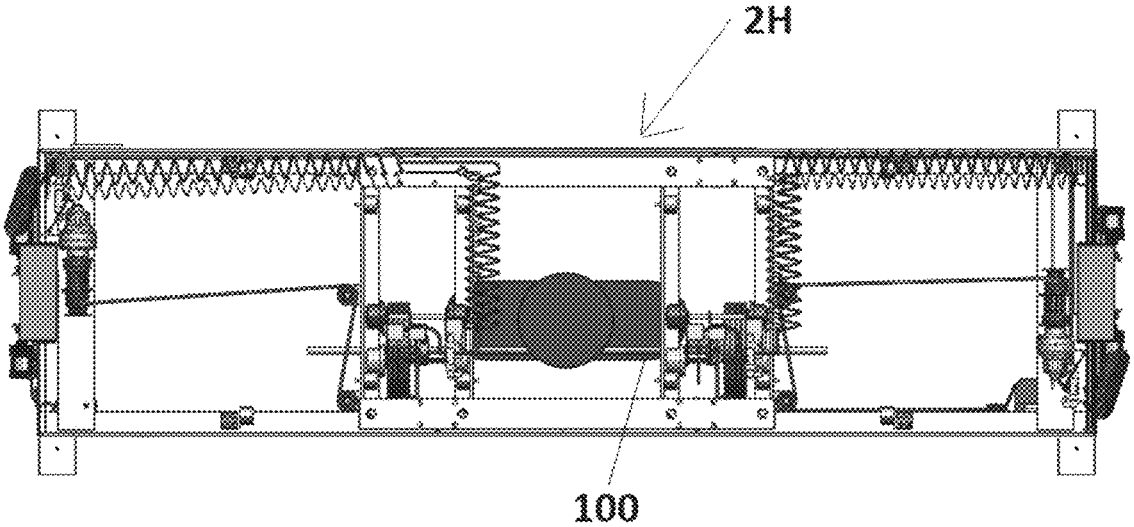

As shown in FIGS. 28A-28C, the apparatus 2 may be utilized by wheelchair-bound weightlifters, or with weightlifters having other disabilities. This allows for compliance with various laws and regulations providing equal access to fitness equipment.

As will be appreciated by those skilled in the art, the features discussed herein may be used in any combination in connection with any disclosed embodiment. Discussion of features in connection with a particular embodiment is not limiting to that embodiment. In addition, unless expressly indicated to be excluded for an embodiment, full disclosures of features apply with equal weight to all embodiments, even if referenced by multiple reference numbers.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A barbell spotting apparatus for exercise with unconstrained movement of a barbell, the barbell spotting apparatus comprising:

a frame including a base portion, configured to rest on a support surface, a top portion, spaced from the base portion along a vertical axis, and first and second overhanging booms extending upwardly and outwardly from the top portion;

an elongated trolley support frame supported by the first and second overhanging booms so that no portion of the trolley support frame overlaps the base portion as viewed along the vertical axis;

a first trolley resting on the trolley support frame so as to be movable along a longitudinal axis of the trolley support frame, wherein the first trolley includes a first sled supported thereby such that the first sled is movable along the first trolley in a first sled direction generally perpendicular to the longitudinal axis of the trolley support frame;

a first cable guide located on the first sled;

a second trolley resting on the trolley support frame so as to be movable along the longitudinal axis of the trolley support frame, wherein the second trolley includes a second sled supported thereby such that the second sled is movable along the second trolley in a second sled direction generally perpendicular to the longitudinal axis of the trolley support frame;

a second cable guide located on the second sled;

a first cable connected to a first end of the barbell, the first cable being suspended from the first cable guide;

a second cable connected to a second end of the barbell, the second cable being suspended from the second cable guide;

a first brake associated with the first cable, the first brake being actuatable from a rest state to a braking state, wherein, in the rest state, the first cable is extendible to allow downward movement of the barbell, and, wherein, in the braking state, the first cable is not extendible to restrict downward movement of the barbell;

a second brake associated with the second cable, the second brake being actuatable from a rest state to a braking state, wherein, in the rest state, the second cable is extendible to allow downward movement of the barbell, and, wherein, in the braking state, the second cable is not extendible to restrict downward movement of the barbell; and, at least one detector configured to detect a qualifying condition during use requiring downward movement of the barbell to be restricted, wherein, upon detection of the qualifying condition, the at least one detector transmits an actuation signal to at least one of the first brake and the second brake, wherein, the first and second brakes are independently actuatable.

2. The barbell spotting apparatus of claim 1, wherein the first trolley and the second trolley are connected.

3. The barbell spotting apparatus as in claim 1, wherein the frame being weighted to provide a counterweight against moment generated by the barbell about the overhanging booms.

4. The barbell spotting apparatus as in claim 1, wherein the at least one detector includes at least one microphone and at least one signal processor for receiving and processing a voice command from a user, to generate the actuation signal.

5. The barbell spotting apparatus as in claim 4, wherein the at least one microphone is located on the barbell.

6. The barbell spotting apparatus as in claim 4, wherein the at least one microphone is located on a coupling located on the barbell.

7. The barbell spotting apparatus as in claim 4, wherein the at least one microphone is located on the frame.

8. The barbell spotting apparatus as in claim 1, wherein the at least one detector includes at least one camera and at least one processor for receiving and processing captured video to analyze eye and eyelid movement of a user.

9. The barbell spotting apparatus as in claim 1, wherein the at least one detector includes at least one accelerometer configured to measure a rate of descent of the barbell.

10. The barbell spotting apparatus as in claim 1, wherein the at least one detector includes at least one reflective optical sensor configured to measure a rate of ascent of the first brake.

11. The barbell spotting apparatus as in claim 1, wherein the at least one detector includes at least one cable counter configured to measure a rate of movement of the first cable.

12. The barbell spotting apparatus as in claim 11, wherein the at least one detector includes a second cable counter configured to measure a rate of movement of the second cable.

13. The barbell spotting apparatus as in claim 12, wherein a processor is provided to evaluate differences in rate of movement of the first and second cables.

14. The barbell spotting apparatus as in claim 1, wherein the at least one detector includes at least one emergency button.

15. The barbell spotting apparatus as in claim 1, wherein the at least one detector includes at least one grip sensor located on the barbell.

16. The barbell spotting apparatus as in claim 1, wherein the frame includes at least one column, the at least one column being at least partially filled with water or sand.

17. The barbell spotting apparatus of claim 1, wherein the first trolley includes a plurality of wheels for rolling engagement with the trolley support frame to allow the first trolley to be moveable along the longitudinal axis of the trolley support frame.

18. The barbell spotting apparatus of claim 1, wherein the first sled includes a plurality of casters for rolling engagement with the first trolley to allow the first sled to move along the first trolley.

19. The barbell spotting apparatus of claim 1, wherein the first sled includes a plurality of toothed wheels engaging toothed tracks located on the first sled to allow the first sled to move along the first trolley.

20. The barbell spotting apparatus of claim 1, wherein, the first brake is a caliper brake.

21. The barbell spotting apparatus of claim 20, wherein, the frame includes a first column, wherein, with the first brake in the rest state, the first brake is movable along the first column in response to movement of the first cable, and, wherein, with the first brake in the braking state, the first brake brakingly engages the first column to restrict movement of the first cable.

22. The barbell spotting apparatus as in claim 21, wherein the second brake is a caliper brake.

23. The barbell spotting apparatus as in claim 22, wherein the frame includes a second column, wherein, with the second brake in the rest state, the second brake is movable along the second column in response to movement of the second cable, and, wherein, with the second brake in the braking state, the second brake brakingly engages the second column to restrict movement of the second cable.

24. The barbell spotting apparatus as in claim 22, wherein, in the rest state, the second brake is movable along the first column in response to movement of the second cable, and, wherein, with the second brake in the braking state, the second brake brakingly engages the first column to restrict movement of the second cable.

25. The barbell spotting apparatus as in claim 21, wherein the first column is tapered.

* * * * *